US005156014A

United States Patent [19]

Nakamura et al.

[11] Patent Number: 5,156,014

[45] Date of Patent: Oct. 20, 1992

[54] AIR CONDITIONING APPARATUS

[75] Inventors: Takashi Nakamura; Hidekazu Tani; Tomohiko Kasai; Shigeo Takata, all of Wakayama, Japan

[73] Assignee: Mitsubishi Denki Kabushiki Kaisha, Tokyo, Japan

[21] Appl. No.: 687,434

[22] Filed: Apr. 18, 1991

[30] Foreign Application Priority Data

| | | | |
|---|---|---|---|
| Apr. 23, 1990 | [JP] | Japan | 2-107904 |
| Apr. 23, 1990 | [JP] | Japan | 2-107905 |
| Apr. 23, 1990 | [JP] | Japan | 2-107906 |
| Apr. 23, 1990 | [JP] | Japan | 2-107907 |
| Apr. 23, 1990 | [JP] | Japan | 2-107908 |
| Apr. 23, 1990 | [JP] | Japan | 2-107909 |
| Apr. 23, 1990 | [JP] | Japan | 2-107910 |
| Apr. 23, 1990 | [JP] | Japan | 2-107911 |
| Apr. 23, 1990 | [JP] | Japan | 2-107912 |
| Apr. 23, 1990 | [JP] | Japan | 2-107913 |
| Apr. 23, 1990 | [JP] | Japan | 2-107931 |

[51] Int. Cl.[5] ..... F25B 13/00

[52] U.S. Cl. ..... 62/160

[58] Field of Search ..... 62/160, 324.6, 513

[56] References Cited

U.S. PATENT DOCUMENTS

| | | | |
|---|---|---|---|
| 4,760,707 | 8/1988 | Dennis et al. | 62/197 |
| 5,040,376 | 8/1991 | Ueno | 62/160 |
| 5,063,752 | 11/1991 | Nakamura et al. | 62/160 X |
| 5,065,588 | 11/1991 | Nakayama et al. . | |

FOREIGN PATENT DOCUMENTS

| | | |
|---|---|---|
| 0316685 | 5/1989 | European Pat. Off. . |
| 62-56429 | 11/1987 | Japan . |
| 2213248 | 8/1989 | United Kingdom . |

*Primary Examiner*—William E. Wayner

*Attorney, Agent, or Firm*—Oblon, Spivak, McClelland, Maier & Neustadt

[57] ABSTRACT

An air conditioning apparatus comprising: a single heat source device including a compressor, a reversing valve, an outdoor heat exchanger and an accumulator; a plurality of indoor units including indoor heat exchangers and first flow controllers; a first main pipe and a second main pipe for connecting between the heat source device and the indoor units; a first branch joint which can selectively connect one end of the indoor heat exchanger of each indor unit to either one of the first main pipe and the second main pipe; a second branch joint which is connected to the other end of the indoor heat exchanger of each indoor unit through the first flow controllers, and which is also connected to the second main pipe through a second flow controller; the first branch joint and the second branch joint being connected together through the second flow controller; the second branch joint being connected to the first main pipe through a fourth flow controller; a junction device which includes the first branch joint, the second flow controller, the fourth flow controller and the second branch joint, and which is interposed between the heat source device and the indoor units; and the first main pipe having a greater diameter than the second main pipe; and a switching valve arrangement which can be arranged between the first main pipe and the second main pipe in the heat source device to switch the first main pipe and the second main pipe to a low pressure side and to a high pressure side, respectively.

11 Claims, 39 Drawing Sheets

AIR CONDITIONING APPARATUS

The present invention relates to a multi-room heat pump type of air conditioning apparatus wherein a single heat source device is connected to a plurality of indoor units. More particularly, the present invention relates to an air conditioning apparatus wherein room cooling and room heating can be selectively carried out for each indoor unit, or wherein room cooling can be carried out in one or some indoor units, and simultaneously room heating can be carried out in the other indoor unit(s).

There has been known a heat pump type air conditioning apparatus wherein a single heat source device is connected to a plurality of indoor units through two pipes, i.e., a gas pipe and a liquid pipe, and room cooling and room heating can be selectively performed. Such a heat pump type of air conditioning apparatus is constructed to carry out the same operation mode in all indoor units, i.e., to carry out either room heating or room cooling in all indoor unit at the same time.

Since the conventional multi-room heat pump type of air conditioning apparatus has been constructed as noted above, all indoor units can carry out either one of room heating and room cooling at the same time, which creates problems wherein a room required for cooling is subjected to room heating, and wherein a room required for heating is subjected to room cooling.

In particular, when the conventional air conditioning apparatus is installed in a large-scale building, the problems as stated just above are serious because interior zones and perimeter zones, or ordinary office rooms and office-automated rooms such as computer rooms are totally different in terms of air conditioning load.

It is an object of the present invention to resolve these problems, and provide a multi-room heat pump type air conditioning apparatus wherein a single heat source device is connected to a plurality of indoor units, and the respective indoor units can selectively carry out either room cooling or room heating to perform room cooling in one or some of the indoor units and room heating in the other indoor unit(s) at the same time, whereby even if interior zones and perimeter zones, or ordinary office rooms and office-automated rooms such as computer rooms are totally different in terms of air conditioning load in the case of installment of the apparatus in a large-scale building, the apparatus can cope with the requirements of room cooling and room heating the spaces with the respective indoor units installed in them.

The foregoing and other objects of the present invention have been attained by providing an air conditioning apparatus comprising a single heat source device including a compressor, a reversing valve, an outdoor heat exchanger and an accumulator; a plurality of indoor units including indoor heat exchangers and first for controllers; a first main pipe and a second main pipe for connecting between the heat source device and the indoor units; a first branch joint which can selectively connect one end of the indoor heat exchanger of each indoor unit to either one of the first main pipe and the second main pipe; a second branch joint which is connected to the other end of the indoor heat exchanger of each indoor unit through the first flow controllers, and which is also connected to the second main pipe through a second flow controller; the first branch joint and the second branch joint being connected together through the second flow controller; the second branch joint being connected to the first main pipe through a fourth flow controller; a junction device which includes the first branch joint, the second flow controller, the fourth flow controller and the second branch joint, and which is interposed between the heat source device and the indoor units; the first main pipe having a greater diameter than the second main pipe; and a switching valve arrangement between the first main pipe and the second main pipe in the heat source device; wherein the first main pipe and the second main pipe can be switched to a low pressure side and to a high pressure side, respectively.

In a preferred embodiment of the present invention, a gas-liquid separator is arranged in the second main pipe; the second flow controller is connected between the gas-liquid separator and the second branch joint; and the junction device includes the gas-liquid separator in addition to the first branch joint, the second flow controller, the fourth flow controller and the second branch joint.

In another preferred embodiment of the present invention, there are provided a bypass pipe which has one end connected to the second branch joint and the other end connected to the first main pipe through a third flow controller; a first heat exchanging portion which carries out heat exchange between the bypass pipe connecting the third flow controller and the first main pipe, and a pipe connecting the second main pipe and the second flow controller; and the junction device which includes the third flow controller, the first heat exchanging portion and the bypass pipe in addition to the first branch joint, the second branch joint, the second flow controller and the fourth flow controller; thereby to carry out such control that a refrigerant in the second main pipe takes a two phase state, and the state of the refrigerant at an outlet of the first heat exchanging portion achieves a set degree of subcooling.

In another preferred embodiment, there are provided a bypass pipe which has one end connected to the second branch joint and the other end connected to the first main pipe through a third flow controller; a heat exchanging portion which carries out heat exchange at a confluent portion of branch pipes for connecting between the respective indoor units and the second branch joint; heat exchanging portions which carry out heat exchange between the branch pipes and a part of the bypass pipe downstream of the third flow controller; first pressure detecting means arranged between the first branch joint and the second flow controller; second pressure detecting means arranged between the second flow controller and the fourth flow controller; and flow controller control means which controls the third and fourth flow controllers in a way to bring a pressure difference detected by the first and second pressure detecting means in a predetermined range under an operation wherein the indoor units carry out cooling and heating concurrent operation and the outdoor heat exchanger works as evaporator.

In another preferred embodiment, the flow controller control means carries out such control that when the flow rates of the third and fourth flow controllers are increased, the third flow controller takes priority over the fourth flow controller, and wherein when the flow rates of the third and fourth flow controllers are decreased, the fourth flow controller takes priority over the third flow controller.

In another preferred embodiment, there are provided first pressure detecting means on the pipe between the first branch joint and the second flow controller; second pressure detecting means on the pipe between the second flow controller and the fourth flow controller; and flow controller control means for controlling the fourth flow controller in a way to bring the difference between the pressures detected by the first and second pressure detecting means in a predetermined range when heating is carried out at all the indoor units.

In another preferred embodiment, the first branch joint can selectively connect the one end of the indoor heat exchangers to either one of the main pipe and the second main pipe through either one of the first main pipe and a gas-liquid separator; the first branch joint and the second branch joint are connected together through the gas-liquid separator and the second flow controller; there is provided a bypass pipe which has one end connected to the second branch joint and the other end connected to the first main pipe through a third flow controller; there is provided a first heat exchanging portion which carries out heat exchange between the bypass pipe connecting the third flow controller and the first main pipe, and the pipe connecting the second main pipe and the second flow controller; there is provided boundary surface detecting means for detecting a boundary surface at which a gaseous refrigerant and a liquid refrigerant are divided in the gas-liquid separator; the junction device includes the third flow controller, the first heat exchanging portion, the boundary surface detecting means and the bypass pipe in addition to the first branch pipe, the second branch pipe, the second flow controller and the fourth flow controller; wherein the boundary surface of the gaseous refrigerant and the liquid refrigerant in the gas-liquid separator is controlled to be at a lower position than a predetermined level, and the refrigerant at the outlet of the first heat exchanging portion is controlled to have a predetermined degree of subcooling.

In another preferred embodiment, the first branch joint is provided with first branch ports for connection to the indoor units; the second branch joint is provided with second branch ports for connection to the indoor units; there is provided a bypass pipe which has one end connected to the second branch joint and the other end connected to the first main pipe through a third flow controller; there are provided third heat exchanging portions which carry out heat exchange between the bypass pipe connecting the third flow controller to the first main pipe, and branch pipes connecting the indoor units to the second branch joint; and the junction device includes the third flow controller, the third heat exchanging portions and the bypass pipe as well; wherein depending on the capability of the indoor units connected to the junction device, selection of an individual use of the respective first branch ports and a combined use of some first branch ports is made for connection to the indoor units, and selection of an individual use of the respective second branch ports and a combined use of some second branch ports is also made for connection to the indoor units.

In another preferred embodiment, in defrosting under cooling and heating concurrent operation the four way reversing valve is switched, a cooling indoor unit continues cooling, and the first branch joint and the first flow controller which are connected to a heating indoor unit are closed.

In another preferred embodiment, in defrosting the four way reversing valve is switched, the first branch joint and the first flow controllers are closed, and the second and fourth flow controllers are opened.

In another preferred embodiment, there is provided a bypass pipe which connects between the second branch joint and the first main pipe through a third flow controller; there are provided a first heat exchanging portion which carries out heat exchange between the bypass pipe connecting the third flow controller and the first main pipe, and a pipe connecting the second main pipe and the second flow controller, and a second heat exchanging portion which carries out heat exchange between the bypass pipe connecting the third flow controller and the first main pipe, and the second branch joint; the junction device includes the third flow controller as well.

Now, the present invention will be described in detail with reference to preferred embodiments illustrated in the accompanying drawings.

Explanation of the preferred embodiments will be made for the case wherein a single heat source device is connected to three or two indoor units. The following explanation is also applicable to the case wherein a single source device is connected to more than three indoor units.

A first embodiment of the present invention will be explained, referring to FIGS. 1 to 4.

Figure 1:
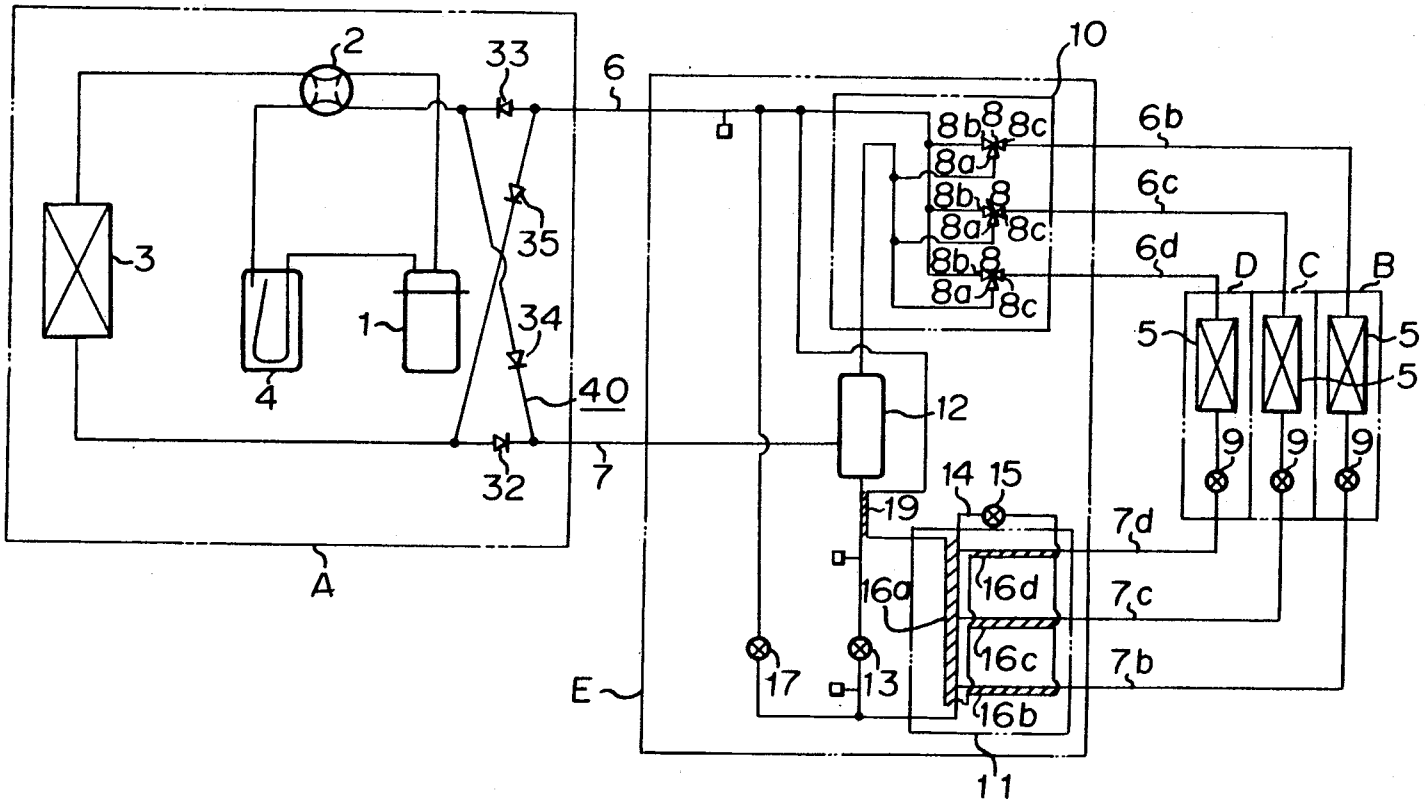
FIG. 1 is a schematic diagram of the entire structure of a first and a fifteenth embodiment of the air conditioning apparatus according to the present invention, which is depicted on the basis of the refrigerant system of the apparatus.

In FIG. 1, reference numeral A designates the heat source device. Reference numerals B, C and D designate the indoor units which are connected in parallel as described later on, and which have the same structure.

Reference numeral E designates a junction device which includes a first branch joint, a second flow controller, a second branch joint, a gas-liquid separator, heat exchanging portions, a third flow controller, and a fourth flow controller.

Reference numeral 1 designates a compressor. Reference numeral 2 designates a four port reversing valve which can switch the flow direction of a refrigerant in the heat source device. Reference numeral 3 designates an outdoor heat exchanger which is installed on the side of the heat source device. Reference numeral 4 designates an accumulator which is connected to the compressor 1, the reversing valve 2 and the outdoor heat exchanger 3 to constitute the heat source device A. Reference numeral 5 designates three indoor heat exchangers. Reference numeral 6 designates a first main pipe which has a large diameter and which connects the four way reversing valve 2 of the heat source device A and the junction device E. Reference numerals 6b, 6c and 6*d* designate first branch pipes which connect the junction device E and the indoor heat exchangers 5 of the respective indoor units B, C and D, and which correspond to the first main pipe 6. Reference numeral 7 designates a second main pipe which has a smaller diameter than the first main pipe 6, and which connects the junction device E and the outdoor heat exchanger 3 of the heat source device A. Reference numerals 7*b*, 7*c* and 7*d* designate second branch pipes which connect the junction device E and the indoor heat exchangers 5 of the respective indoor units B, C and D, and which correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates first flow controllers which are connected to the respective indoor heat exchangers 5 in close proximity to the same, which are controlled based on superheat amounts on room cooling and subcooling amounts on room heating at refrigerant outlet sides of the respective indoor heat exchangers, and which are connected to the second branch pipes 7*b*, 7*c* and 7*d*, respectively. Reference numeral 10 designates the first branch joint which includes the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d*, and the second main pipe 7. Reference numeral 12 designates the gas-liquid separator which is arranged in the second main pipe 7, and which has a gas layer zone connected to first ports 8*a* of the respective switching valves 8 and a liquid layer zone connected to the second branch joint 11. Reference numeral 13 designates the second flow controller which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller which is arranged in the bypass pipe 14. Reference numerals 16*b*, 16*c* and 16*d* designate the third heat exchanging portions which are arranged in the bypass pipe 14 downstream of the third flow controller 15, and which carry out heat exchange with the respective second branch pipes 7*b*, 7*c* and 7*d* in the second branch joint 11. Reference numeral 16*a* designates the second heat exchanging portion which is arranged in the bypass pipe 14 downstream of the third flow controller 15, and which carries out heat exchanging with a confluent portion where the second branch pipes 7*b*, 7*c* and 7*d* join in the second branch joint. Reference numeral 19 designates the first heat exchanging portion which is arranged in the bypass pipe 14 downstream of the third flow controller and the second heat exchanging portion 16*a*, and which carries out heat exchanging with the pipe which connects between the gas-liquid separator 12 and the second flow controller 13. Reference numeral 17 designates the fourth flow controller which is arranged in a pipe between the second branch joint 11 and the first main pipe 6, and which can be selectively opened and closed. Reference numeral 32 designates a third check valve which is arranged between the outdoor heat exchanger 3 and the second main pipe 7, and which allows the refrigerant only to flow from the outdoor heat exchanger 3 to the second main pipe 7. Reference numeral 33 designates a fourth check valve which is arranged between the four way reversing valve 2 of the heat source device A and the first main pipe 6, and which allows the refrigerant only to flow from the first main pipe 6 to the reversing valve 2. Reference numeral 34 designates a fifth check valve which is arranged between the reversing valve 2 and the second main pipe 7, and which allows the refrigerant only to flow from the reversing valve 2 to the second main pipe 7. Reference numeral 35 designates a sixth check valve which is arranged between the outdoor heat exchanger 3 and the first main pipe 6, and which allows the refrigerant only to flow from the first main pipe 6 to the outdoor heat exchanger 3. These check valves 32– 35 constitute a switching valve arrangement 40.

The operation of the first embodiment as constructed above will be explained.

Figure 2:
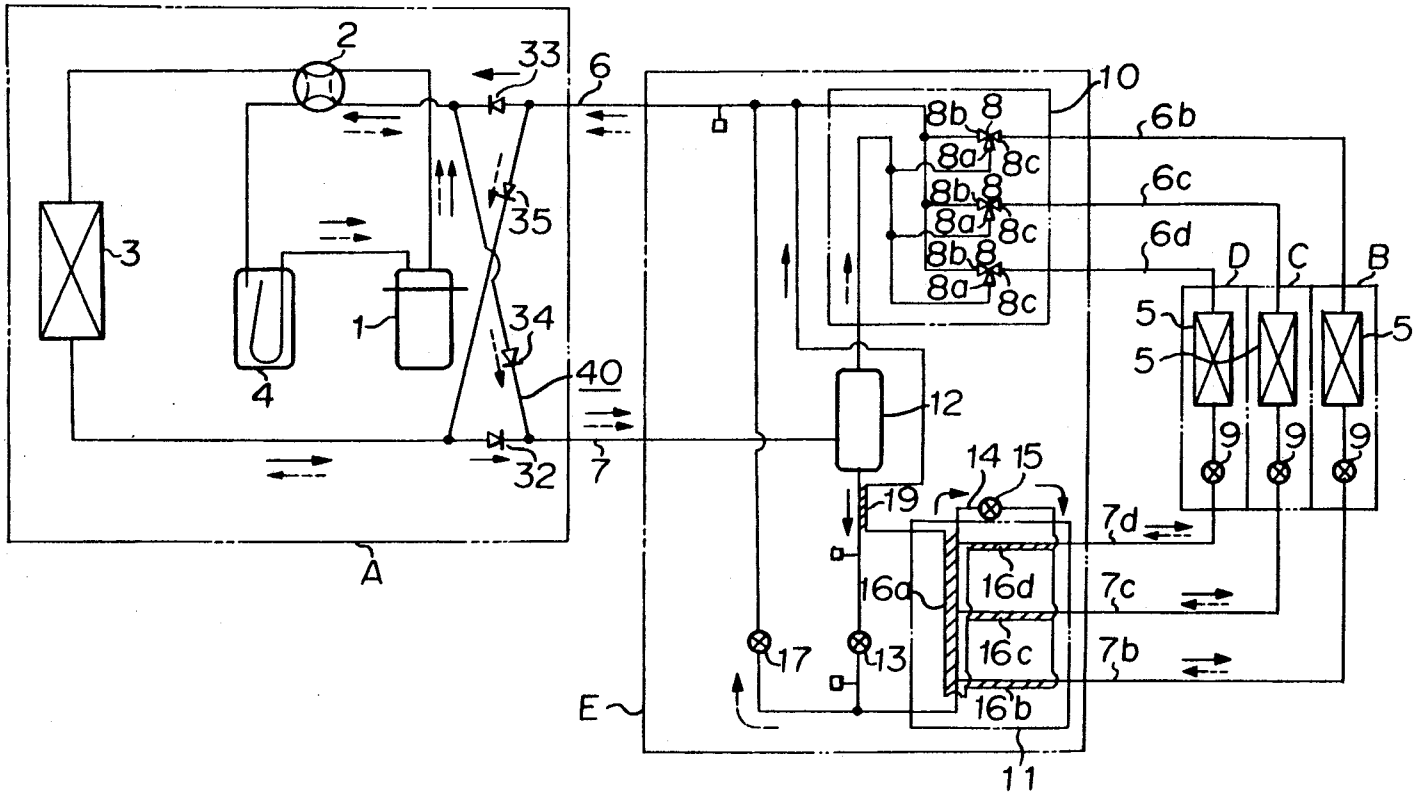
FIG. 2 is a schematic diagram showing the operation states of the first and the fifteenth embodiment of FIG. 1 wherein solo operation on room cooling and solo operation on room heating are performed.

Firstly, the case wherein only room cooling is performed will be explained with reference to FIG. 2.

In this case, the flow of the refrigerant is indicated by arrows of solid line. The refrigerant gas which has discharged from the compressor 1 and been a gas having high temperature under high pressure passes through the four way reversing valve 2, and is heat exchanged and condensed in the outdoor heat exchanger 3 to be liquefied. Then, the liquefied refrigerant passes through the third check valve 32, the second main pipe 7, the separator 12 and the second flow controller 13 in that order. The refrigerant further passes through the second branch joint 11 and the second branch pipes 7*b*, 7*c* and 7*d*, and enters the indoor units B, C and D. The refrigerant which has entered the indoor units B, C and D is depressurized to low pressure by the first flow controllers 9 which are controlled based on the superheat amounts at the outlet refrigerants of the respective indoor heat exchanger 5. In the indoor heat exchangers 5, the refrigerant thus depressurized carries out heat exchanging with the air in the rooms having the indoor heat exchangers to be evaporated and gasified, thereby cooling the rooms. The refrigerant so gasified passes through the first branch pipes 6*b*, 6*c* and 6*d*, the three way switching valves 8, and the first branch joint 10. Then the refrigerant is inspired into the compressor through the first main pipe 6, the fourth check valve 33, the four way reversing valve 2 in the heat source device, and the accumulator 4. In this way, a circulation cycle is formed to carry out room cooling. At this mode, the three way switching valves 8 have the first ports 8*a* closed, and second ports 8*b* and third ports 8*c* opened. At the time, the first main pipe 6 is at low pressure in it, and the second main pipe 7 is at high pressure in it, which necessarily make the third check valve 32 and the fourth check valve 33 to conduct for the refrigerant. In addition, in this mode, the refrigerant, which has passed through the second flow controller 13, partly enters the bypass pipe 14 where the entered part of the refrigerant is depressurized to low pressure by the third flow controller 15. The refrigerant thus depressurized carries out heat exchanging with the second branch pipes 7*b*, 7*c* and 7*d* at the third heat exchanging portions 16*b* 16*c* and 16*d*, with the confluent portion of the second branch pipes 7*b*, 7*c* and 7*d* at the second heat exchanging portion 16*a* in the second branch joint 11, and at the first heat exchanging portion 19 with the refrigerant which enters the second flow controller 13. The refrigerant is evaporated due to such heat exchanging, and enters the first main pipe 6 and the fourth check valve 33. Then the refrigerant is inspired into the compressor 1 through the first four way reversing valve 2 and the accumulator 4.

On the other hand, the refrigerant, which has heat exchanged at the first heat exchanging portion 19, the second heat exchanging portion 16*a*, and the third heat exchanging portions 16*b*, 16*c* and 16*d*, and has been cooled so as to get sufficient subcooling, enters the indoor units B, C and D which are expected to carry out room cooling.

Secondly, the case wherein only room heating is performed will be described with reference FIG. 2. In this case, the flow of the refrigerant is indicated by arrows of dotted line.

The refrigerant which has been discharged from the compressor 1 and been a gas having high temperature under high pressure passes through the four way reversing valve 2, the fifth check valve 34, the second main pipe 7, and the gas-liquid separator 12. Then the refrigerant passes through the first branch joint 10, the three way switching valves 8, and the first branch pipes 6*b*, 6*c* and 6*d* in that order. After that, the refrigerant enters the respective indoor units B, C and D where the refrigerant carries out heat exchanging with the air in the rooms having the indoor units. The refrigerant is condensed to be liquefied due to such heat exchanging, thereby heating the rooms. The refrigerant thus liquefied passes through the first flow controllers 9 which are controlled based on subcooling amounts at the refrigerant outlets of the respective indoor heat exchangers 5. Then the refrigerant enters the second branch joint 11 through the second branch pipes 7*b*, 7*c* and 7*d*, and joins there. Then the joined refrigerant passes through the fourth flow controller 17. The refrigerant is depressurized by either the first flow controllers 9 or the fourth flow controller 17 to take a two phase state having low pressure. The refrigerant thus depressurized enters the outdoor heat exchanger 3 through the first main pipe 6 and the sixth check valve 35 of the heat source device A, and carries out heat exchanging to be evaporated and gasified. The refrigerant thus gasified is inspired into the compressor 1 through the four way reversing valve 2 of the heat source device, and the accumulator 4. In this way, a circulation cycle is formed to carry out room heating. In this mode, the switching valves 8 have the second ports 8*b* closed, and the first and the third ports 8*a* and 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant.

Figure 3:
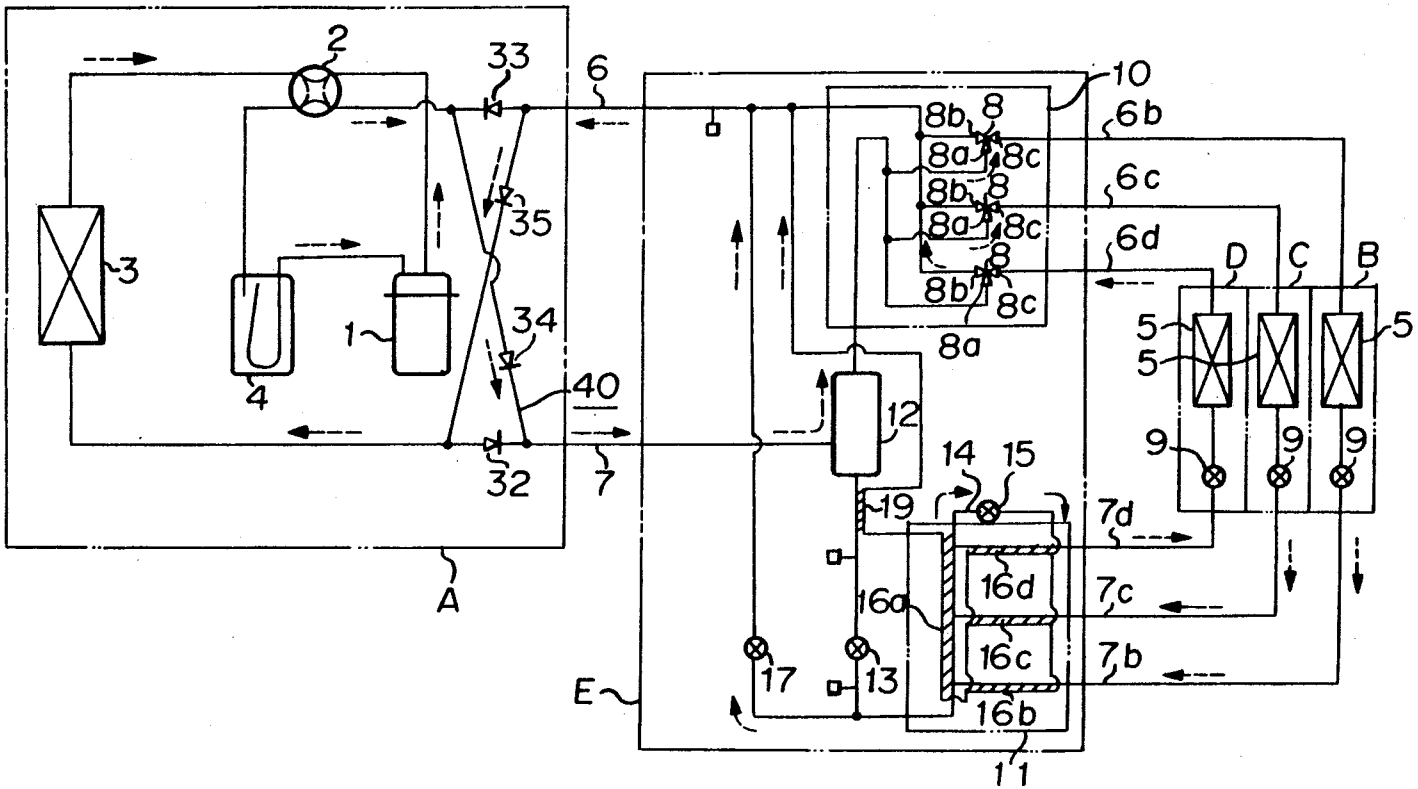
FIG. 3 is a schematic diagram showing the operation state of the first and the fifteenth embodiment of FIG. 1 wherein room heating is principally performed under room cooling and room heating concurrent operation (heating load is greater than cooling load)

Thirdly, the case wherein room heating is principally performed in room cooling and room heating concurrent operation will be explained with reference to FIG. 3. In FIG. 3, arrows of dotted line indicate the flow of the refrigerant.

The refrigerant which has been discharged from the compressor 1, and been a gas having high temperature under high pressure passes through the four way reversing valve 2, and then reaches the junction device E through the fifth check valve 34 and the second main pipe 7. The refrigerant flows through the gas-liquid separator 12. In addition, the refrigerant passes through the first branch joint 10, the three way switching valves 8, and the first branch pipes 6*b* and 6*c* in that order, and enters the indoor units B and C which are expected to carry out room heating. In the indoor heat exchangers 5 of the respective indoor units B and C, the refrigerant carries out heat exchange with the air in the rooms having the indoor units B and C installed in them, to be condensed and liquefied, thereby heating the rooms. The refrigerant thus condensed and liquefied passes through the first flow controllers 9 of the indoor units B and C, the first controllers 9 of the indoor units B and C being almost fully opened under the control based on subcooling amounts at the refrigerant outlets of the corresponding indoor heat exchangers 5. The refrigerant is slightly depressurized by these first flow controllers 9, and flows into the second blanch joint 11. After that, a part of the refrigerant passes through the second branch pipe 7*d* of the indoor unit D which is expected to carry out room cooling, and enters the indoor unit D. The refrigerant flows into the first flow controller 9 of the indoor unit D, the first flow controller 9 being controlled based on a superheat amount at the refrigerant outlet of the corresponding indoor heat exchanger 5. After the refrigerant is depressurized by this first flow controller 9, it enters the indoor heat exchanger 5, and carries out heat exchange to be evaporated and gasified, thereby cooling the room with this indoor heat exchanger 5 in it. Then the refrigerant enters the first main pipe 6 through the three way switching valve 8 which is connected to the indoor unit D.

On the other hand, another part of refrigerant passes through the fourth flow controller 17 which is selectively opened and closed depending on value indicative of high pressure in the second main pipe 7 and value indicative of intermediate pressure in the second branch joint 11. Then the refrigerant joins with the refrigerant which has passed the indoor unit D which is expected to carry out room cooling. After that, the refrigerant thus joined passes through the first main pipe 6 having such a larger diameter, and the sixth check valve 35 of the heat source device A, and enters the outdoor exchanger 3 where the refrigerant carries out heat exchange to be evaporated and gasified. The refrigerant thus gasified is inspired into the compressor 1 through the heat source device reversing valve 2 and the accumulator 4. In this way, a circulation cycle is formed to carry out the room cooling and room heating concurrent operation wherein room heating is principally performed. At this time, the difference between the evaporation pressure in the indoor heat exchanger 5 of the room cooling indoor unit D and that of the outdoor heat exchanger 3 lessens because of switching to the first main pipe 6 having such a greater diameter. At that time, the three port switching valves 8 which are connected to the room heating indoor units B and C have the second ports 8*b* closed, and the first and third ports 8*a* and 8*c* opened. The three port switching valve 8 which is connected to the room cooling indoor unit D has the second port 8*a* closed, and the first port 8*b* and the third port 8*c* opened.

In this mode, the first main pipe 6 is at low pressure in it, and the second main pipe 7 is at high pressure in it, which necessarily causes the fifth check valve 34 and the sixth check valve 35 to conduct for the refrigerant. At this circulation cycle, the remaining part of the liquefied refrigerant goes into the bypass pipe 14 from the confluent portion of the second branch joint 11 where the second branch pipes 7*b*, 7*c* and 7*d* join together. The refrigerant which has gone into the bypass pipe 14 is depressurized to low pressure by the third flow controller 15. The refrigerant thus depressurized carries out heat exchange with the refrigerant in the second branch pipes 7*b*, 7*c* and 7*d* at the third heat exchanging portions 16*b*, 16*c* and 16*d*, with the refrigerant in the confluent portion of the second branch pipes 7*b*, 7*c* and 7*d* in the second branch joint 11 at the second heat exchanging portion 16*a*, and at the first heat exchanging portion 19 with the refrigerant which comes from the second flow controller 13. The refrigerant is evaporated by such heat exchange, and enters the first main pipe 6. After that, the refrigerant flows into the sixth check valve 35 and then into the outdoor heat exchanger 3 where it performs heat exchange to be evaporated and gasified. The refrigerant thus gasified is inspired into the compressor 1 through the first four way reversing valve 2 and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcooling flows into the indoor unit D which is expected to cool the room with the indoor unit D installed in it.

Fourthly, the case wherein room cooling is principally performed in room cooling and room heating concurrent operation will be described with reference to FIG. 4.

Figure 4:
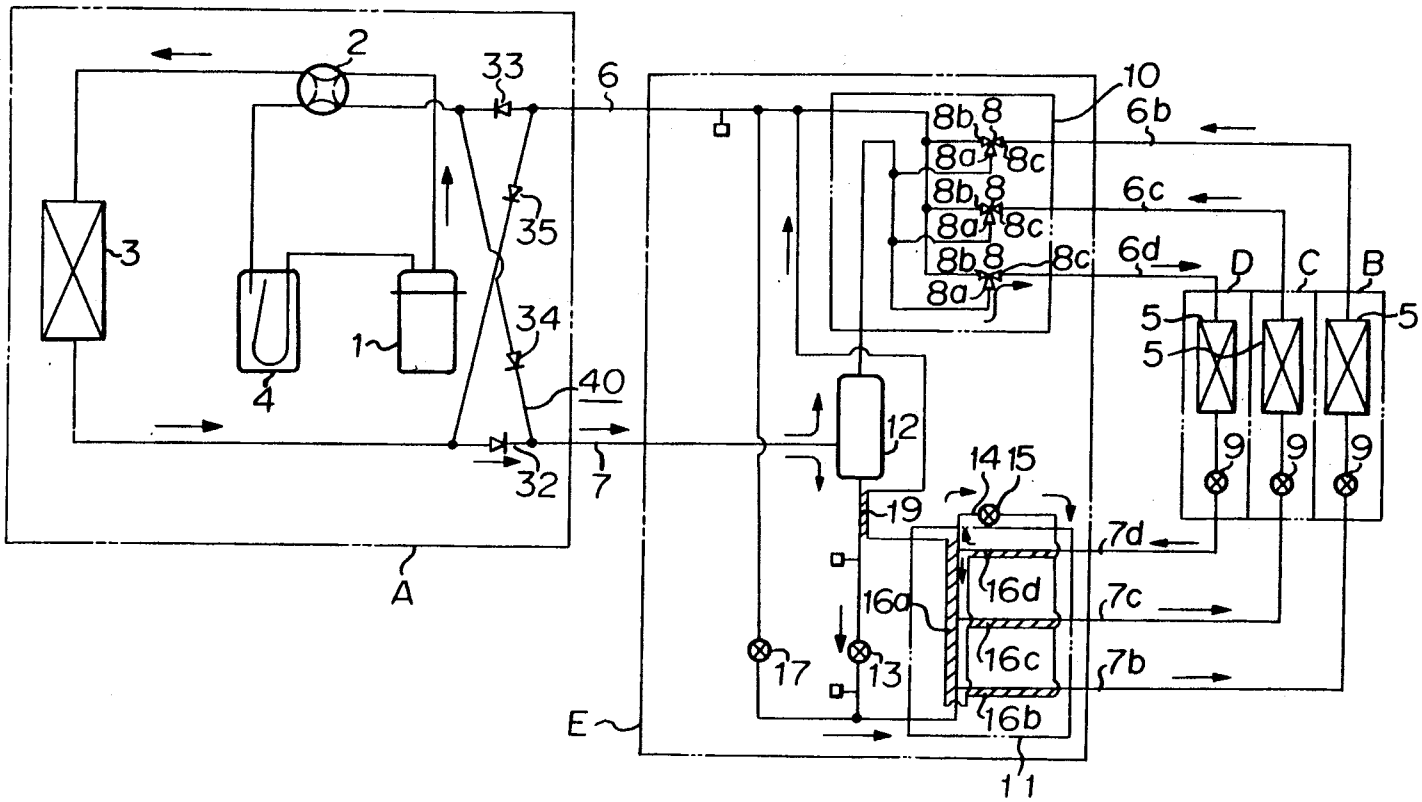
FIG. 4 is a schematic diagram showing the operation state of the first and the fifteenth embodiment of the FIG. 1 wherein room cooling is principally performed under room cooling and room heating concurrent operation (cooling load is greater than heating load)

In FIG. 4, arrows of solid lines indicate the flow of the refrigerant. The refrigerant which has been discharged from the compressor 1 and been a gas having high temperature under high pressure carries out heat exchange at an arbitrary amount in the outdoor heat exchanger 3 to take a two phase state having high temperature under high pressure. Then the refrigerant passes through the third check valve 32 and the second main pipe 7, and is forwarded to the gas-liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe 6*d* which are connected to the indoor unit D, in that order, the indoor unit D being expected to heat the room with the indoor unit D installed in it. The refrigerant flows into the indoor unit D, and carries out heat exchange with the air in the room with the indoor heat exchanger 5 of the heating indoor unit D installed in it to be condensed and liquefied, thereby heating the room. In addition, the refrigerant passes through the first flow controller 9 connected to the room heating indoor unit D, this first flow controller 9 being almost fully opened under the control based on an subcooling amount at the refrigerant outlet of the indoor heat exchanger 5 of the heating indoor unit D. The refrigerant is slightly depressurized by this first flow controller 9, and flows into the second branch joint 11. On the other hand, the remaining liquid refrigerant enters the second branch joint 11 through the second flow controller 13 which can be selectively opened and closed depending on value indicative of pressure in the second main pipe 7 and value indicative of intermediate pressure in the second branch joint 11. Then the refrigerant joins there with the refrigerant which has passed through the heating indoor unit D. The refrigerant thus joined passes through the second branch joint 11, and then the second branch pipes 7*b* and 7*c*, respectively, and enters the respective indoor units B and C. The refrigerant which has flowed into the indoor units B and C is depressurized to low pressure by the first flow controllers 9 of the indoor units B and C, these first flow controllers 9 being controlled based on superheat amounts at the refrigerant outlets of the corresponding indoor heat exchangers 5. Then the refrigerant flows into the indoor heat exchangers 5, and carries out heat exchange with the air in the rooms having these indoor units B and C to be evaporated and gasified, thereby cooling these rooms. In addition, the refrigerant thus gasified passes through the first branch pipes 6*b* and 6*c*, the three way switching valves 8, and the first branch joint 10. Then the refrigerant is inspired into compressor 1 through the first main pipe 6, the fourth check valve 33, the four way reversing valve 2 in the heat source device A, and the accumulator 4. In this way, a circulation cycle is formed to carry out the room cooling and room heating concurrent operation wherein room cooling is prir cipally performed. In this mode, the three way switching valves 8 which are connected to the indoor units B and C have the first ports 8*a* closed, and the second and third ports 8*b* and 8*c* opened. The three way switching valve 8 which is connected to the indoor unit D has the second port 8*b* closed, and the first and third ports 8*a* and 8*c* opened.

At that time, the first main pipe 6 is at low pressure in it, and the second main pipe 7 is a high pressure in it, which necessarily causes the third check valve 32 and the fourth check valve 33 to conduct for the refrigerant.

In this circulation cycle, the liquid refrigerant partly enters the bypass pipe 14 from the confluent portion of the second branch joint 11 where the second branch pipes 7*b*, 7*c* and 7*d* join together. The liquid refrigerant which has entered into the bypass pipe 14 is depressurized to low pressure by the third flow controller 15. The refrigerant thus depressurized carried out heat exchange with the refrigerant in the second branch pipes 7*b*, 7*c* and 7*d* at the third heat exchanging portions 16*b*, 16*c* and 16*d*, and at the second heat exchanging portion 16*a* with the refrigerant in the confluent portion of the second branch pipes 7*b*, 7*c* and 7*d* in the second branch joint 11, and at the first heat exchanging portion 19 with the refrigerant which flows into the second flow controller 13. The refrigerant is evaporated by such heat exchange, and enters the first main pipe 6. The refrigerant which has entered the first main pipe 6 is inspired into the compressor 1 through the fourth check valve 33, the four way reversing valve 2 in the heat source device A, and the accumulator 4.

On the other hand, the refrigerant in the second branch joint 11 which has carried out heat exchange and cooled at the first heat exchanging portion 19, the second heat exchanging portion 16*a*, and the third heat exchanging portions 16*b*, 16*c* and 16*d* to obtain sufficient subcool flows into the indoor units B and C which are expected to carry out room cooling.

Figure 5:
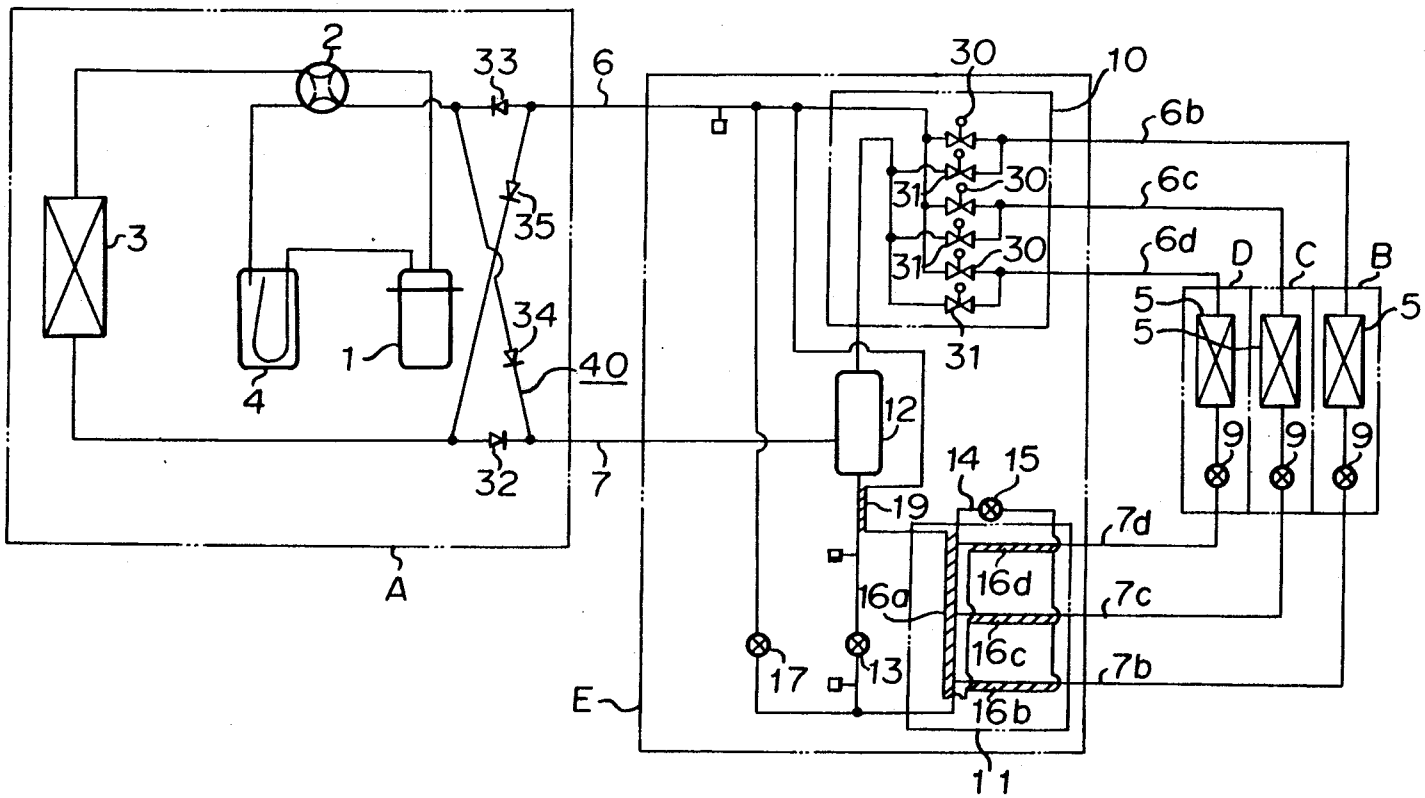
FIG. 5 is a schematic diagram showing the entire structure of a second embodiment which is depicted on the basis of the refrigerant system of the apparatus.

Although in the first embodiment the three way switching valves 8 can be arranged to selectively connect the first branch pipes 6*b*, 6*c* and 6*d* to either the first main pipe 6 or the second main pipe 7, paired on-off valves such as solenoid valves 30 and 31 can be provided instead of the three way switching valves as shown as a second embodiment in FIG. 5 to make selective switching, offering similar advantage.

In accordance with the first and second embodiments, in the case wherein room heating is principally performed in room cooling and room heating concurrent operation, the gaseous refrigerant under high pressure is directed through the switching valve arrangement, the second main pipe and the first branch joint to the indoor units which are expected to carry out heating. The refrigerant, which has carried out heating, partly enters the indoor unit which is expected to carry out cooling. The refrigerant which has carried out cooling flows into the first main connecting pipe through the first branch joint. On the other hand, the remaining refrigerant passes through the fourth flow controller, and joins, in the first main pipe, with the refrigerant which has passed through the cooling indoor unit. The refrigerant thus joined returns to the switching valve arrangement.

In the case wherein room cooling is principally performed in room cooling and room heating concurrent operation, the gaseous refrigerant under high pressure carries out heat exchange at an arbitrary amount in the heat source device to take a two phase state. Such refrigerant enters the gas-liquid separator through the switching valve arrangement and the second main pipe. The gaseous refrigerant which has been separated in the gas-liquid separator is directed through the first branch joint to an indoor unit which is expected to carry out heating. The refrigerant which has carried out heating enters the second branch joint. On the other hand, the remaining liquid refrigerant which has been separated in the gas-liquid separator passes through the second flow controller, and joins, at the second branch joint, with the refrigerant which has passed through the heating indoor unit. The refrigerant thus joined enters indoor units which are expected to carry out cooling. The refrigerant which has carried out cooling is directed to the switching valve arrangement through the first branch joint and the first main pipe, and returns to the compressor.

In the case wherein only room heating is performed, the refrigerant is directed to the indoor units through the switching valve arrangement, the second main pipe and the first branched joint. The refrigerant which has carried out heating goes into the first main connecting pipe through the second branch joint, and returns to the switching valve arrangement.

In the case wherein only room cooling is performed, the refrigerant is detected to the indoor units through the switching valve arrangement, the second main pipe and the second branch joint. The refrigerant which has carried out cooling goes into the first main pipe through the first branch joint, and returns to the switching valve arrangement.

As explained, the air conditioning apparatus according to the first and second embodiments comprises the single heat source device including the compressor, the reversing valve, the outdoor heat exchanger and the accumulator; the plural indoor units including the indoor heat exchangers and the first flow controllers; the first main pipe and the second main pipe for connecting between the heat source device and the indoor units; the first branch joint which can selectively connect one end of the indoor heat exchanger of each indoor unit to either one of the first main pipe and the second main pipe; the second branch joint which connects the other end of the indoor heat exchanger of each indoor unit to the second main pipe through the first flow controllers; the first branch joint and the second branch joint being connected together through the second flow controller; the junction device which includes the first branch joint, the second flow controller and the second branch joint, and which is interposed between the heat source device and the indoor units; the first main pipe having a greater diameter than the second main pipe; and the switching valve arrangement between the first main pipe and the second main pipe in the heat source device; wherein the first main pipe and the second main pipe can be switched to a low pressure side and to a high pressure side, respectively, and wherein the second branch joint and the first main pipe are connected to through the fourth flow controller. As a result, the indoor units can selectively and simultaneously carry out cooling and heating. In addition, one or some of the indoor units can carry out cooling while the other indoor unit(s) can carry out heating. The greater one of the extended main pipes which connect between the heat source device and the junction device can be always utilized at a low pressure side to improve performance. In particular, in the case wherein room heating is principally performed in the concurrent operation, the greater main pipe can be utilized at a low pressure side to decrease the difference between the evaporation pressure in the indoor heat exchanger(s) of the cooling indoor unit(s) and that in the outdoor heat exchanger. This arrangement allows the evaporation pressure in the indoor heat exchanger(s) to raise in order to operate the air conditioning apparatus while cooling capability does not run short or while the evaporation pressure in the outdoor heat exchanger can not lower to frost the heat exchanger, leading to shortage in performance. In addition, the arrangement wherein the second branch joint and the first main pipe are connected through the fourth flow controller can bypass the refrigerant to the first main pipe at a low pressure side through the fourth flow controller in the case wherein heating is principally performed in the concurrent operation (heating load is greater than cooling load). In that case, the refrigerant has a greater amount than the optimum refrigerant amount for the cooling indoor unit(s). In this manner, the evaporation pressure in the indoor heat exchanger(s) can be raised to carry out an effective operation without coming short of cooling capability.

A third embodiment of the present invention will be explained with reference to FIGS. 6 through 9 and FIGS. 11 through 13. The explanation will be made for the features of the third embodiment different from the first embodiment, and explanation of the features of the third embodiment similar to the first embodiment will be omitted for the sake of simplicity.

Figure 6:
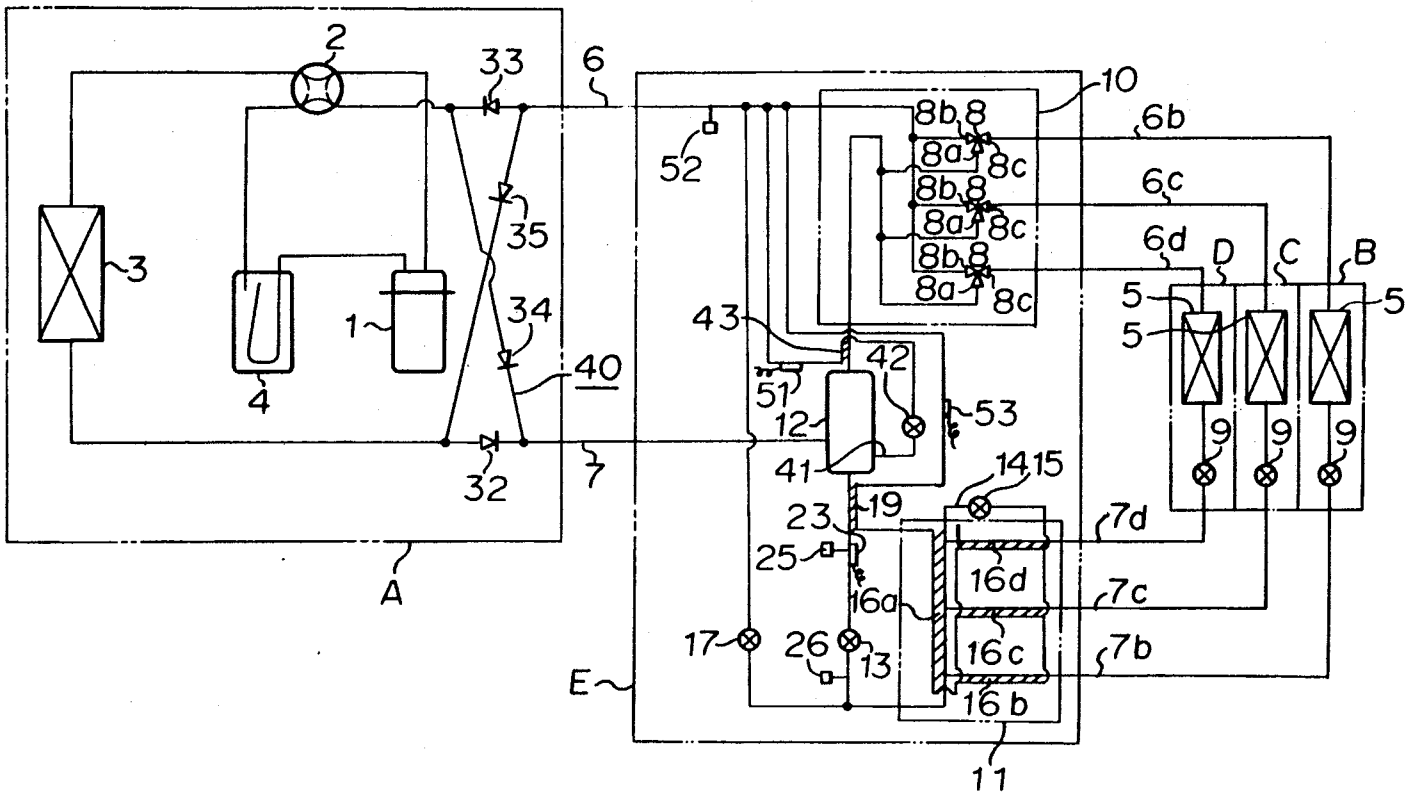
FIG. 6 is a schematic diagram of the entire structure of a third and a ninth embodiment of the air conditioning apparatus according to the present invention, which is depicted on the basis of the refrigerant system of the apparatus.

In FIG. 6, reference numeral 41 designates a liquid purging pipe which has one end connected to the gas-liquid separator 12 and the other end connected to the first main pipe 6. Reference numeral 42 designates a fifth flow controller which is arranged in the liquid purging pipe 41 between the gas liquid separator 12 and the first main pipe 6. Reference numeral 43 designates a fourth heat exchanging portion which is arranged in the liquid purging pipe 41 downstream of the fifth flow controller 42, and which carries out heat exchange with the pipe connecting between the gas-liquid separator 12 and the first branch joint 10.

Reference numeral 23 designates a first temperature detector which is attached to the pipe connecting between the second flow controller 13 and the first heat exchanging portion 19. Reference numeral 25 designates a first pressure detector which is attached to the same pipe as the first temperature detector 23. Reference numeral 26 designates a second pressure detector which is attached to the pipe connecting the second flow controller 13 and the second branch joint 11. Reference numeral 52 designates a third pressure detector which is attached to the pipe connecting between the first main pipe 6 and the first branch joint 10. Reference numeral 51 designates a second temperature detector which is attached to the liquid purging pipe 41 at a refrigerant outlet of the fourth heat exchanging portion 43. Reference numeral 53 designates a third temperature detector which is attached to the bypass pipe 14 at a refrigerant outlet of the first heat exchanging portion 19.

The operation of the third embodiment as constructed above will be explained in terms of the features different from the operation of the first embodiment. Explanation of the features similar to the operation of the first embodiment will be omitted for the sake of simplicity.

In the case wherein room cooling is principally performed under the concurrent operation, when the liquid level at which the gaseous refrigerant and the liquid refrigerant separated in the gas-liquid separator 12 are divided is located below the liquid purging pipe 41 in the gas-liquid separator 12, the gaseous refrigerant flows into the liquid purging pipe 41, and is depressurized to low pressure by the fifth flow controller 42. At that time, the amount of the refrigerant which flows through the fifth flow controller 42 is small because the refrigerant is in the form of gas at the inlet of the fifth flow controller 42. The refrigerant which flows through the liquid purging pipe 41 carries out heat exchange, at the fourth heat exchanging portion 43, with the gaseous refrigerant which is under high pressure and which is going to flow from the gas-liquid separator 12 into the first branch joint 10. The refrigerant in the liquid purging pipe 41 becomes a superheated gas having low pressure due to such heat exchange, and flows into the first main pipe 6.

Conversely, when the liquid level at which the gaseous refrigerant and the liquid refrigerant separated by the gas-liquid separator 12 are divided is located above the liquid purging pipe 41 in the gas-liquid separator 12, the liquid refrigerant flows into the liquid purging pipe 41, and is depressurized to low pressure by the fifth flow controller 42. Because the refrigerant is in the form of liquid at the inlet of the fifth flow controller 42, the amount of the refrigerant which flows through the fifth flow controller 42 is greater in comparison with the case wherein the refrigerant is in the form of gas at the inlet of the fifth flow controller. As a result, even if the refrigerant which flows through the liquid purging pipe 41 carries out heat exchange, at the fourth heat exchanging portion 43, with the gaseous refrigerant which is under high pressure and which is going to flow from the gas-liquid separator 12 into the first branch joint 10, the refrigerant in the liquid purging pipe 41 does not become a superheated gas having low pressure. The refrigerant flows into the first main pipe 6, maintaining a two phase state.

Figure 10:
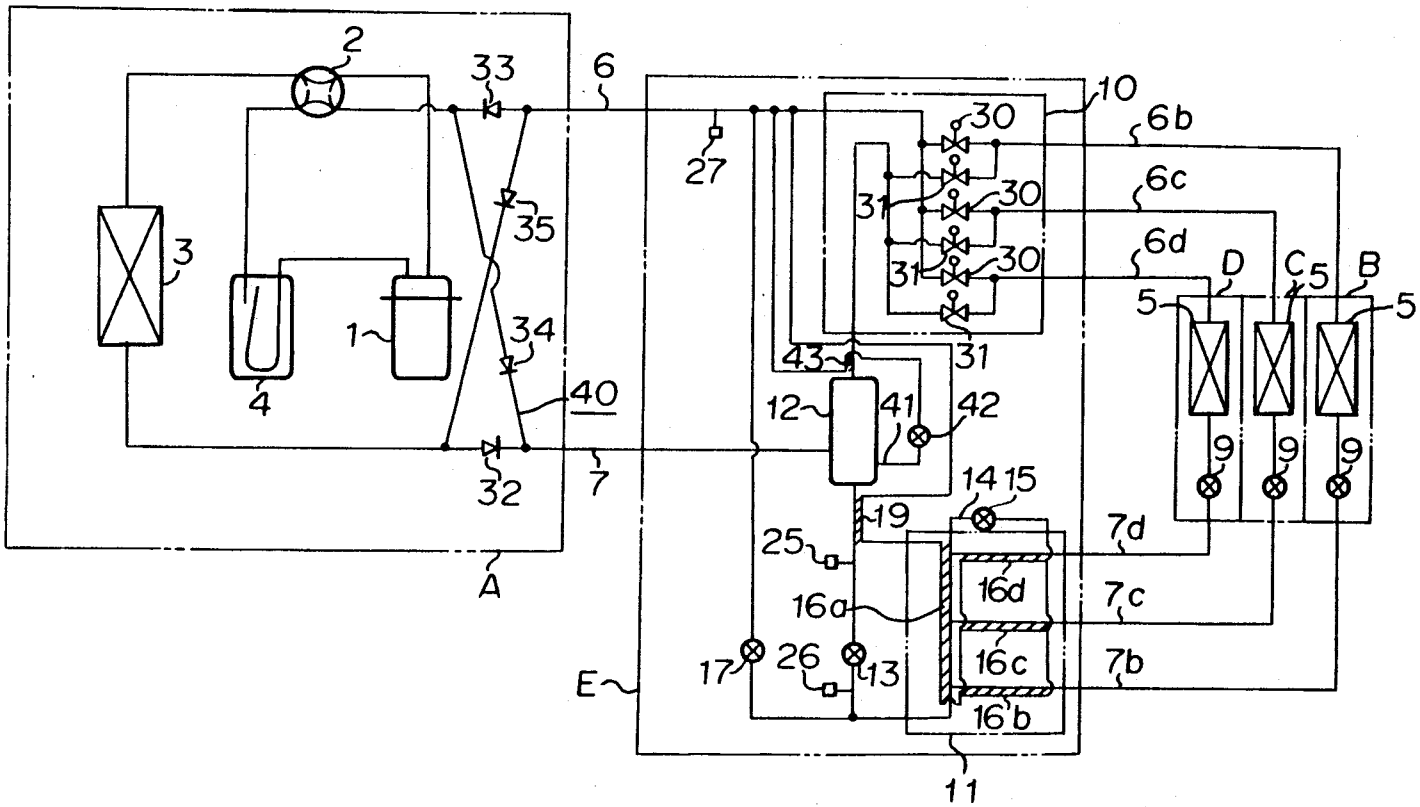
FIG. 10 is a schematic diagram showing the entire structure of a fourth and a tenth embodiment which is depicted on the basis of the refrigerant system of the apparatus.

Although in the third embodiment the three way switching valves 8 can be arranged to selectively connect the first branch pipes 6*b*, 6*c* and 6*d* for the indoor units to either the first main pipe 6 or the second main pipe 7, paired on-off valves such as solenoid valves 30 and 31 can be provided instead of the three way switching valves as shown as a fourth embodiment in FIG. 10 to make selective switching, offering similar advantage.

Figure 7:
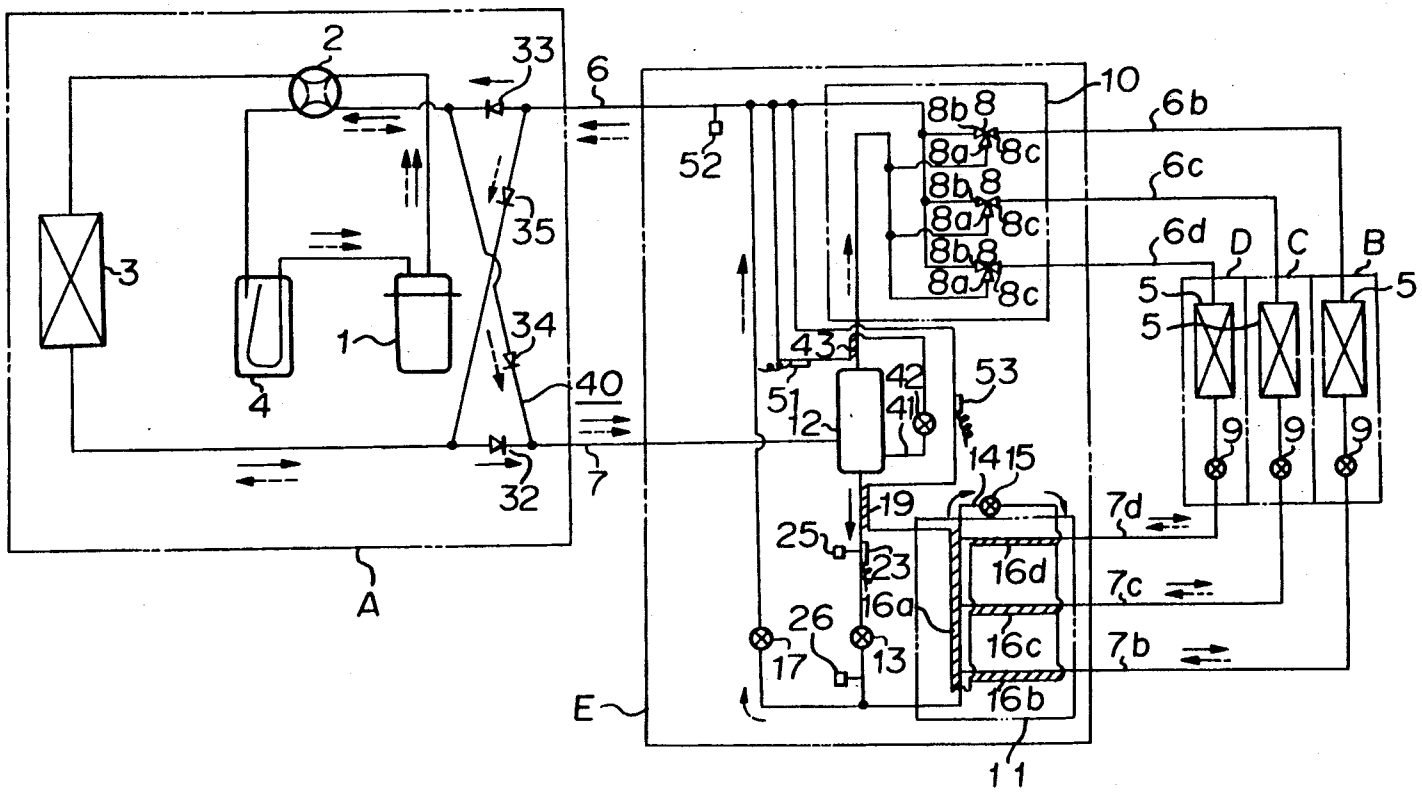
FIG. 7 is a schematic diagram showing the operation states of the third and a ninth embodiment of FIG. 6 wherein solo operation on room cooling and solo operation on room heating are performed.
Figure 8:
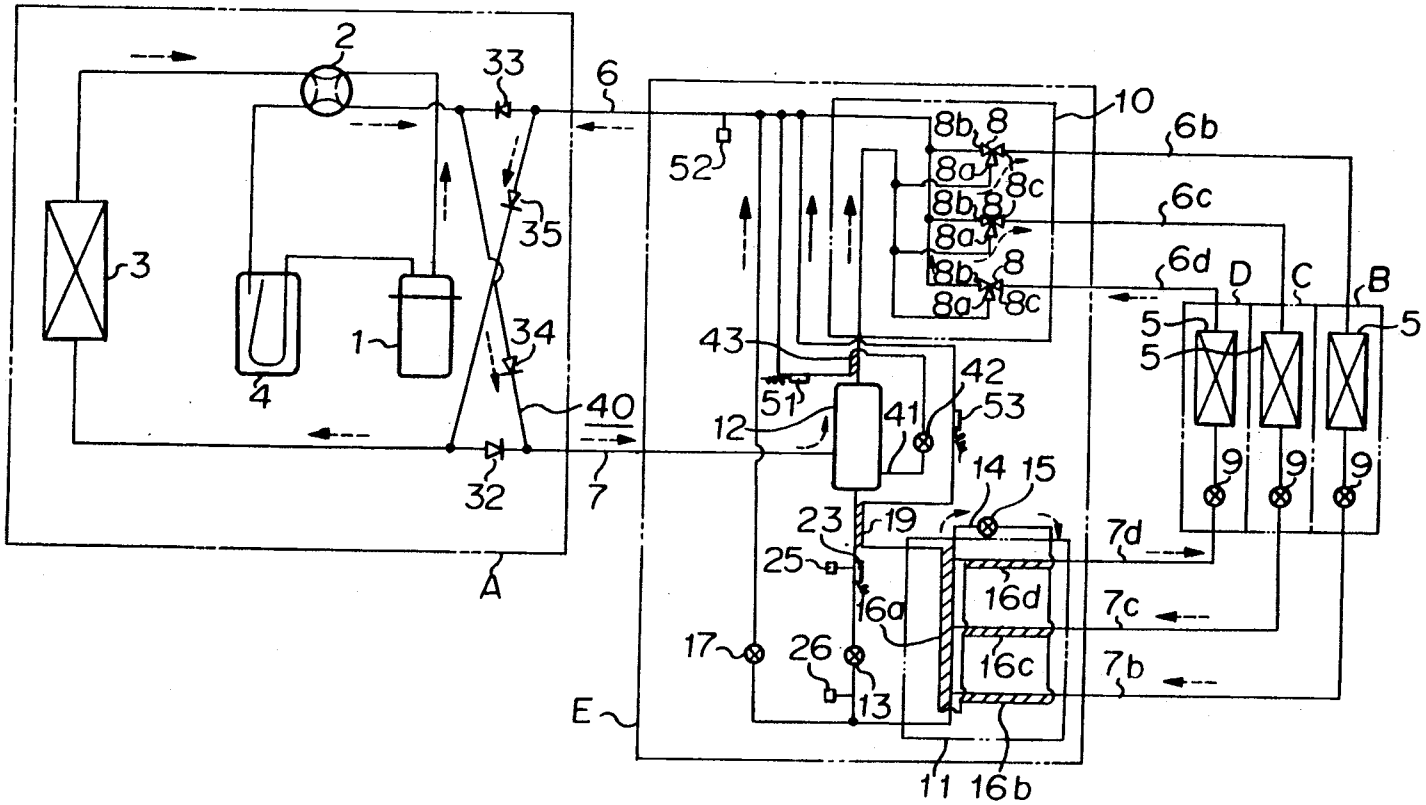
FIG. 8 is a schematic diagram showing the operation state of the third and a ninth embodiment of FIG. 6 wherein room heating is principally performed under room cooling and room heating concurrent operation (heating load is greater than cooling load)

The control of the third flow controller 15 under the cooling operation according to the third embodiment will be explained. In FIG. 7, when the amount of the refrigerant which is sealed in the air conditioning apparatus is not enough to fill the second main pipe 7 in cooling with a liquid refrigerant having high pressure, the refrigerant which has been condensed in the outdoor heat exchanger 3 and has a two phase state under high pressure passes through the second main pipe 7 and the gas-liquid separator 12. Then the two phase refrigerant carries out heat exchange, at the first heat exchanging portion 19, at the second heat exchanging portion 16*a*, and at the third heat exchanging portions 16*b*, 16*c* and 16*d*, with the refrigerant which has been depressurized to low pressure by the third flow controller 15 and flows through the bypass pipe. The refrigerant which has left the gas-liquid separator 12 is liquefied and cooled due to such heat exchange to obtain sufficient supercooling, and flows into the indoor units B, C and D which are expected to carry out cooling.

When the flow rate of the refrigerant is small under the flow control of the refrigeration cycle, the dryness fraction in the refrigerant which is going to the first heat exchanging portion 19 lowers, resulting in an increase in the degree of subcooling at the refrigerant outlet of the first heat exchanging portion 19. However, cooling capability runs short because the flow rate of the refrigerant which flows into the cooling indoor units B, C and D is small. In order to cope with this problem, the opening angle of the third flow controller 15 can be enlarged to increase the flow rate of the refrigerant under the flow control of the refrigeration cycle, thereby increasing the dryness fraction of the refrigerant flowing into the first heat exchanging portion 19, and ensuring a suitable amount of refrigerant and a suitable degree of subcooling. On the other hand, when the flow rate of the refrigerant is great under the flow control of the refrigeration cycle, the dryness fraction in the refrigerant which is going into the first heat exchanging portion 19 increases, resulting in a decrease in the degree of subcooling at the refrigerant outlet of the first heat exchanging portion 19. This causes heat exchange capability to run short at the first, second and third heat exchanging portions 19, 16*a*, 16*b*, 16*c* and 16*d*. The degree of subcooling in the refrigerant which is going to flow from the second branch joint 11 into the cooling indoor units B, C and D runs short, deteriorating good distribution of the refrigerant. In order to cope with this problem, the opening angle of the third flow controller 15 can be reduced to decrease the flow rate of the refrigerant under the flow control of the refrigeration cycle, thereby lowering the dryness fraction in the refrigerant flowing into the first heat exchanging portion 19, ensuring a suitable degree of subcooling at the refrigerant outlet of the first heat exchanging portion 19, and ensuring an enough degree of subcooling in the refrigerant which is flowing into the cooling indoor units B, C and D. In addition, good distribution of the refrigerant can be obtained.

The control of the third flow controller according to the third embodiment will be explained with reference to FIGS. 11, 12 and 13.

Figure 11:
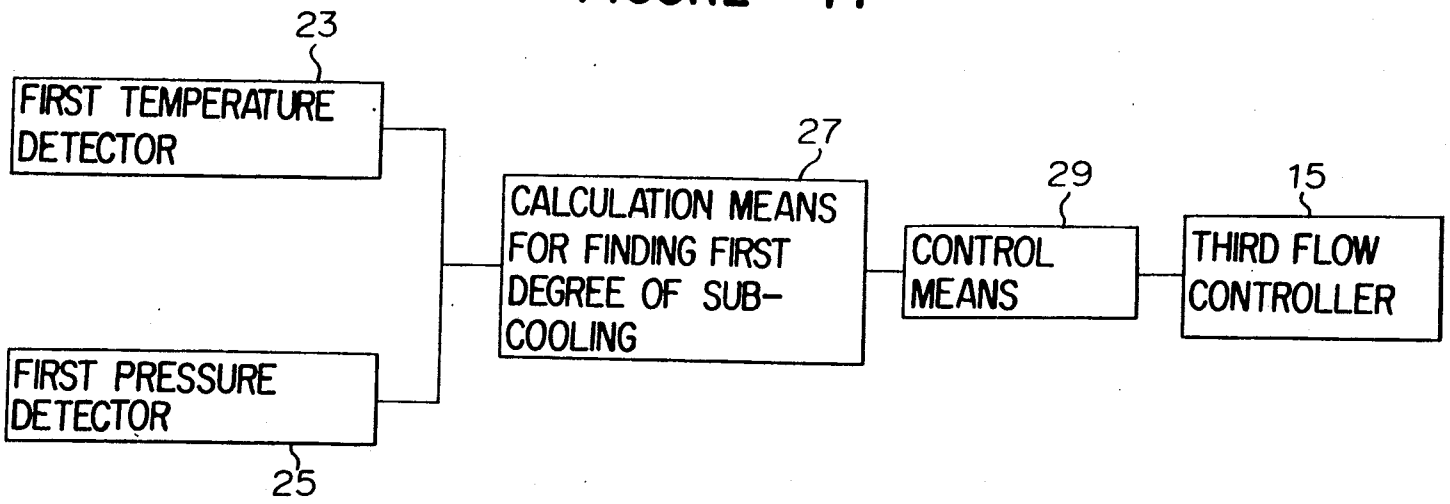
FIG. 11 is a schematic diagram showing the control for a third flow controller in the third embodiment.

FIG. 11 is a schematic diagram showing the control of the third flow controller according to the third embodiment. The degree of subcooling (hereinbelow, referred to as the first degree of subcooling SC1) is found in calculation means for finding the first degree of subcooling 27 based on the temperature detected by the first temperature detector 23 and the pressure detected by the first pressure detector 25. Control means 29 determines the opening angle of the third flow controller based on the first degree of subcooling for control.

Figure 12:
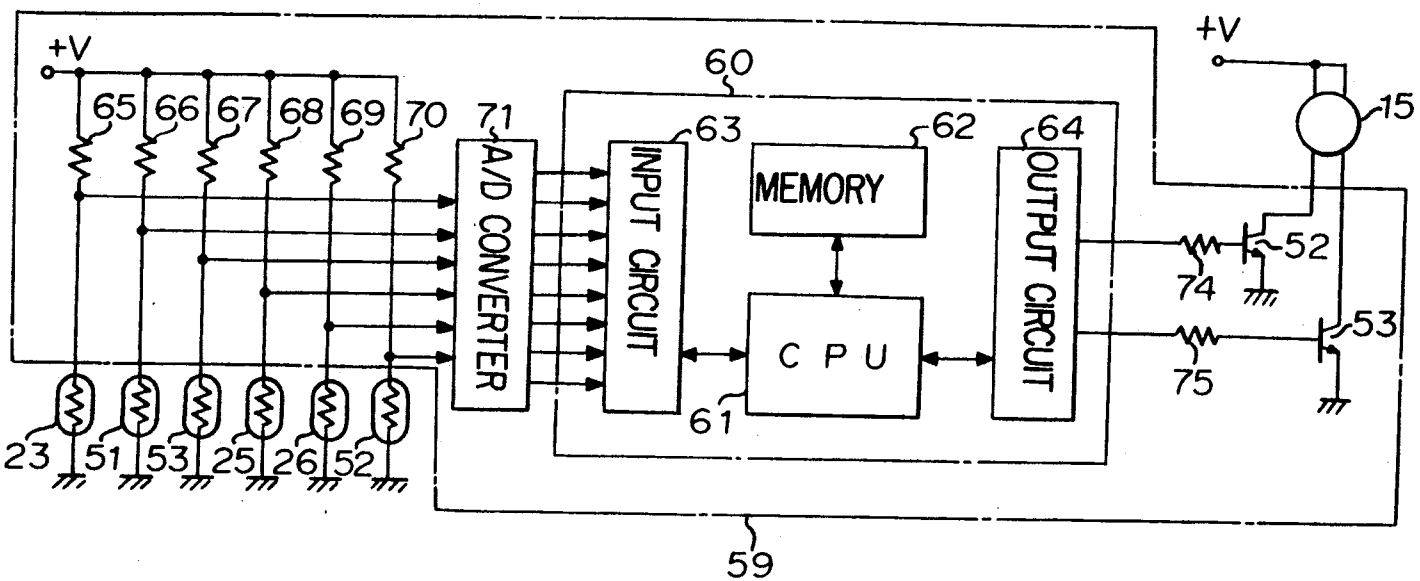
FIG. 12 is a schematic circuit diagram showing the electrical connection for the control in the third and the ninth embodiment.

FIG. 12 is a schematic circuit diagram showing the electrical connection according to the third embodiment. Reference numeral 60 designates a microcomputer which is in a control unit 59, and which includes a CPU 61, a memory 62, an input circuit 63 and an output circuit 64. Reference numerals 65, 66, 67, 68, 69 and 70 designate resistors which are connected in series with the first temperature detector 23, the second temperature detector 51, the third temperature detector 53, the first pressure detector 25, the second pressure detector 26 and the third pressure detector 52, respectively. Reference numeral 71 designates an A/D converter which converts the detected outputs from the first temperature detector 23, the second temperature detector 51, the third temperature detector 53, the first pressure detector 25, the second pressure detector 26 and the third pressure detector 52 into digital outputs. The A/D converter gives its outputs to the input circuit 63. Control transistors 52 and 53 which control the opening angle of the third flow controller 15 are connected to the output circuit 64 through resistors 74 and 75, respectively.

Figure 13:
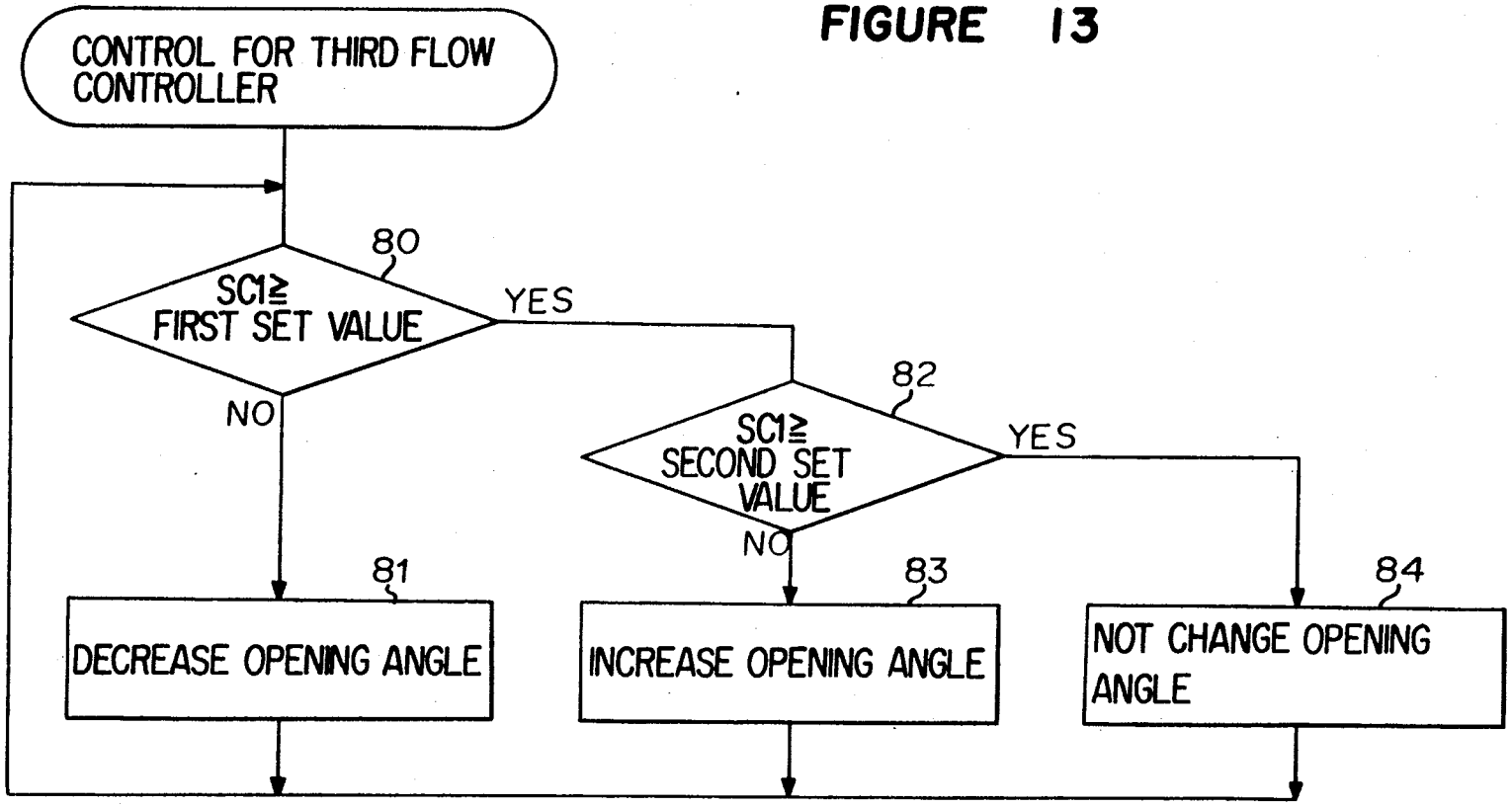
FIG. 13 is a flowchart showing the operations under the control according the third embodiment.

FIG. 13 is a flow chart showing a program which is stored in the memory 62 of the microcomputer 60 to control the opening angle of the third flow controller 15. At Step 80, it is judged whether the first degree of subcooling SC1 is a predetermined first set value or above. If affirmative, the program proceeds to Step 82. If negative, the program proceeds to Step 81. At Step 81, the opening angle of the third flow controller 15 is decreased. At Step 82, it is determined whether the first degree of subcooling SC1 is a predetermined second set value or below, which is greater than the first set value. If affirmative, the problem proceeds to Step 84. If negative, the program proceeds to Step 83. At Step 83, the opening angle of the third flow controller 15 is increased. At Step 84, the opening angle of the third flow controller is unchanged.

In accordance with the third embodiment and the fourth embodiment of the present invention, in the case wherein heating is principally performed under the concurrent operation, the gaseous refrigerant which is under high pressure is directed from the switching valve arrangement, the second main pipe and the first branch joint into indoor units which are expected to carry out heating. Then the refrigerant partly enters from the second branch joint into a cooling indoor unit. The refrigerant carries out cooling there, and flows from the first branch joint into the first main pipe. The remaining refrigerant passes through the fourth flow controller, and joins with the refrigerant which has passed through the cooling indoor unit. The refrigerant thus joined returns to the heat source device through the first main pipe.

In the case wherein cooling is principally performed under the concurrent operation, the gaseous refrigerant which is under high pressure carries out at an arbitrary amount at the outdoor heat exchanger to take a two phase state. Then the refrigerant passes through the switching valve arrangement in the heat source device and the second main pipe, and enters the junction device. In the junction device, the refrigerant is separated into a gaseous refrigerant and a liquid refrigerant. The separated gaseous refrigerant is directed to a heating indoor unit through the first branch joint, carries out heating there, and enters the second branch joint. On the other hand, the separated remaining liquid refrigerant passes through the second flow controller, and joins at the second branch joint with the refrigerant which has passed through the heating indoor unit. The refrigerant thus joined enters the cooling indoor units to carry out cooling. After that, the refrigerant is directed from the first branch joint to the heat source device through the first main pipe, and returns to the compressor. In addition, in the course of flowing a part of the refrigerant from the second branch joint into the first main pipe through the bypass pipe, the refrigerant which is going to enter the second branch joint is cooled at the first heat exchanging portion to have a sufficient degree of subcooling, and is directed into the cooling indoor unit.

Further, in the case of solo heating, the refrigerant is directed from the switching valve arrangement in the heat source device into the indoor units through the second main pipe and the first branch joint to carry out heating. The refrigerant passes through the second branch joint and the first main pipe, and returns to the heat source device through the switching valve arrangement in the heat source device.

In the case of solo cooling, the refrigerant is directed from the switching valve arrangement in the heat source device into the indoor units through the second main pipe and the second branch joint to carry out cooling. The refrigerant passes through the first branch joint and the first main pipe, and returns to the heat source device. In addition, in the course of flowing a part of the refrigerant from the second branch joint into the first main pipe through the bypass pipe, the refrigerant which is going to enter the second branch joint is cooled at the first heat exchanging portion to have a sufficient degree of subcooling, and is directed into the cooling indoor units. At that time, the air conditioning apparatus carries out such control that the refrigerant in the second main pipe takes a two phase state, and the refrigerant at the refrigerant outlet of the first heat exchanging portion has a set degree of subcooling.

As explained, the air conditioning apparatus of the third and fourth embodiments according to the present invention prevents the occurrence of such state that a great flow rate under the flow rate control of the refrigeration cycle increases the dryness fraction in the refrigerant entering the junction device, and that the flow rate of the gaseous refrigerant becomes excessive. In addition, this prevents the occurrence of such state that the gaseous refrigerant flows into the second heat exchanging portion and then the third heat exchanging portions, heat exchanging capability runs short at the first, second and third heat exchanging portions, the degree of subcooling the refrigerant which flows from the second branch joint into the cooling indoor units becomes insufficient to deteriorate good distribution of the refrigerant.

In addition, because the air conditioning apparatus is controlled to ensure in a sufficient manner the degree of subcooling of the refrigerant at the refrigerant outlet of the first heat exchanging portion, the refrigerant at the refrigerant outlet of the outdoor heat exchanger, i.e. the refrigerant flowing through the second main pipe can take a two phase state under high pressure instead of a liquid state under high pressure. Except for solo cooling, the refrigerant which is flowing through the second main pipe takes a two phase state under high pressure in the case wherein cooling is principally performed under the concurrent operation, and takes a two phase state under low pressure in the case of solo heating and in the case wherein heating is principally performed under the concurrent operation. It is sufficient that the refrigerant takes a two phase state under high pressure even during solo cooling. As a result, the amount of the refrigerant which should be sealed in the air conditioning apparatus can be reduced, and inactivity in the refrigerant which has caused in standstill can be prevented from deteriorating the reliability of the compressor.

A fifth embodiment of the present invention will be explained with reference to FIGS. 14 through 17, and FIGS. 19 and 20. Explanation of the fifth embodiment will be made in terms of the features different from the first embodiment, and explanation of the features similar to the first embodiment will be omitted for the sake of simplicity.

Figure 14:
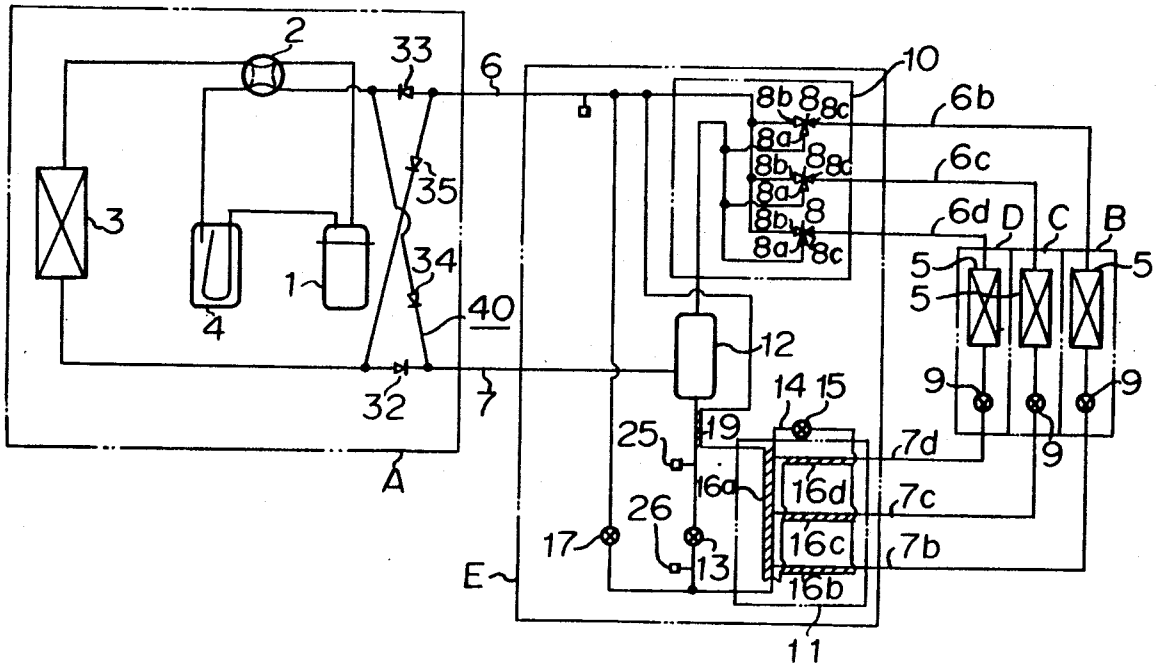
FIG. 14 is a schematic diagram of the entire structure of a fifth and a seventh embodiment of the air conditioning apparatus according to the present invention, which is depicted on the basis of the refrigerant system of the apparatus.

In FIG. 14, reference numeral 25 designates a first pressure detecting means which is arranged on the pipe between the first branch joint 10 and the second flow controller (electric expansion valve in the fifth embodiment) 13. Reference numeral 26 designates a second pressure detecting means which is arranged on the pipe between the second flow controller 13 and the fourth flow controller (electric expansion valve in the fifth embodiment) 17.

The operation of the fifth embodiment as constructed above will be described in terms of the features different from the operation of the first embodiment. The operation of the fifth embodiment similar to that of the first embodiment will be omitted for the sake of simplicity.

In the case wherein only heating is performed, the flow of the refrigerant is indicated by arrows of dotted line.

In detail, the refrigerant which has been discharged from the compressor 1 and been a gas having high temperature under high pressure passes through the four way reversing valve 2, the fifth check valve 34, the second main pipe 7, and the gas-liquid separator 12. Then, the refrigerant passes through the first branch joint 10, the three way switching valves 8, and the first branch pipes **6*b*, 6*c* and 6*d* in that order. After that, the refrigerant enters the respective indoor units B, C and D where the refrigerant carries out heat exchange with the air in the rooms having the indoor units. The refrigerant is condensed to be liquefied due to such heat exchange, thereby heating the rooms. The refrigerant thus liquefied passes through the first flow controllers 9 which are controlled based on subcooling amounts at the refrigerant outlets of the respective indoor heat exchangers 5 to be substantially fully opened. Then, the refrigerant enters the second branch joint 11 through the second branch pipes 7*b*, 7*c* and 7*d*, and joins there. Then, the joined refrigerant passes through the fourth flow controller 17. The refrigerant is depressurized by either the first flow controllers 9, or the third flow controller or fourth flow controller 13 or 17** to take a two phase state having low pressure.

Figure 16:
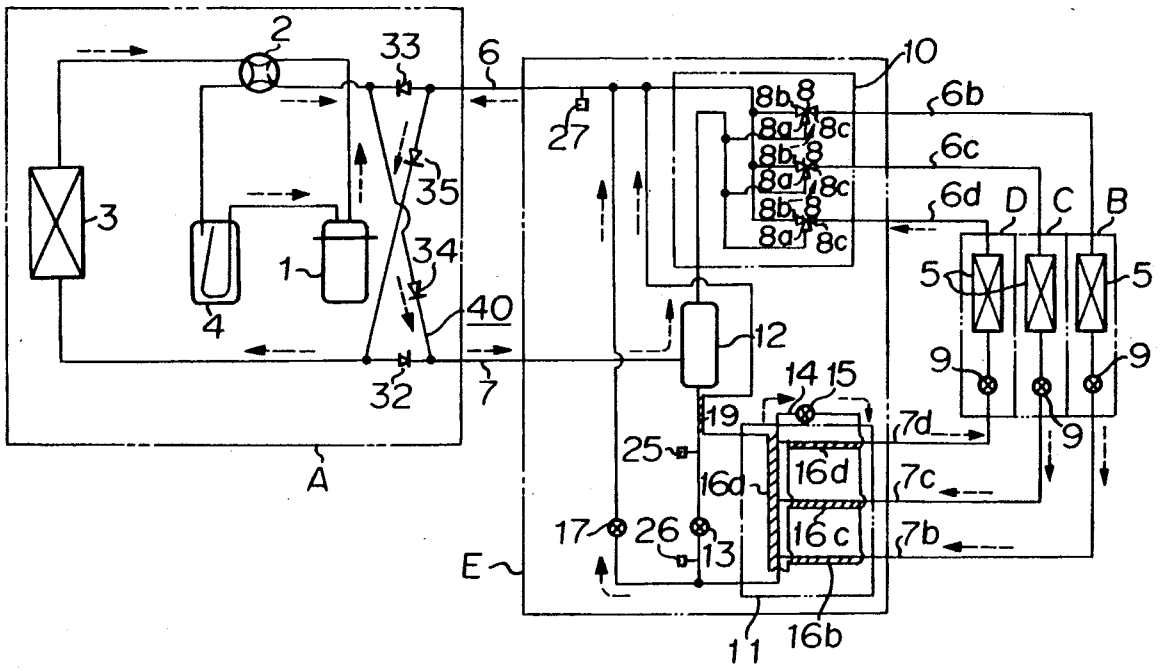
FIG. 16 is a schematic diagram showing the operation state of the fifth and the seventh embodiment of FIG. 14 wherein room heating is principally performed under room cooling and room heating concurrent operation (heating load is greater than cooling load)

In the case wherein heating is principally performed in the concurrent operation, the flow of the refrigerant is indicated by arrows of dotted line in FIG. 16.

The refrigerant which has been discharged from the compressor 1, and been a gas having high temperature under high pressure passes through the fifth check valve 34 and the second main pipe 7, and is directed to the junction device E. The refrigerant flows through the gas liquid separator 12, passes through the first branch joint 10, the three way switching valves 8, and the first branch pipes **6*b* and 6*c* in that order. The refrigerant enters the indoor units B and C which are expected to carry out heating. In the indoor heat exchangers 5 of the respective indoor units B and C, the refrigerant carries out heat exchange with the air in the rooms having the indoor units B and C installed in them, to be condensed and liquefied, thereby heating the rooms. The refrigerant thus condensed and liquefied passes through the first flow controllers 9 which are controlled based on subcooling amounts at the refrigerant outlets of the indoor heat exchangers B and C to be substantially fully opened. As a result, the refrigerant is slightly depressurized by the first flow controllers 9, and enters the second branch joint 11. A part of the refrigerant which has entered the second branch joint 11 passes through the second branch pipe 7*d*, and enters the cooling indoor unit D. The refrigerant enters the first controller 9 of the indoor unit D, the first flow controller 9 being controlled based on a superheat amount at the refrigerant outlet of the indoor heat exchanger 5 of the indoor unit D. After the refrigerant is depressurized by this first controller 9, it enters the indoor heat exchanger 5, and carries out heat exchange to be evaporated and gasified, thereby cooling the room with this indoor heat exchanger 5 in it. Then the refrigerant enters the first main pipe 6 through the three way switching valve 8** which is connected to the indoor unit D.

On the other hand, the remaining refrigerant passes through the fourth flow controller 17 which is controlled in a way to bring a difference between the pressure detected by the first pressure detecting means 25 and the pressure detected by the second pressure detecting means 26 into a predetermined range. After that, the remaining refrigerant joins with the refrigerant which has passed through the indoor unit D.

At this cycle, another part of the liquid refrigerant flows from the confluent portion of the second branch pipes **7*b*, 7*c* and 7*d* in the second branch joint 11 into the bypass pipe 14, and is depressurized to low pressure by the third flow controller (electric expansion valve in the fifth embodiment) 15. The refrigerant thus depressurized carries out heat exchange with the second branch pipes 7*b*, 7*c* and 7*d* at the third heat exchanging portions 16*b*, 16*c* and 16*d* in the second branch joint 11, with the confluent portion of the second branch pipes 7*b*, 7*c* and 7*d* at the second heat exchanging portion 16*a* in the second branch joint 11. The refrigerant is evaporated due to such heat exchange, flows into the first main pipe 6 and the sixth check valve 35, and is inspired into the compressor 1 through the four way reversing valve 2 and the accumulator 4. On the other hand, the refrigerant which has carried out heat exchange at the second and third heat exchanging portions 16*a*, 16*b* and 16*d*, and has been cooled to obtain in the second branch joint 11** enters the indoor unit D which is expected to carry out cooling.

Figure 17:
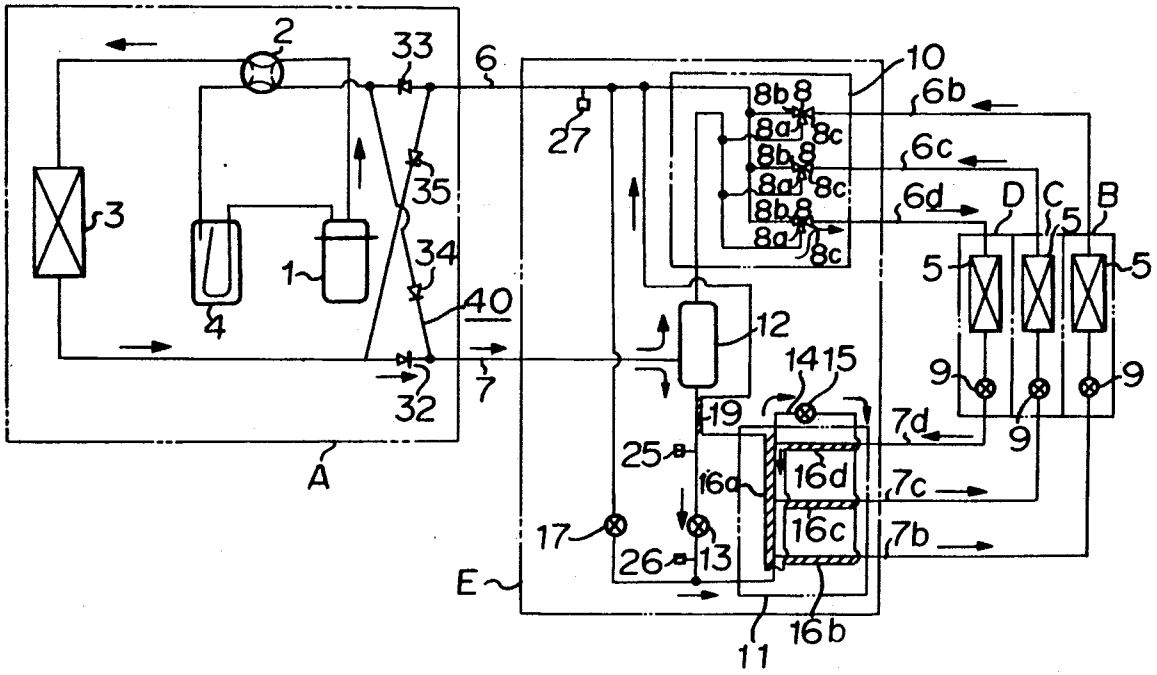
FIG. 17 is a schematic diagram showing the operation state of the fifth and the seventh embodiment of the FIG. 14 wherein room cooling is principally performed under room cooling and room heating concurrent operation (cooling load is greater than heating load)

In the case wherein cooling is principally performed in the concurrent operation, the flow of refrigerant is indicated by arrows of solid line in FIG. 17.

The gaseous refrigerant which has been discharged from the compressor 1 carries out heat exchange at an arbitrary amount in the outdoor heat exchanger 3 to take a two phase state having high temperature under high pressure. Then the refrigerant passes through the third check valve 32 and the second main pipe 7, and is forwarded to the gas liquid separator 12 in the junction device E. The refrigerant is separated into a gaseous refrigerant and a liquid refrigerant there, and the gaseous refrigerant thus separated flows through the first branch joint 10, and the three way switching valve 8 and the first branch pipe **6*d* which are connected to the indoor unit D, in that order, the indoor unit D being expected to heat the room with the indoor unit D installed in it. The refrigerant flows into the indoor unit D, and carries out heat exchange with the air in the room with the indoor heat exchanger 5 of the heating indoor unit D to be condensed and liquefied, thereby heating the room. In addition, the refrigerant passes through the first flow controller 9 connected to the heating indoor unit D, this first flow controller 9 being controlled based on a subcooling amount at the refrigerant outlet of the indoor heat exchanger 5 of the heating indoor unit D to be substantially fully opened. The refrigerant is slightly depressurized by this first flow controller 9, and flows into the second branch joint 11. On the other hand, the remaining liquid refrigerant passes through the second flow controller 13 which is controlled based on the pressure detected by the first pressure detecting means 25 and the pressure detected by the second pressure detecting means 26. Then the liquid refrigerant enters the second branch joint 11**, and joins with the refrigerant which has passed through the heating indoor unit D.

Now, the controls for the third and fourth flow controllers 15 and 17 which are carried out under the concurrent operation wherein heating is principally performed will be explained.

Figure 19:
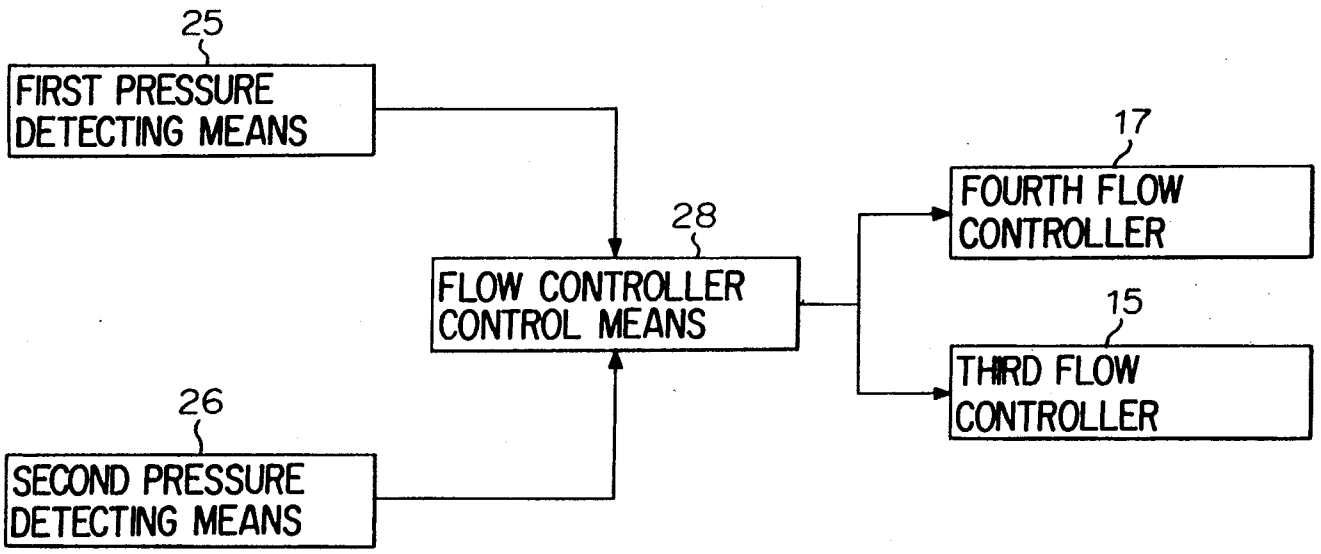
FIG. 19 is a schematic diagram showing the structure of the flow controller control system in the fifth and the sixth embodiments.
Figure 20:
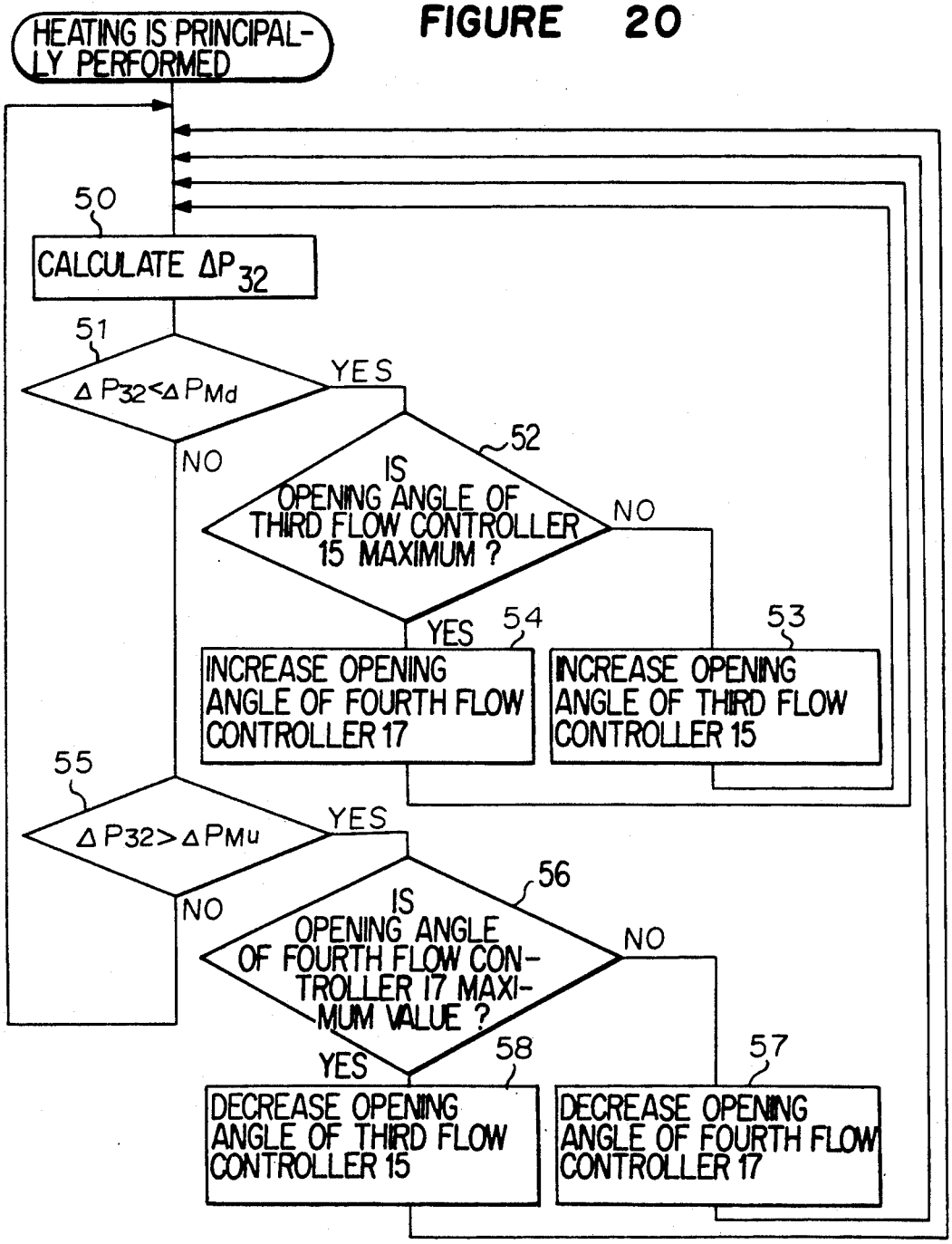
FIG. 20 is a flowchart showing the operations of the flow controller control system of the fifth and the sixth embodiments.

FIG. 19 is a schematic diagram showing the control system for the third and fourth flow controllers 15 and 17. FIG. 20 is a flow chart showing the operation which is made by the control system. Reference numeral 28 designates flow controller control means for controlling the opening angles of the third and fourth flow controllers 15 and 17 depending on a difference between the pressures detected by the first and second pressure detecting means 25 and 26. When the difference $\Delta P_{32}$ between the pressures detected by the first and second pressure detecting means 25 and 26 achieves a value $\Delta P_1$ or below, the refrigerant required for heating can not be supplied in a sufficient manner even if the first flow controllers 9 of the heating indoor units B and C are fully opened. When the pressure difference $\Delta P_{32}$ achieves a value $\Delta P_2$ or above, sufficient heat exchange can not be carried out at the heat exchanging portions 16*a*, 16*b*, 16*c* and 16*d*, which creates a problem wherein the distribution of the refrigerant to the cooling indoor unit D deteriorates, and the refrigerant entering the indoor unit D is subcooled in an insufficient manner, preventing the refrigerant from being supplied in a stable manner. In order to cope with this problem, the third and fourth flow controllers 15 and 17 are controlled in a way to bring the pressure difference $\Delta P_{32}$ into the range between a first desired pressure difference $\Delta P_{Md}$ and a second desired pressure difference $\Delta P_{Mu}$, the first desired pressure difference $\Delta P_{Md}$ being preset to be greater than $\Delta P_1$ and the second desired pressure difference $\Delta P_{Mu}$ being preset to be smaller than $\Delta P_2$. As a result, the refrigerant can be supplied to the heating indoor units B and C in a sufficient manner, and sufficient subcooling can be ensured at the heat exchanging portions 16*a*, 16*b*, 16*c* and 16*d*. In order to bring the pressure difference $\Delta P_{32}$ into the predetermined range, the opening angle of either the third flow controller 15 or the fourth flow controller 17 may be increased or decreased. It is noted that when the opening angles of the third and fourth flow controllers 15 and 17 are increased, an increase in the opening angle of the third flow controller 15 takes priority over an increase in that of the fourth flow controller 17, and that when the opening angles of the third and fourth flow controllers 15 and 17 are decreased, a decrease in the opening angle of the fourth flow controller 17 takes priority over a decrease in the opening angle of the third flow controller 15, thereby ensuring the flow rate of the refrigerant at cooling sides in a sufficient manner at the heat exchanging portions 16*a*, 16*b*, 16*c* and 16*d*. The third flow controller 15 has such function that the flow rate of the refrigerant at cooling sides can be controlled at the heat exchanging portions 16*a*, 16*b*, 16*c* and 16*d*.

Referring now to FIG. 20, at Step 50 the pressure difference $\Delta P_{32}$ is calculated. At Step 51, $\Delta P_{32}$ is compared to $\Delta P_{Md}$. If $\Delta P_{32} < \Delta P_{Md}$, the program proceeds to Step 52 where it is judged whether the opening angle of the third flow controller 15 the maximum or not. If negative, the program proceeds to Step 53 where the opening angle of the third flow controller 15 is increased. If affirmative, the program proceeds to Step 54 where the opening angle of the fourth flow controller 17 is increased. The program returns to Step 50 from Steps 53 and 54. On the other hand, if $\Delta P_{32} \geqq \Delta P_{Md}$, the program proceeds to Step 55 where $\Delta P_{32}$ is compared to $\Delta P_{Mu}$. If $\Delta P_{32} > \Delta P_{Mu}$, the program proceeds to Step 56 where it is judged whether the opening angle of the fourth flow controller 17 is the minimum value or not. If negative, the proceeds to Step 57 where the opening angle of the fourth flow controller 17 is decreased. If affirmative, the program proceeds to Step 58 where the opening angle of the third flow controller 15 is decreased. The program returns to Step 50 from Steps 57 and 58. The program also returns to Step 50 if $\Delta P_{32} \leqq \Delta P_{Mu}$. In this manner, the pressure difference $\Delta P_{32}$ can be maintained in the predetermined range while the flow rate of the refrigerant at the cooling sides can be ensured in a sufficient manner at the heat exchanging portions 16*a*, 16*b*, 16*c* and 16*d*. Although in the fifth embodiment the three way switching valves 8 can be arranged to selectively connect the first branch pipes 6*b*, 6*c* and 6*d* to either the first main pipe 6 or the second main pipe 7, paired on-off valves such as solenoid valves 30 and 31 can be provided instead of the three way switching valves as shown as a sixth embodiment in FIG. 18 to make selective switching, offering similar advantage.

In accordance with the fifth and sixth embodiments of the present invention, in the case wherein heating is principally performed under the concurrent operation, the gaseous refrigerant having high pressure is directed from the heat source device switching valve arrangement, the second main pipe and the first branch joint into the heating indoor units to carry out heating there. After that, a part of the refrigerant flows from the second branch joint into the cooling indoor unit to carry out cooling, and flows from the first branch joint into the first main pipe. On the other hand, another refrigerant passes through the fourth flow controller, and joins with the refrigerant which has passed through the cooling indoor unit. The refrigerant thus joined returns to the switching valve arrangement in the heat source device through the first main pipe. In addition, the remaining part of the refrigerant is directed from the second branch joint into the bypass pipe, and carries out heat exchange at the heat exchanging portions to cool and give sufficient subcooling to the refrigerant which is going to enter the second branch joint and the refrigerant which is going to enter the cooling indoor unit. Further, the third and fourth flow controllers are controlled in a way to bring the difference between the pressures detected by the first and second pressure detecting means into the predetermined range.

In the case wherein cooling is principally performed under the concurrent operation, the gaseous refrigerant having high pressure carries out heat exchange at an arbitrary amount in the heat source device to take a two phase state. Then the refrigerant is directed to the gas-liquid separator through the switching valve arrangement and the second main pipe. The gaseous refrigerant which has been separated in the gas-liquid separator is directed into the heating indoor unit through the first branch joint to carry out heating, and flows into the second branch joint. On the other hand, the refrigerant which is the liquid separated in the gas-liquid separator passes through the second flow controller, and joins at the second branch joint with the refrigerant which has passed through the heating indoor unit. The refrigerant thus joined enters the cooling indoor units to carry out cooling. After that, the refrigerant is directed from the first branch joint to the switching valve arrangement in the heat source device through the first main pipe, and returns to the compressor. In addition, a part of the refrigerant is directed from the second branch joint into the bypass pipe to carry out heat exchange at the heat exchanging portions. In this manner, the refrigerant which is going to enter the second branch joint, and the refrigerant which is going to enter the cooling indoor units are cooled to have sufficient subcooling.

In addition, in the case of solo heating, the refrigerant is directed from the switching valve arrangement in the heat source device into the indoor units through the second main pipe and the first branch joint to carry out heating. Then the refrigerant returns from the second branch joint to the switching valve arrangement in the heat source device through the fourth flow controller and the first main pipe.

In the case of solo cooling, the refrigerant is directed from the switching valve arrangement in the heat source device into the indoor units through the second main pipe and the second branch joint to carry out cooling. Then the refrigerant returns from the first branch joint to the switching valve arrangement in the heat source device through the first main pipe.

As explained, the air conditioning apparatus according to the fifth and sixth embodiments of the present invention comprises the single heat source device including the compressor, the four way reversing valve, the outdoor heat exchanger and the accumulator; the plural indoor units including the indoor heat exchangers and the first flow controllers; the first main pipe and the second main pipe for connecting between the heat source device and the indoor units; the first branch joint which can selectively connect one end of the indoor heat exchanger of each indoor unit to either one of the first main pipe and the second main pipe; the second branch joint which is connected to the other end of the indoor heat exchanger of each indoor unit through the first flow controllers, and which is also connected to the second main pipe through the second flow controller; the first branch joint and the second branch joint being connected together through the second flow controller; the second branch joint being connected to the first main pipe through the fourth flow controller; the junction device which includes the first branch joint, the second branch joint, the second flow controller and the fourth flow controller, and which is interposed between the heat source device and the indoor units; the first main pipe having a greater diameter than the second main pipe; the switching valve arrangement which can be arranged between the first main pipe and the second main pipe in the heat source device to switch the first main pipe and the second main pipe to a low pressure side and a high pressure side, respectively; the bypass pipe which has one end connected to the second branch joint and the other end connected to the first main pipe through the third flow controller; the heat exchanging portion which carries out heat exchange at the confluent portion of the branch pipes for connecting between the respective indoor units and the second branch joint; the heat exchanging portions which carry out heat exchange between the branch pipes and a part of the bypass pipe downstream of the third flow controller; the first pressure detecting means arranged between the first branch joint and the second flow controller; the second pressure detecting means arranged between the second flow controller and the fourth flow controller; and the flow controller control means which controls the third and fourth flow controllers in a way to bring the pressure difference detected by the first and second pressure detecting means in the predetermined range under the operation wherein the indoor units carry out cooling and heating concurrent operation and the outdoor heat exchanger works as evaporator. This arrangement allows the plural indoor units to selectively and simultaneously carry out room cooling and room heating in such manner that one or some of the indoor units are carrying out room cooling and simultaneously the other indoor unit(s) is carrying out room heating. In addition, a greater-diameter one of the extended pipes which connect between the heat source device and the junction device can be always used at a low pressure side to improve cooling and heating capability. In particular, the greater-diameter pipe is used at a low pressure side under the cooling and heating concurrent operation wherein room heating is principally performed. As a result, the difference between the evaporation pressure in the cooling indoor heat exchanger(s) and that in the heat source device heat exchanger can lessen to increase the evaporation pressure at the indoor heat exchanger(s), thereby being capable of working without falling short of cooling capability, or without decreasing the evaporation pressure in the heat source device heat exchanger to lower capability due to icing on the heat source device heat exchanger. In addition, a sufficient amount of the refrigerant can be supplied to the heating indoor unit(s), and the refrigerant which is going to enter the cooling indoor unit(s) can obtain sufficient subcooling at the heat exchanging portions, thereby stabilizing the supply of the refrigerant.

A seventh embodiment will be explained in terms of the features different from those of the fifth embodiment with reference to FIGS. 14 through 17, and FIGS. 21 and 22. The features similar to the those of the fifth embodiment will be omitted for the sake of simplicity. In the case of solo heating shown in FIG. 15, the flow of the refrigerant is indicated by arrows of dotted line. The refrigerant which has been discharged from the compressor 1 and has been a gas having high temperature under high pressure passes through the four way reversing valve 2, and passes through the fifth check valve 34, the second main pipe 7 and the gas liquid separator 12. Then the refrigerant passes through the first branch joint 10, the three way switching valves 8, and the first branch pipes **6*b*, 6*c* and 6*d* leading to the indoor units in that order. The refrigerant enters the indoor units B, C and D where the refrigerant carries out heat exchange with the air in the rooms with the indoor units therein. The refrigerant is condensed and liquefied due to such heat exchange to heat the rooms. The refrigerant thus liquefied passes through the first flow controllers 9 which are controlled based on subcool amounts at the refrigerant outlet of the indoor heat exchangers 5 to be substantially fully opened. The refrigerant flows from the second branch pipes 7b, 7c and 7d into the second branch joint 11, and joins there. The refrigerant thus joined passes through the fourth flow controller 17. The fourth flow controller 17 is controlled so that the refrigerant maintains a liquid state even after it has been depressurized by the first flow controllers 9, and that the refrigerant takes a two phase state comprising a gas and a liquid for the first time after it has been depressurized by the fourth flow controller 17. This arrangement allows the second branch pipes 7b, 7c and 7d to be filled with the liquid refrigerant. Thus the second branch pipes 7b, 7c and 7d are also filled with the liquid refrigerant in the case of solo cooling. When in solo heating the fourth flow controller 17 is controlled so that the second branch pipes 7b, 7c and 7d take the two phase state, the amount of the refrigerant in the second branch pipes 7b, 7c and 7d can be smaller than the amount of mass refrigerant held in the second branch pipes 7b, 7c and 7d in solo cooling by an decrease in the specific gravity of the refrigerant. As a result, the amount of the liquid refrigerant which is held in the accumulator 4 as excessive refrigerant is increased. On the other hand, because in the seventh embodiment the refrigerant in the branch pipes 7b, 7c and 7d occupies a liquid state, there is no significant difference between the solo heating and the solo cooling in terms of amount of mass refrigerant held in the branch pipes 7b, 7c and 7d. This arrangement can increase the amount of the excessive refrigerant, minimize the accumulator 4, minimize the occurrence of the refrigerant returning to the compressor 1 in a liquid state, and increase the reliability of the compressor 1. The refrigerant which has been depressurized to low pressure enters the outdoor heat exchanger 3 through the first main pipe 6 and the sixth check valve 35 in the heat source device A. The refrigerant which has entered the outdoor heat exchanger 3 and has carried out heat exchanger there to be evaporated and gasified is inspired into the compressor 1 through the four way reversing valve 2 and the accumulator 4 in the heat source device. In this manner, the circulation cycle is formed to carry out heating. At that time, the three way switching valves 8 have the second ports 8b closed, and the first and the third ports 8a and 8c opened. In addition, at that time, the first main pipe 6 is at low pressure in it, and the second main pipe 7 is at high pressure in it, which necessarily causes the fifth check valve 34 and the sixth check valve 35** to conduct for the refrigerant.

Now, the control for the fourth flow controller 17 on the solo heating will be explained.

Figure 15:
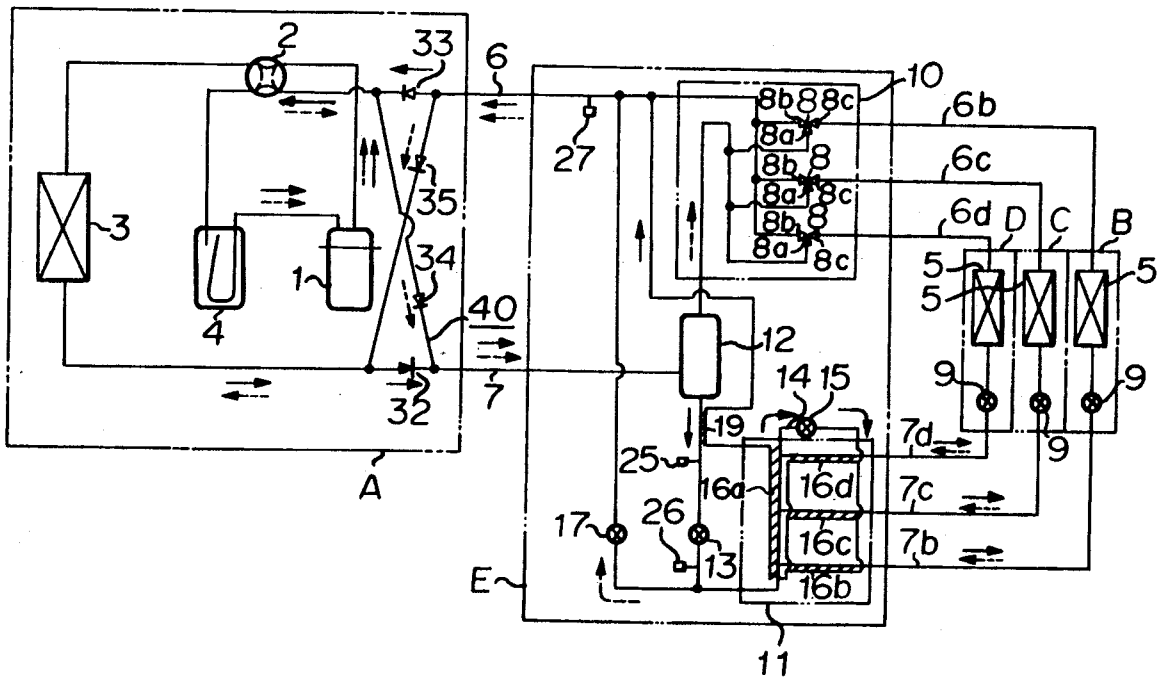
FIG. 15 is a schematic diagram showing the operation states of the fifth and the seventh embodiment of FIG. 14 wherein solo operation on room cooling and solo operation on room heating are performed.
Figure 21:
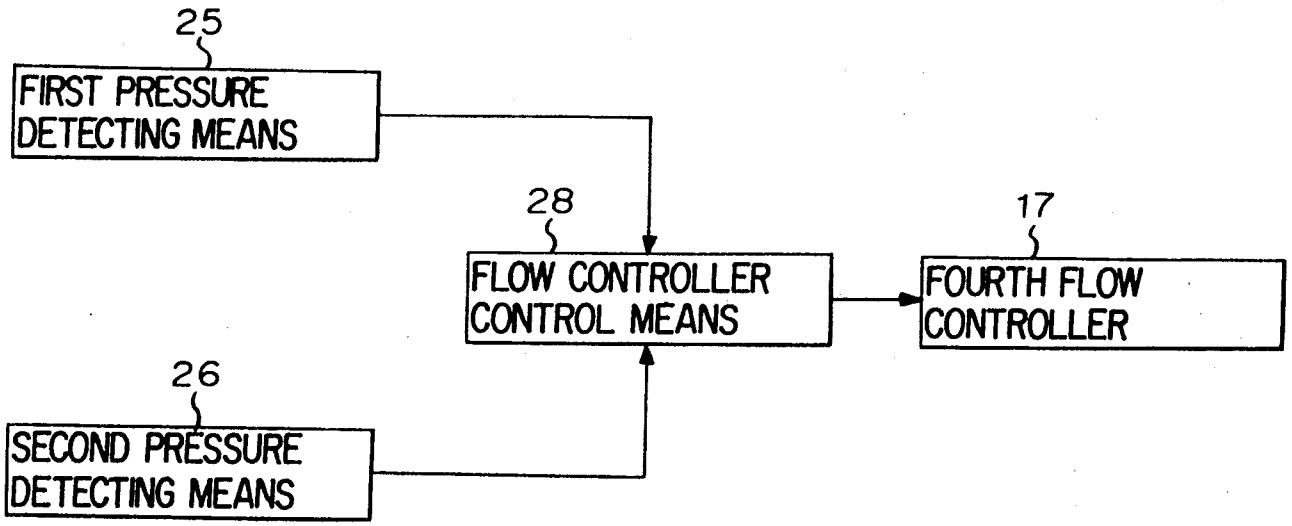
FIG. 21 is a schematic diagram showing the structure of the flow controller control system in seventh embodiment.
Figure 22:
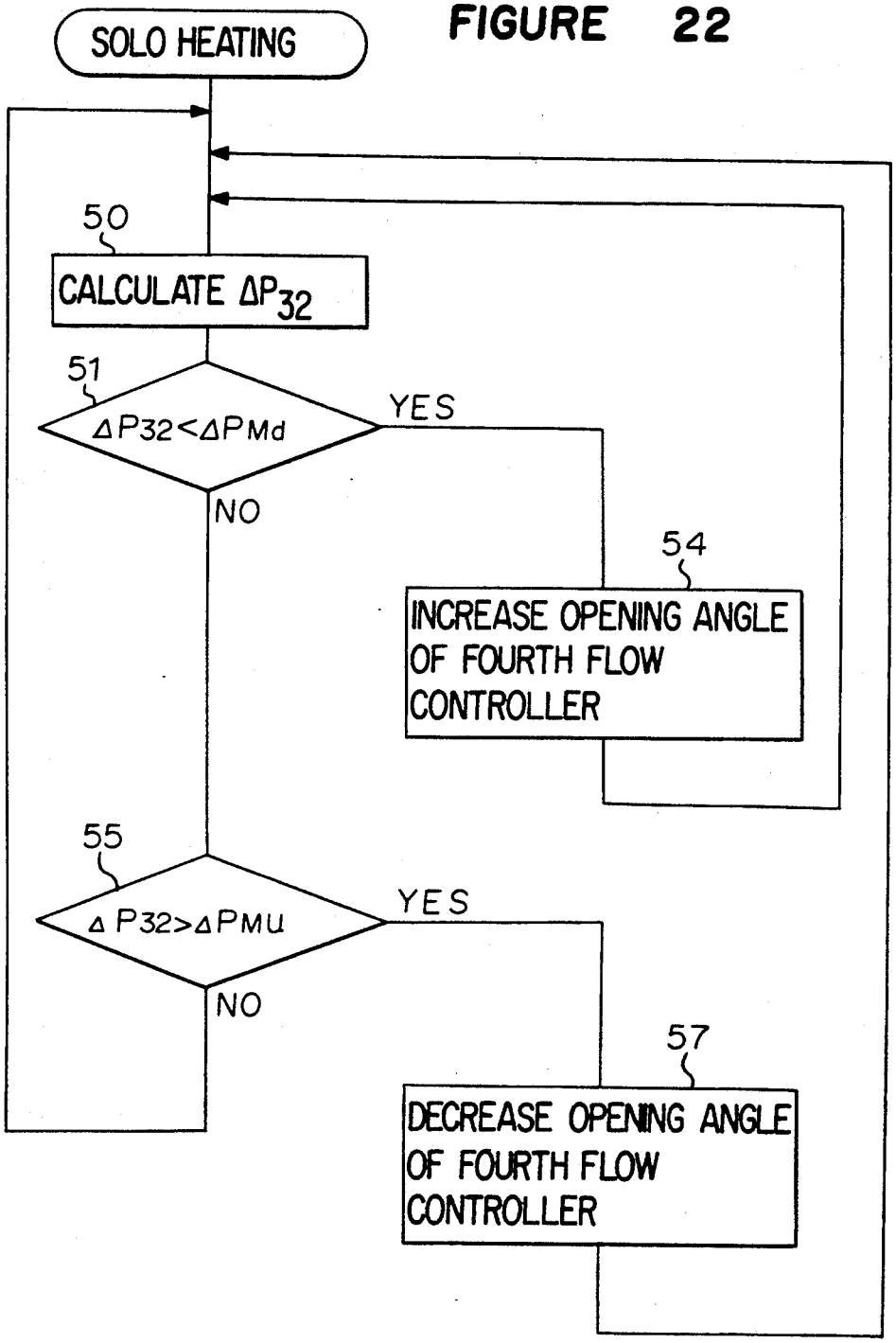
FIG. 22 is a flowchart showing the operation of the flow controller control system of the seventh embodiment.

Referring now to FIG. 21, there is shown a schematic diagram showing the control system for the fourth flow controller 17 shown in FIG. 15. A flowchart showing the operation of the control system is shown in FIG. 22. Reference numeral 28 designates flow controller control means which controls the opening angle of the fourth flow controller 17 depending on a difference between the pressures detected by the first and second pressure detecting means 25 and 26. When the difference $\Delta P_{32}$ between the pressure detected by the first and second pressure detecting means 25 and 26 achieves a predetermined value $\Delta P_1$ or below, the refrigerant required for heating is not supplied to the heating indoor units B, C and D in a sufficient manner even if the first flow controllers 9 are fully opened. On the other hand, the difference $\Delta P_{32}$ achieves a predetermined value $\Delta P_2$ or above, the refrigerant does not take a single liquid phase after having been depressurized by the fourth flow controller 17 and takes two phase (gas and liquid) state in the branch pipes 7b, 7c and 7d even if the liquid refrigerant has obtained sufficient subcooling after having passed through the indoor heat exchangers. In order to cope with this problem, the fourth flow controller 17 is controlled in a way to bring the difference $\Delta P_{32}$ between in a predetermined first desired difference $\Delta P_{Md}$ and a predetermined second desired difference $\Delta P_{Mu}$, the first desired difference $\Delta P_{Md}$ being present to be greater than $\Delta P_1$, and the second desired difference $\Delta P_{Mu}$ being present to be smaller than $\Delta P_2$. Such control can supply the refrigerant in a sufficient manner to the indoor units B, C and D which are expected to carry out heating, and can fill the second branch pipes 7b, 7c and 7d with a single liquid phase.

At Step 50 of FIG. 22, the difference $\Delta P_{32}$ is calculated. At Step 51, $\Delta P_{32}$ is compared to $\Delta P_{Md}$. If $\Delta P_{32} < \Delta P_{Md}$, the program proceeds to Step 54 where the opening angle of the fourth flow controller 17 is increased, and the program returns to Step 50. On the other hand, if $\Delta P_{32} \geqq \Delta P_{Md}$, the program proceeds to Step 55 where $\Delta P_{32}$ is compared to $\Delta P_{Mu}$. If $\Delta P_{32} > \Delta P_{Md}$, the program proceeds to Step 57 where the opening angle of the fourth flow controller 17 is decreased, and the program returns to Step 50. If $\Delta P_{32} \leqq \Delta P_{Mu}$, the program also returns to Step 50. In this manner, the difference $\Delta P_{32}$ can be maintained in the predetermined range.

Figure 18:
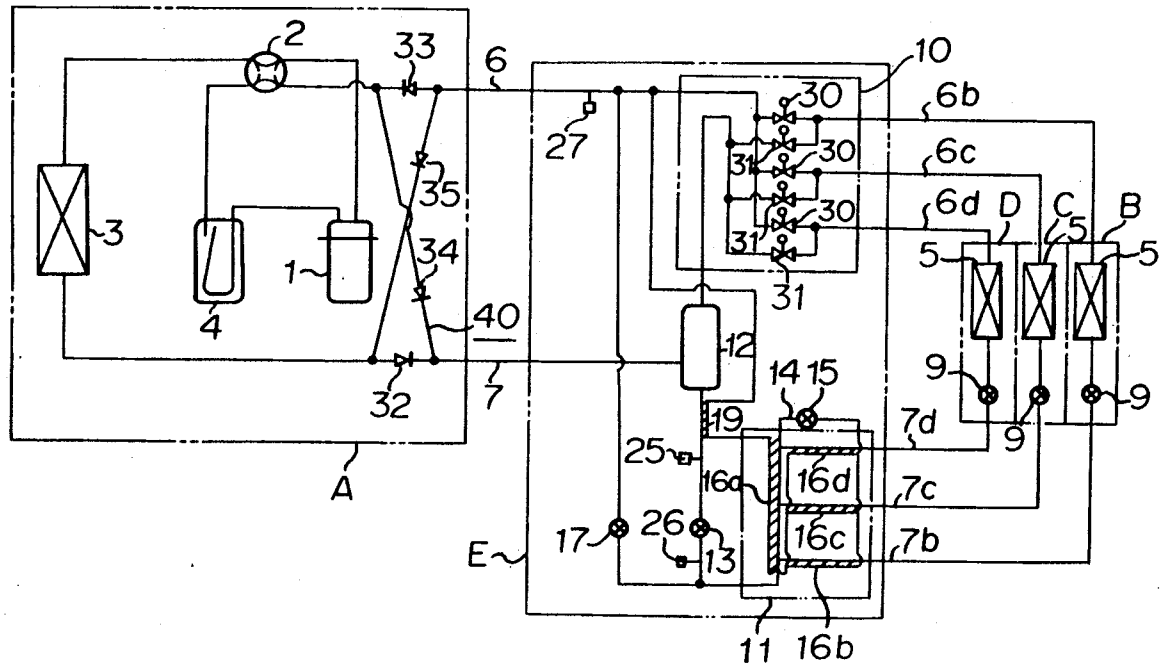
FIG. 18 is a schematic diagram showing the entire structure of a sixth and an eighth embodiment which is depicted on the basis of the refrigerant system of the apparatus.

Although the seventh embodiment the three way switching valves 8 can be arranged to selectively connect the first branch pipes 6b, 6c and 6d to either the first main pipe 6 or the second main pipe 7, paired on-off valves such as solenoid valves 30 and 31 can be provided instead of the three way switching valves as shown as an eighth embodiment in FIG. 18 to make selective switching, offering similar advantage.

As explained, in accordance with the air conditioning apparatus of the seventh and eighth embodiments, the refrigerant can be supplied to the heating indoor units in a sufficient manner. The branch pipes between the first flow controllers and the second branch joint are filled with the liquid refrigerant to decrease the amount of the excessive refrigerant held in the accumulator, thereby minimizing the accumulator. The occurrence of the refrigerant returning to the compressor in a liquid state can be minimized to improve the reliability of the compressor.

A ninth embodiment of the present invention will be explained in terms of the features different from the third embodiment, referring to FIGS. 6 through 9, FIG. 12, and FIGS. 23 and 24. Explanation of the features similar to the third embodiment will be omitted for the sake of simplicity.

In the ninth embodiment, the liquid purging pipe 41, the fifth flow controller 42, the fourth heat exchanging portion 43, the second temperature detector 51 and the third pressure detector 52 constitute boundary surface detecting means.

In the case wherein cooling is principally performed under the concurrent operation, when the liquid level at which the gaseous refrigerant and the liquid refrigerant separated in the gas liquid separator 12 are divided is below the liquid purging pipe 41 of the gas-liquid separator 12, the gaseous refrigerant enters the liquid purging pipe 41, and is depressurized to low pressure by the fifth flow controller 42. The amount of the refrigerant which is flowing through the fifth flow controller 42 is small because the refrigerant at the inlet of the fifth flow controller 42 is in the form of gas. As a result, the refrigerant which is flowing through the liquid purging pipe 41 carries out heat exchange, at the fourth heat exchanging portion 43, with the gaseous refrigerant which goes from the gas-liquid separator 12 to the first branch joint 10 and has high pressure. The refrigerant in the liquid purging pipe 41 becomes a superheated gas having low pressu·e due to such heat exchange, and enters the first main pipe 6.

Conversely, when the liquid level at which the gaseous refrigerant and the liquid refrigerant separated in the gas-liquid separator 12 are divided is above the liquid purging pipe 41 of the gas liquid separator 12, the liquid refrigerant enters the liquid purging pipe 41, and is depressurized to low pressure by the fifth flow controller 42. Because the refrigerant at the inlet of the fifth flow controller 42 is in the form of liquid, the amount of the refrigerant which is flowing through the fifth flow controller 42 is greater in comparison with the case wherein the refrigerant at the fifth flow controller 42 is in the form of gas. As a result, even when the refrigerant which is flowing through the liquid purging pipe 41 carries out heat exchanger, at the fourth heat exchanging portion 43, with the gaseous refrigerant which goes from the gas liquid separator 12 into the first branch joint 10 and has high pressure, the refrigerant in the liquid purging pipe 41 enters the first main pipe 6 in the form of two phase state without becoming a superheated gas having low pressure.

Although in the ninth embodiment the three way switching valve 8 can be arranged to selectively connect the first branch pipes 6*b*, 6*c* and 6*d* to either the first main pipe 6 or the second main pipe 7, paired on-off valves such as solenoid valves 30 and 31 can be provided instead of the three way switching valves as shown as a tenth embodiment in FIG. 10 to make selective switching, offering similar advantage.

Now, the control for the third flow controller 15 according to the ninth embodiment under the concurrent operation wherein cooling is principally performed will be explained.

Figure 9:
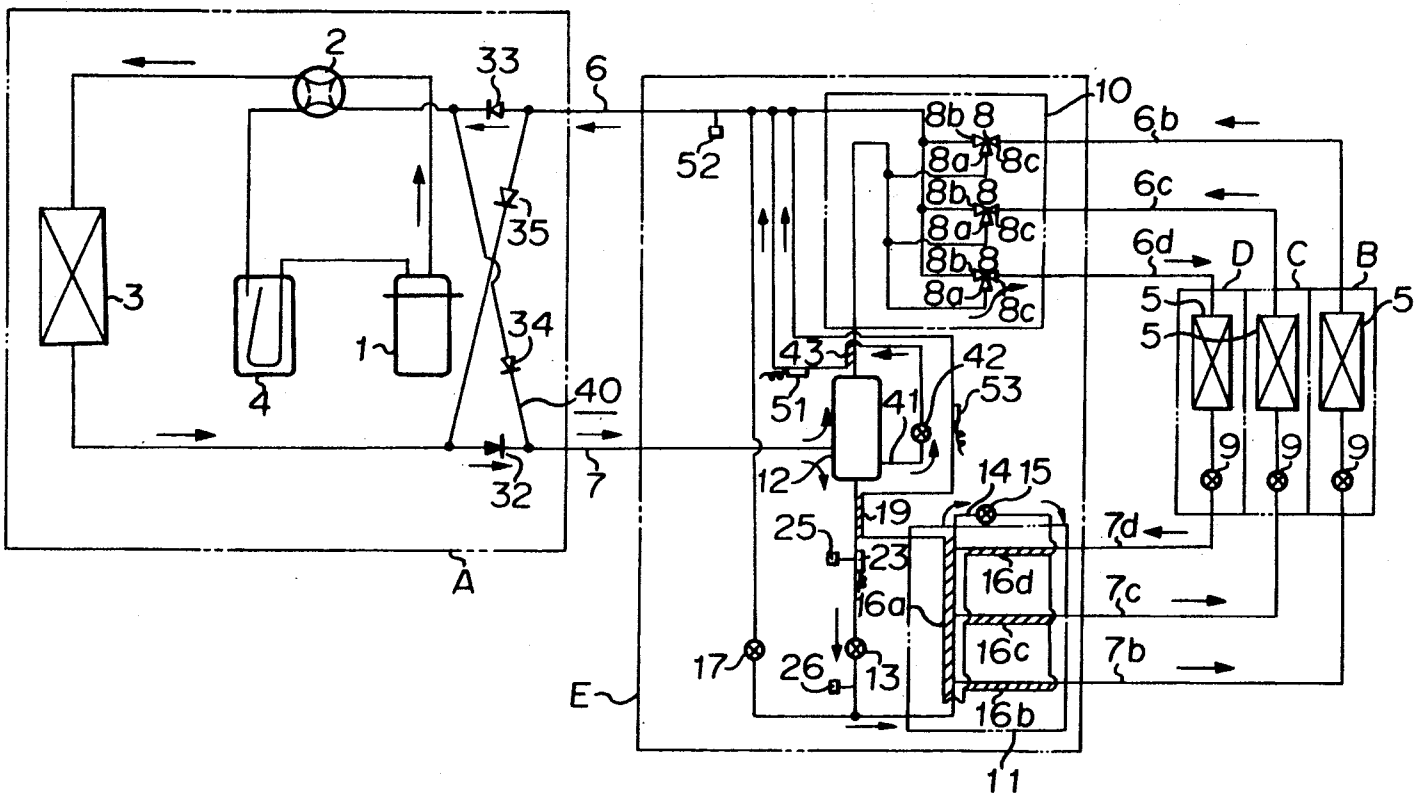
FIG. 9 is a schematic diagram showing the operation state of the third and a ninth embodiment of the FIG. 6 wherein room cooling is principally performed under room cooling and room heating concurrent operation (cooling load is greater than heating load)

Referring to FIG. 9, when the flow rate of the refrigerant under the flow control of the refrigerant cycle is smaller than the processing capability of the outdoor heat exchanger 3, the dryness fraction of the refrigerant which enters the gas liquid separator 12 lowers to run short of a gaseous refrigerant, thereby raising the liquid level as the boundary surface of the gaseous refrigerant and the liquid refrigerant in the gas-liquid separator 12. This causes the liquid refrigerant to be included in the gaseous refrigerant at the gas-liquid separator 12. The gaseous refrigerant including the liquid refrigerant goes into the heating indoor unit D through the first branch joint 10 and the first branch pipe 6*d*. As a result, the degree of subcooling of the refrigerant at the outlet of the indoor heat exchanger 5*d* of the indoor unit D is increased to run short of heating capability. In addition, the liquid level in the gas-liquid separator 12 raises, causing the liquid refrigerant to enter the liquid purging pipe 41. Because the refrigerant at the inlet of the fifth flow controller 42 is in the form of liquid, the flow rate of the refrigerant which is flowing through the fifth flow controller 42 increases. Even if the refrigerant in the liquid purging pipe 41 carries out heat exchange at the fourth heat exchanging portion 43, the refrigerant does not become take a superheated gaseous state, and enters the first main pipe 6, taking a two phase state. As a result, the degree of superheat found from the temperature detected by the second temperature detector 51 and the pressure detected by the third pressure detector 52 becomes small. In order to cope with this problem, the opening angle of the third flow controller 15 is enlarged to increase the flow rate of the refrigerant under the flow control of the refrigerant cycle to increase the dryness fraction of the refrigerant which flows into the gas-liquid separator 12. In this manner, the gaseous refrigerant can be ensured in an adequate amount to obtain a suitable heating capability of the heating indoor unit D.

On the other hand, when the flow rate of the refrigerant under the flow control of the refrigerant cycle is greater than the processing capability of the outdoor heat exchanger 3, the dryness fraction of the refrigerant which enters the gas liquid separator 12 rises to bring the flow rate of the gaseous refrigerant into an oversupply state. As a result, the liquid level as the boundary surface of the gaseous refrigerant and the liquid refrigerant in the gas-liquid separator 12 lowers, causing the gaseous refrigerant to be included in the liquid refrigerant at the gas-liquid separator 12. Because the liquid refrigerant including the gaseous refrigerant enters the first heat exchanging portion 19, the degree of subcooling of the refrigerant at the outlet of the first heat exchanging portion 19, i.e., at the inlet of the second flow controller 13 decreases to run short of heat exchange capability at the first, second and third heat exchanging portions 19, 16*a*, 16*b*, 16*c* and 16*d*. Thus, the degree of subcooling of the refrigerant which is going to enter from the second branch joint 11 into the cooling indoor units B and C becomes insufficient to deteriorate good distribution of the refrigerant. In addition, the liquid level in the gas liquid separator 12 lowers, causing the gaseous refrigerant to enter the liquid purging pipe 41. Because the refrigerant at the inlet of the fifth flow controller 42 is in the form of gas, the flow rate of the refrigerant which is flowing through the fifth flow controller 42 decreases, and the refrigerant in the liquid purging pipe 41 takes a superheated gaseous state due to heat exchange at the fourth heat exchanging portion 43. Then the refrigerant enters the first main pipe 6, taking such superheated gaseous state, which increases the degree of superheat which is found from the temperature detected by the second temperature detector 51 and the pressure detected by the third pressure detector 52. In order to cope with this problem, the opening angle of the third flow controller 15 is reduced to decrease the flow rate of the refrigerant under the flow control of the refrigeration cycle, thereby lowering the dryness fraction of the refrigerant which enters the gas-liquid separator 12. In this manner, the gaseous refrigerant can be ensured at an adequate amount to prevent the gaseous refrigerant from entering the first heat exchanging portion 19. Thus the refrigerant which enters the cooling indoor units B and C can be obtained, having a sufficient degree of subcooling to ensure good distribution of the refrigerant.

Figure 23:
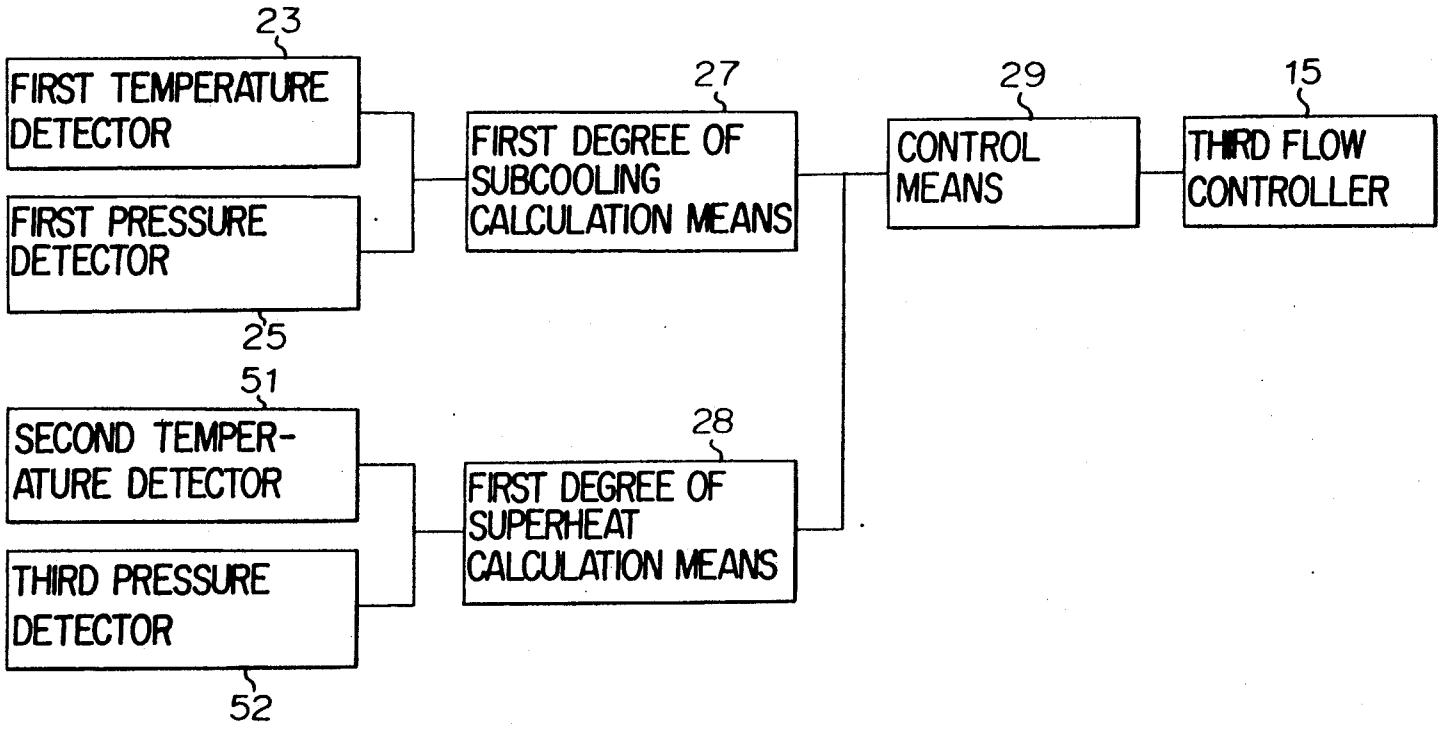
FIG. 23 is a schematic diagram showing the structure of the flow controller control system in a ninth embodiment.
Figure 24:
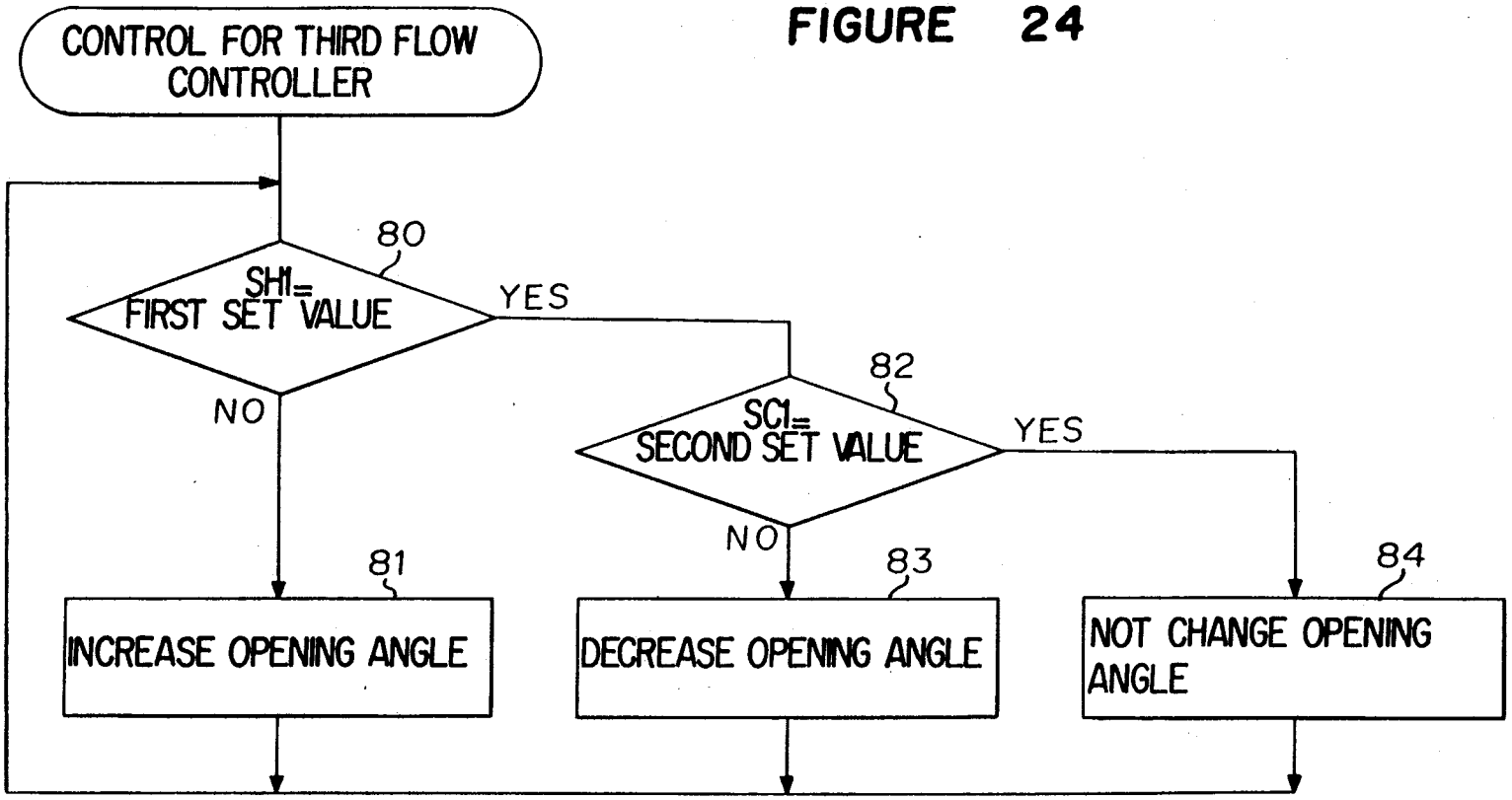
FIG. 24 is a flowchart showing the operation of the flow controller control system of the ninth embodiment.

The explanation will be continued, referring to FIGS. 23, 12 and 24.

Referring to FIG. 23, there is shown a schematic diagram showing the control for the third flow controller 15 according to the ninth embodiment. First degree of subcooling calculation means 27 calculates a degree of subcooling (hereinbelow, referred to as the first degree of subcooling SC1) based on the temperature detected by the first temperature detector 23 and the pressure detected by the first pressure detector 25. A first degree of superheat calculation means 28 calculates a degree of superheat at the outlet of the fourth heat exchanging portion 43 (hereinbelow, referred to as first degree of superheat SH1) based on the temperature detected by the second temperature detector 51 and the pressure detected by the third pressure detector 52. Based on the first degree of subcooling SCl and the first degree of superheat SHl, control means 29 determines the opening angle of the third flow controller to control it.

An example of the electrical connection for the control in the ninth embodiment is similar to the electrical connection shown in FIG. 12 with respect to the third embodiment. Reference numeral 60 designates a microcomputer which is arranged in a controller 59, and which includes a CPU 61, a memory 62, an input circuit 63 and an output circuit 64. Reference numerals 65, 66, 67, 68, 69 and 70 designate resistors which are connected in series with the first, second and third temperature detectors 23, 51 and 53, and the first, second and third pressure detectors 25, 26 and 52, respectively. Reference numeral 71 designates an A/D converter which converts detection outputs from the first, second and third temperature detectors 23, 51 and 53, and the first, second and third pressure detectors 25, 26 and 52 into digital outputs, and which gives its outputs to the input circuit 63. Control transistors 52 and 53 which control the opening angle of the third flow controller 15 are connected to the output circuit 64 through resistors 74 and 75, respectively.

Referring now to FIG. 24, there is show a flowchart showing a control program for the opening angle of the third flow controller 15, which is stored in the memory 62 of the microcomputer 60. At Step 80, it is judged whether the first degree of superheat SHl is a predetermined first set value or above. If affirmative, the program proceeds to Step 82. If negative, the program proceeds to Step 81. At Step 81, the opening angle of the third flow controller 15 is increased. At Step 82, it is judged whether the first degree of subcooling of SCl is a predetermined second set value or below. If affirmative, the program proceeds to Step 84. If negative, the program proceeds to Step 83. At Step 83, the opening angle of the third flow controller 15 is decreased. At Step 84, the opening angle of the third flow controller 15 is not changed.

As explained, in accordance with the air conditioning apparatus of the ninth and tenth embodiments, the control under the concurrent operation wherein cooling is principally performed is made such that the boundary surface of the gaseous refrigerant and the liquid refrigerant in the gas-liquid separator is below the location of the liquid purging pipe, and the refrigerant at the outlet of the first heat exchanging portion takes the set degree of subcooling. Such control can ensure an adequate heating capability for the heating indoor unit, and give sufficient degree of subcooling to the refrigerant which is going to enter the cooling indoor units. In other words, the opening angle of the third flow controller is increased in a way to lower the boundary surface of the gaseous refrigerant and the liquid refrigerant to a position below the liquid purging pipe in the gas-liquid separator, thereby preventing the occurrence of such state that the flow rate of the refrigerant under the flow control of the refrigerant cycle is smaller than the processing capability of the outdoor heat exchanger, and the dryness fraction of the refrigerant which enters the junction device lower to run short of heating capability due to shortage of the gaseous refrigerant. On the other hand, the opening angle of the third flow controller is decreased in a way to bring the degree of subcooling of the refrigerant at the inlet of the second flow controller to the set degree of subcooling, thereby preventing the occurrence of such state that because the flow rate of the refrigerant under the flow control of the refrigeration cycle is greater than heat exchange capability of the outdoor heat exchanger, the dryness fraction of the refrigerant which enters the junction device is increased, and the flow rate of the gaseous refrigerant is excessive. In that manner, it can be prevented that good distribution of the refrigerant deteriorates because a part of the gaseous refrigerant which can not into the heating indoor unit enters the second branch joint and because the degree of subcooling of the refrigerant which enters from the second branch joint into the cooling indoor units becomes insufficient.

An eleventh embodiment will be explained, referring to FIGS. 25 through 28.

Although explanation of the eleventh embodiment will be made for the case wherein a single heat source device is connected to two indoor units having different capacities, the present invention is also applicable to the case wherein a single source device is connected to more than two indoor units, or a single source device is connected to indoor units having the same capacity.

The explanation of the eleventh embodiment will be made in terms of the features different from the third embodiment. Explanation of the features of the eleventh embodiment similar to the third embodiment will be omitted for the sake of simplicity.

Figure 25:
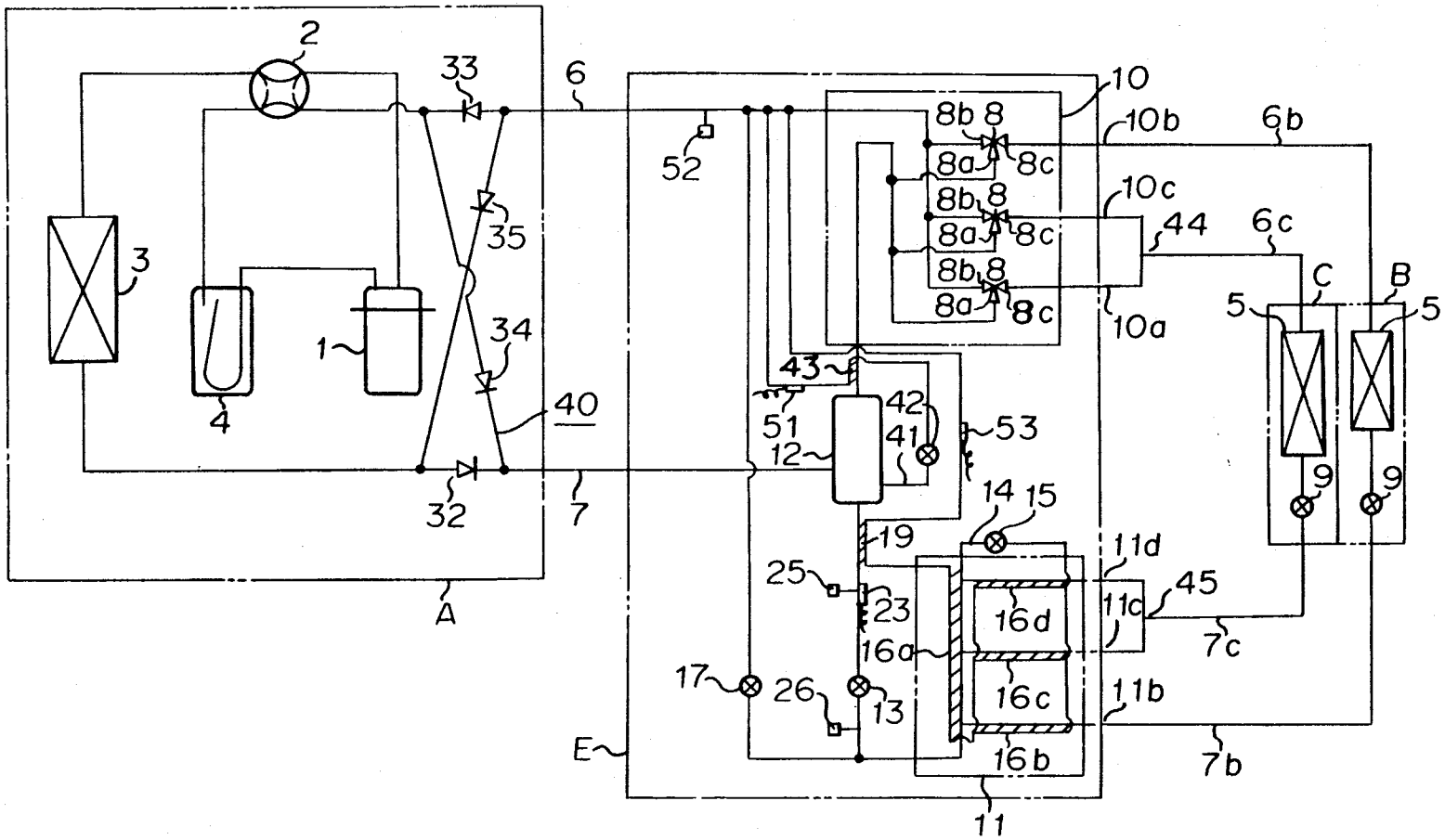
FIG. 25 is a schematic diagram of the entire structure of an eleventh embodiment of the air conditioning apparatus according to the present invention, which is depicted on the basis of the refrigerant system of the apparatus.

In FIG. 25, reference numerals **6*b* and 6*c* designate first branch pipes which connect between a junction device E and indoor heat exchangers 5 of indoor units B and C, respectively, and which correspond to a first main pipe 6. Reference numerals 7*b* and 7*c* designate second branch pipes which connect between the indoor heat exchangers 5 of the indoor units B and C and the junction device E, and which correspond to a second main pipe 7. Reference numeral 8 designates three way switching valves which can selectively connect the first branch pipes 6*b* and 6*c* to either the first main pipe 6 or the second main pipe 7. Reference numeral 10*b*, 10*c* and 10*d* designate first branch ports which correspond to the respective three way switching valves 8. Reference numeral 9 designates first flow controllers which are connected to the second branch pipes 7*b* and 7*c*. Reference numeral 10 designates a first branch joint which includes the first ports 10*b*, 10*c* and 10*d*, and the three way switching valves 8 making selective connection to either the first main pipe 6 or the second main pipe 7. Reference numeral 11 designates a second branch joint which includes the second branch ports 11*b*, 11*c* and 11*d*, and a confluent portion of the second branch ports. Reference numeral 44 designates a first combinative portion which combines the first branch ports 10*c* and 10*d* to connect to the first branch pipe 6*c* for the indoor unit C having a greater capacity. Reference numeral 45 designates a second combinative portion which combines the second branch ports 11*c* and 11*d* to connect to the second branch pipe 7*c*** for the indoor unit C.

The operation of the air conditioning apparatus constructed in accordance with the eleventh embodiment will be explained.

Firstly, the operation of solo cooling will be explained, referring to FIG. 26.

Figure 26:
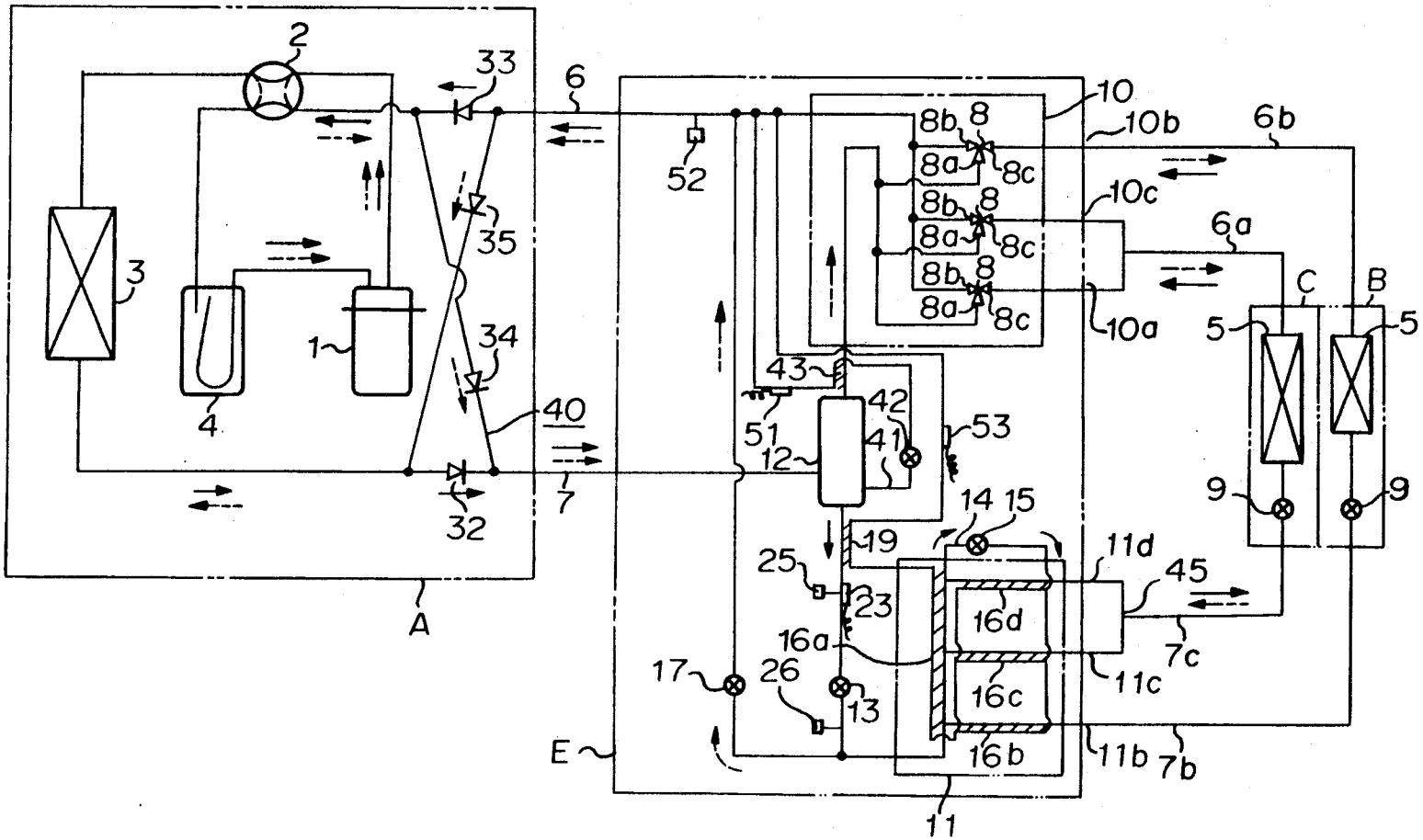
FIG. 26 is a schematic diagram showing the operation states of the eleventh embodiment of FIG. 25 wherein solo operation on room cooling and solo operation on room heating are performed.

As indicated by arrows of solid line in FIG. 26, the refrigerant gas which has been discharged from the compressor 1 is divided at the second branch joint 11 into two portions, one of them entering the indoor unit B through the second branch port 11*b* and the second branch pipe 7*b*, and the other entering the indoor unit C through the second branch ports 11*c* and 11*d*, the second combinative portion 45 and the second brar ch pipe 7*c*. The refrigerant goes into the three way switching valves 8 from the indoor unit B through the first branch pipe 6*b* and the first branch port 10*b*, and from the indoor unit C through the first branch pipe 6*a*, the first combinative portion 44 and the first branch ports 10*c* and 10*d*. Then refrigerant passes through the first branch joint 10, and is inspired into the compressor 1 through the first main pipe 6, the fourth check valve 33, the four way switching valve 2 and the accumulator 4. In this manner, a circulation cycle is formed to carry out cooling. Although the refrigerant which enters into the first branch joint 10 from the indoor unit C having a greater capacity is greater than the refrigerant from the indoor unit B in terms of amount, the refrigerant from the indoor unit C is divided into two parts at the first combiantive portion 44 and these parts enter the three way switching valves 8 through the first branch ports 10*c* and 10*d*, respectively. This arrangement allows the refrigerant to enter the first main pipe 6 while pressure loss of the refrigerant through the three way switching valves 8 is restrained at a low level.

The refrigerant which is going to enter the indoor unit C is divided into two parts, and these parts are cooled to obtain sufficient degree of subcooling at the third heat exchanging portion 16*c* and 16*d*, respectively. After that, these divided parts pass through the second branch ports 11*c* and 11*d*, and join at the second combinative portion 45. The refrigerant thus joined enters the indoor unit C through the second branch pipe 7*c*. The arrangement wherein the refrigerant is divided into two parts for passing through the third heat exchanging portions 16*c* and 16*d* can restrain pressure loss in passing therethrough.

Secondly, the operation on solo heating will be explained, referring to FIG. 26. As indicated by arrows of dotted line in FIG. 26, the refrigerant gas which has been discharged from the compressor 1 passes through the second main pipe 7 and the gas liquid separator 12. The refrigerant is divided into two portions through the first branch joint 10 and the three way switching valves 8, one portion entering the indoor unit B through the first branch port 10*b* and the first branch pipe 6*b*, and the other portion entering the indoor unit C through the second branch ports 10*c* and 10*d*, the first combinative portion 44 and the first branch pipe 6*a*. The refrigerant which has entered the indoor units B and C flows into the second branch joint 11 from the indoor unit B through the second branch pipe 7*b* and the second branch port 11*b*, and from the indoor unit C through the second branch pipe 7*c*, the second combinative portion 45 and the second branch ports 11*c* and 11*d*. Although the refrigerant flows from the first branch joint 10 into the indoor unit C having a greater capacity is greater than the refrigerant to the indoor unit B in terms of amount, the refrigerant which is going to enter the indoor unit C is divided into two parts for passing through the three way switching valves 8, and join at the first combinative portion 44 through the first branch ports 10*c* and 10*d*. This arrangement allows the refrigerant to enter the indoor unit C while pressure loss of the refrigerant passing through the three way switching valves 8 can be restrained at a low level. In addition, although the refrigerant which is going to flow from the indoor unit C into the second branch joint 11 is greater than the refrigerant from the indoor unit C in terms of amount, the refrigerant which enters from the indoor unit C is divided into two parts at the second combinative portion 45, and these parts flow into the third heat exchanging portions 16*c* and 16*d* through the second branch ports 11*c* and 11*d*. Such arrangement allows the refrigerant to enter the second branch joint 11 while pressure loss of the refrigerant passing through the third heat exchanging portions 16*c* and 16*d* can be restrained at a low level.

The concurrent operation wherein heating is principally performed will be explained, referring to FIG. 27. Explanation will be made for the case wherein the indoor unit C carries out heating and the indoor unit B performs cooling.

Figure 27:
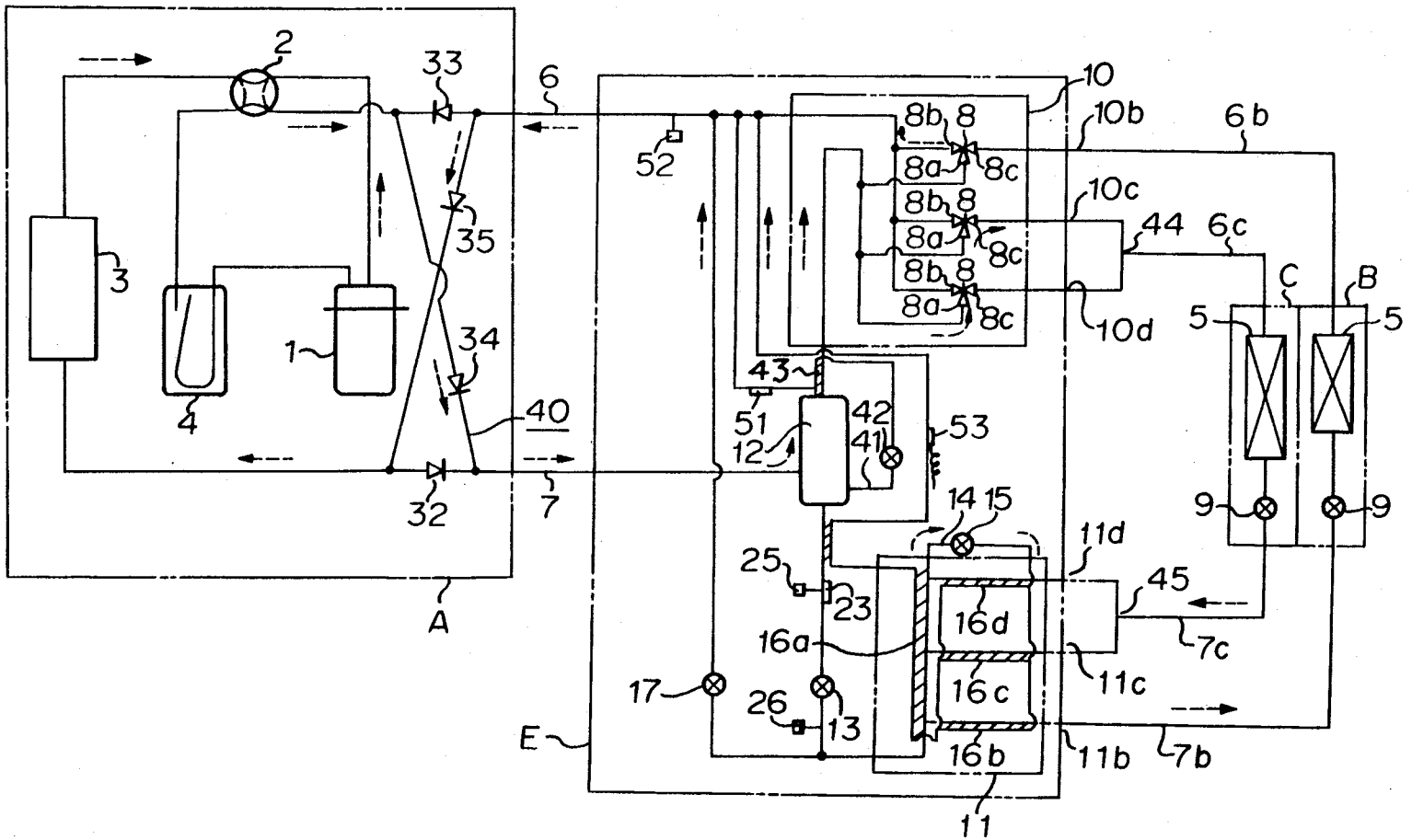
FIG. 27 is a schematic diagram showing the operation state of the eleventh embodiment of FIG. 25 wherein room heating is principally performed under room cooling and room heating concurrent operation (the total capacity of heating indoor units is greater than that of cooling indoor units)

As indicated by arrows of dotted line in FIG. 27, the refrigerant gas which has been discharged from the compressor 1 passes through the first branch ports 10*c* and 10*d*, the first combinative portion 44 and the first branch pipe 6*c* in that order, and enters the heating indoor unit C. The refrigerant flows from the indoor unit C into the second branch joint 11 through the second branch pipe 7*c*, the second combinative portion 45 and the second branch ports 11*c* and 11*d*. Then the refrigerant is divided into two parts at the second branch joint 11. One of the parts enters the cooling indoor unit B through the second branch port 11*b* and the second branch pipe 7*b*, and flows from the indoor unit B into the first main pipe 6 through the three way switching valve 8 connected to the indoor unit B.

Another part of the refrigerant passes through a fifth flow controller 17, and joins with the refrigerant which has been passed through the cooling indoor unit D. Although the refrigerant which is going to flow from the first branch joint 10 into the indoor unit C having the greater capacity is greater than the refrigerant from the indoor unit B in terms of amount, the refrigerant to the indoor unit C is divided into two parts for passing through the three way switching valves 8, and joins at the first combinative portion 44 through the first branch ports 10*c* and 10*d*. Such arrangement allows the refrigerant to enter the indoor unit C while pressure loss of the refrigerant passing through the three way switching valves 8 can be restrained at a low level.

Although the refrigerant which is going to flow from the indoor unit C into the second branch joint 11 is greater than the refrigerant to the indoor unit B in terms of amount, the refrigerant from the indoor unit C into the second branch joint 11 is divided into two parts at the second combinative portion 45. These parts pass through the second branch ports 11*c* and 11*d*, and are cooled to obtain sufficient degree of subcooling at the third heat exchanging portions 16*c* and 16*d* before entering the second branch joint 11. The arrangement wherein the refrigerant is divided into two parts for passing through the third heat exchanging portions 16*c* and 16*d* allows pressure loss of the refrigerant to be restrained at a low level in passing therethrough.

Figure 28:
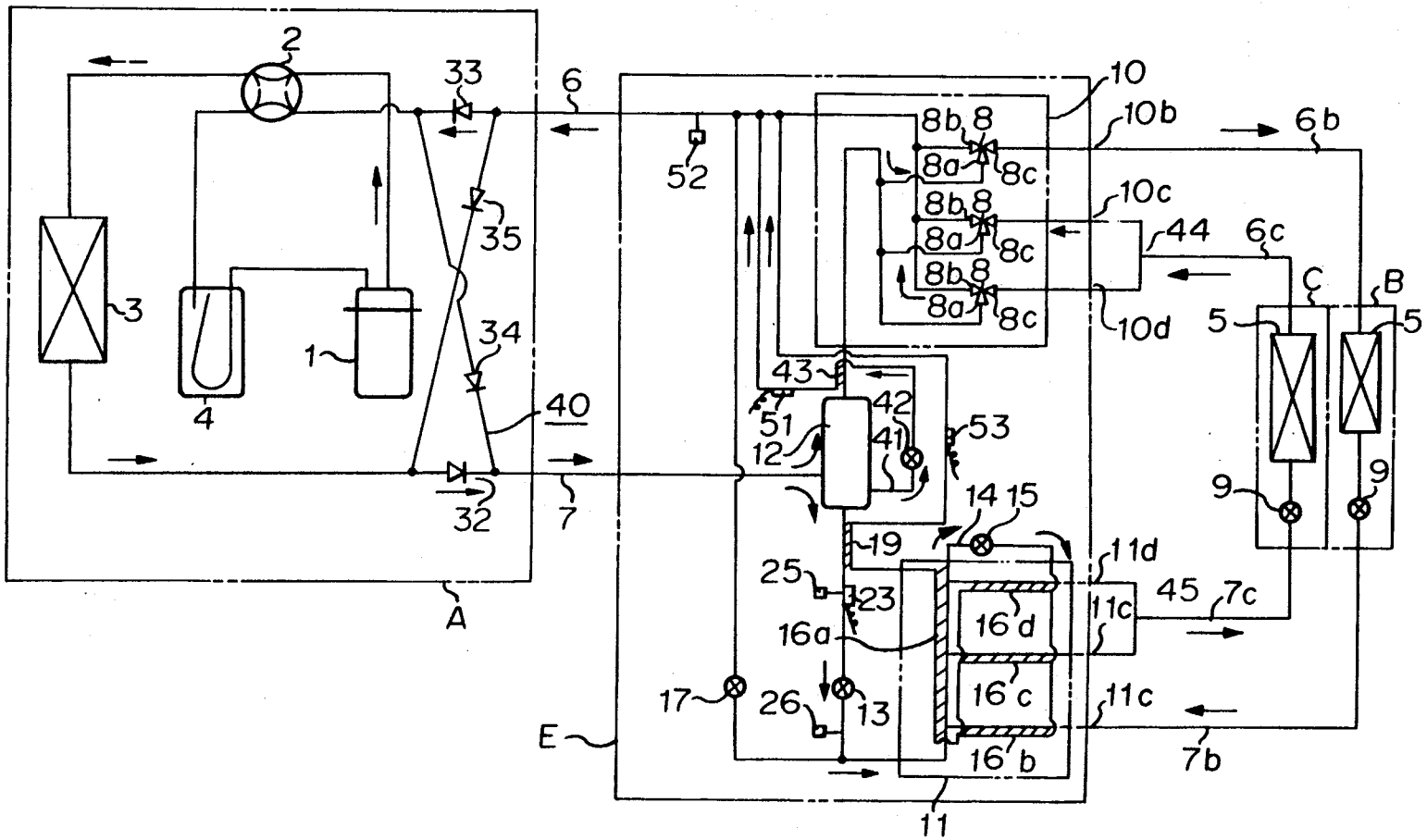
FIG. 28 is a schematic diagram showing the operation state of the eleventh embodiment of the FIG. 25 wherein room cooling is principally performed under room cooling and room heating concurrent operation (the total capacity of cooling indoor units is greater than that of heating indoor units)

The concurrent operation wherein cooling is principally performed will be explained, referring to FIG. 28. Explanation will be made for the case wherein the indoor unit C carries out cooling and the indoor unit B performs heating. As indicated by arrows of solid line in FIG. 28, the refrigerant gas which has been discharged from the compressor 1 is forwarded to the gas-liquid separator 12 in the junction device E. In the gas-liquid separator 12, the refrigerant is separated into a gaseous refrigerant and a liquid refrigerant. The gaseous refrigerant passes through the first branch joint 10, the three way switching valve 8, the first branch port 10*b* and the first branch pipe 6*b* in that order, and enters the heating indoor unit B. On the other hand, the liquid refrigerant enters the second branch joint 11 through a second flow controller 13, and joins with the refrigerant which has passed through the heating indoor unit B. The refrigerant thus joined flows into the cooling indoor unit C through the second branch joint 11, the second branch ports 11*c* and 11*d*, the second combinative portion 45 and the second branch pipe 7*c*. Then the refrigerant passes through the first branch pipe 6*c*, the first combinative portion 44 and the first branch ports 10*c* and 10*d*. The refrigerant is inspired into the compressor 1 through the three way switching valves 8 connected to the indoor unit C, the first branch joint 10, the first main pipe 6, the fourth check valve 33, the four way switching valve 2 and the accumulator 4. In that manner, a circulation cycle is formed to carry out the concurrent operation wherein cooling is principally performed. Although the refrigerant which will enter the first branch joint 10 from the indoor unit C having the greater capacity is greater than the refrigerant to the indoor unit B in terms of amount, the refrigerant from the indoor unit C is divided into two parts at the first combinative portion 44 for entering the three way switching valves 8 through the first branch ports 10*c* and 10*d*. Such arrangement allows the refrigerant to enter the first main pipe 6 while pressure loss of the refrigerant passing through the three way switching valve 8 can be restrained at a low level.

The refrigerant which will enter the indoor unit C having the greater capacity is divided at the second branch joint 11 for passing through the third heat exchanging portions 16*c* and 16*d*, and is cooled to obtain sufficient degree of subcooling at the third heat exchanging portions 16*c* and 16*d*. After that, these parts join at the second combinative portion 45 through the second branch ports 11*c* and 11*d*, and enters the indoor unit C through the second branch pipe 7*c*. The arrangement wherein the refrigerant is divided into such two parts for passing through the third heat exchanging portions 16*c* and 16*d* allows the refrigerant to restrain pressure loss at a low level in passing therethrough.

Figure 29:
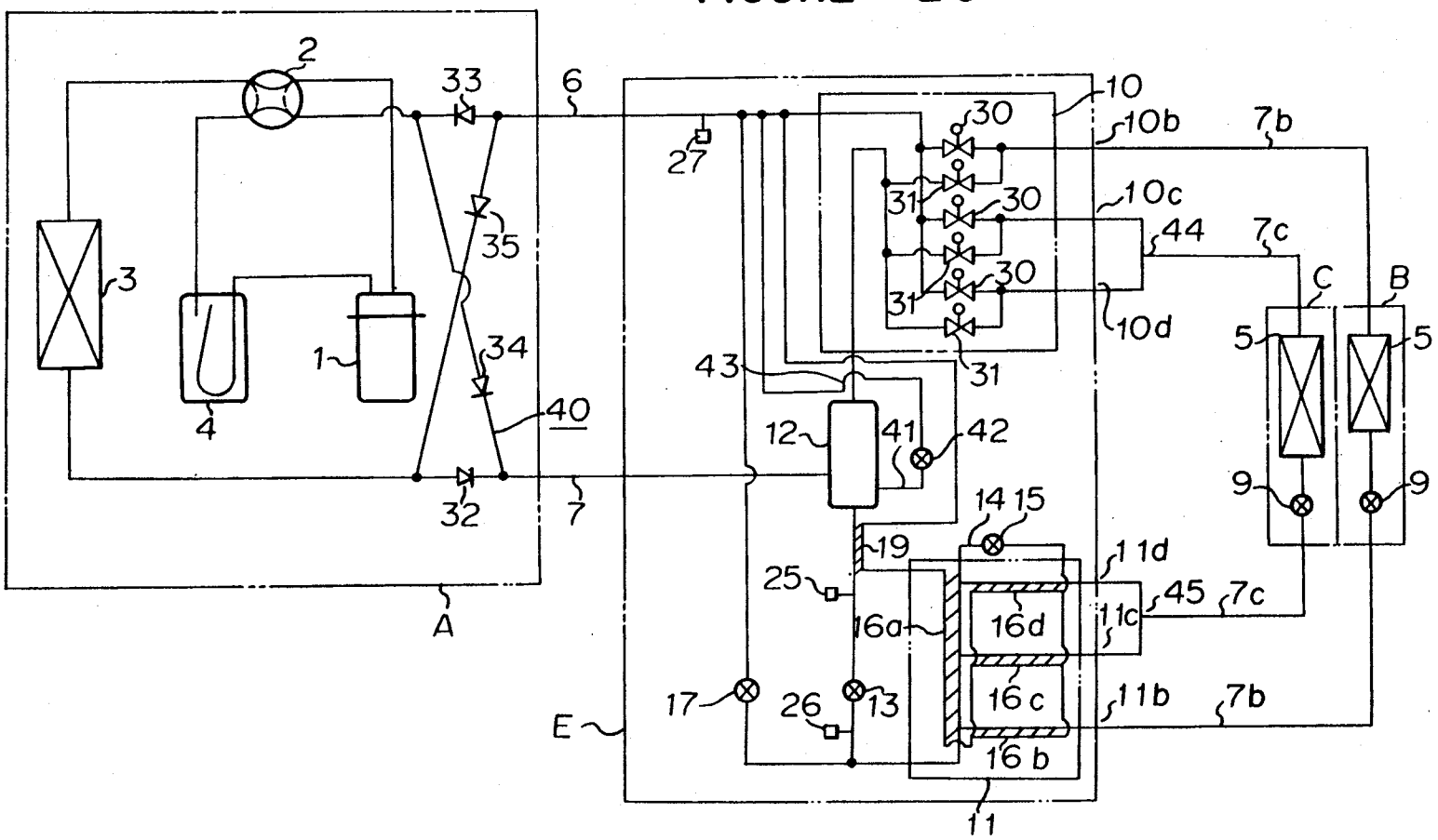
FIG. 29 is a schematic diagram showing the entire structure of a twelfth embodiment which is depicted on the basis of the refrigerant system of the apparatus.

Although in the eleventh embodiment the three way switching valves 8 can be arranged to selectively connect the first branch pipes 6*b* and 6*c* to either the first main pipe 6 or the second main pipe 7, paired on-off valves such as solenoid valves 30 and 31 can be provided instead of the three way switching valves as shown as a twelfth embodiment in FIG. 29 to make selective switching, offering similar advantage.

As explained, in accordance with the air conditioning system of the eleventh and twelfth embodiments, depending on the capacities of the indoor units connected to the junction device, an individual use of the respective first ports or a combined use of some first ports, and an individual use of the third heat exchanging portions for a combined use of some of the third heat exchanging portions can be made for connection with the indoor units. By this arrangement, the refrigerant which will flow into the first branch joint from the indoor unit having a greater capacity, and the refrigerant which will flows from the first branch joint into the indoor unit having a greater capacity can restrain pressure loss at a low level in passing through the three way switching valves. This can prevent the occurrence of such state that heating capability is lowered due to an decrease in the condensasing pressure at the heating indoor unit, and that cooling capability is lowered due to an increase in the evaporating pressure at the cooling indoor unit.

In addition, the refrigerant which is going to enter the second branch joint from the indoor unit having the greater capacity, and the refrigerant which will flow from the second branch joint into the indoor unit having the greater capacity are sufficiently cooled at the third heat exchanging portions to obtain sufficient degree of subcooling. Further, pressure loss of the refrigerant which is passing through the third heat exchanging portions can be restrained at a low level.

The present invention can offer an advantage in that a single kind of junction device can be connected to a plurality of indoor units having different capacities to obtain a required capability without specializing the respective connection branch ports, depending on the capacities of the indoor units.

A thirteenth embodiment of the present invention will be described in terms of the features different from the first embodiment, referring to FIG. 30 through 36. Explanation of the features of the thirteenth embodiment similar to the first embodiment will be omitted for the sake of simplicity.

Figure 30:
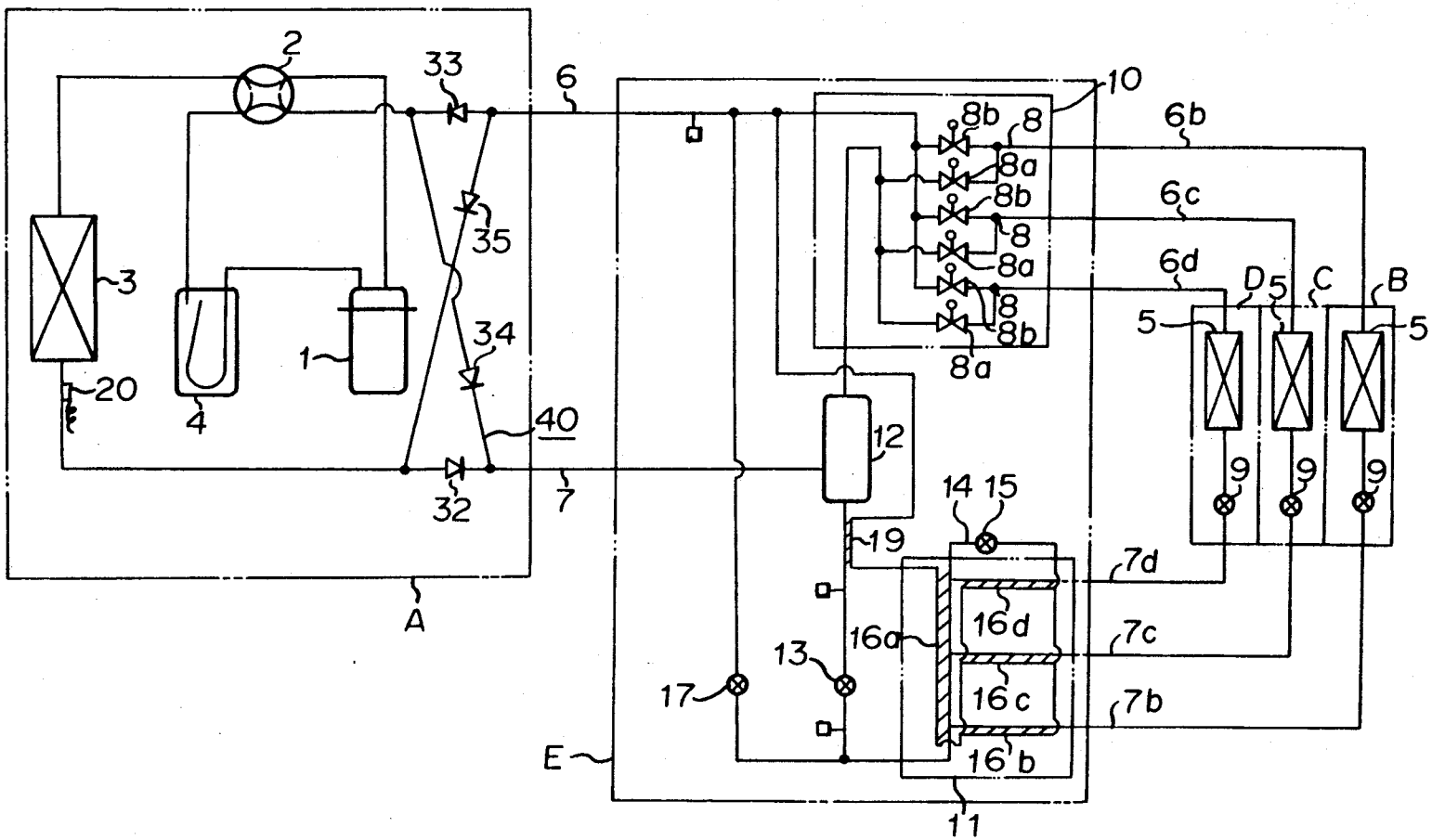
FIG. 30 is a schematic diagram of the entire structure of a thirteenth embodiment of the air conditioning apparatus according to the present invention, which is depicted on the basis of the refrigerant system of the apparatus.

In FIG. 30, reference numeral 8 designates switching valve junctions which can be arranged in a first branch joint to selectively connect first branch pipes 6*b*, 6*c* and 6*d* to either a first main pipe 6 or a second main pipe 7, and which have first ports provided with on-off valves 8*a* for connection with the second main pipe 7, and second ports provided with on-off valves 8*b* for connection with the first main pipe 6.

Figure 31:
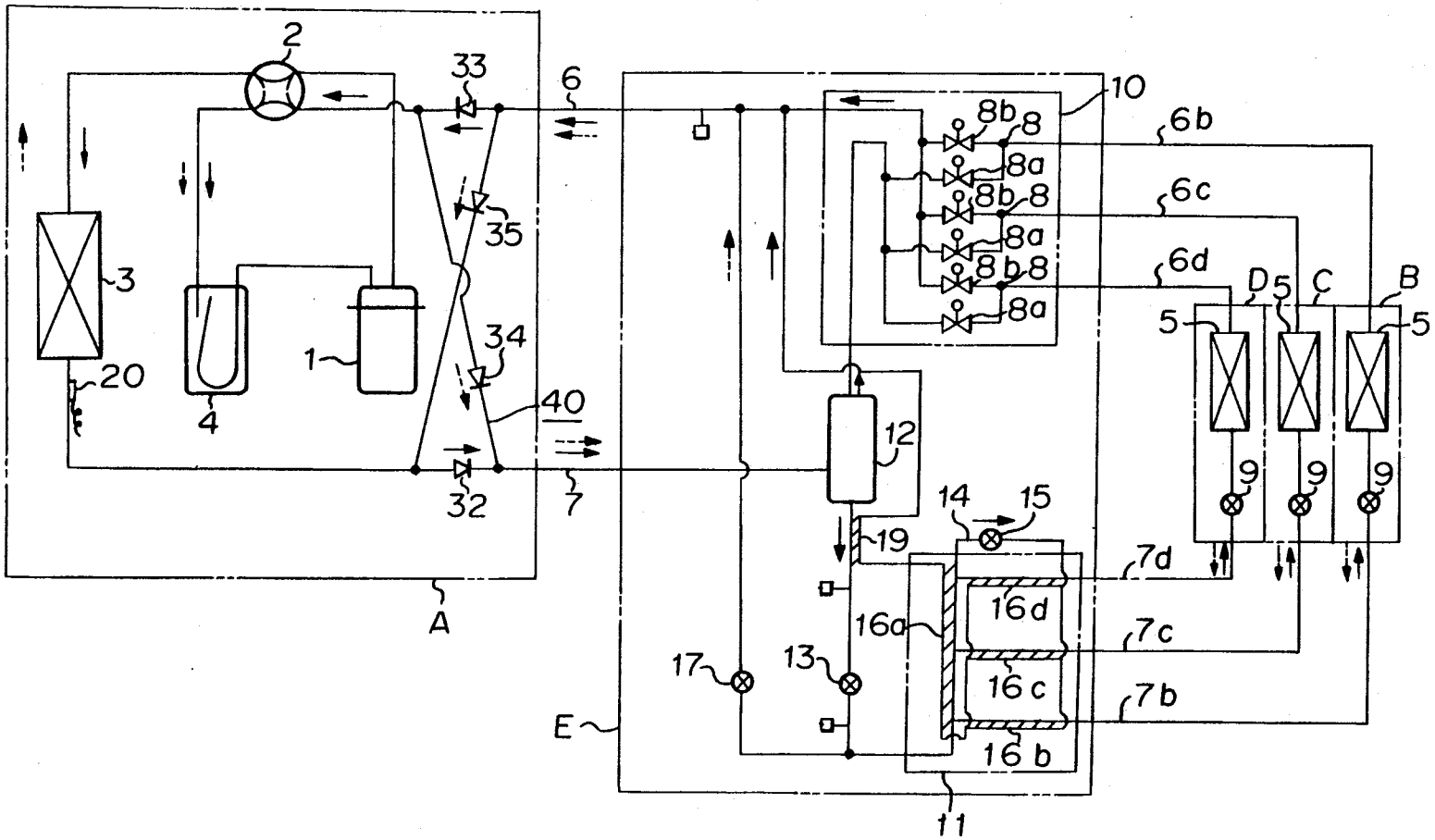
FIG. 31 is a schematic diagram showing the operation states of the thirteenth embodiment of FIG. 30 wherein solo operation on room cooling and solo operation on room heating are performed.

In solo cooling, the refrigerant flows in a refrigerant circuit as indicated by arrows of solid line in FIG. 31.

The switching valve junctions 8 in the first branch joint 10 have the on-off valves 8*a* for the first ports closed, and the on-off valves 8*b* for the second ports opened.

In solo heating, the refrigerant flows in through the refrigerant circuit as indicated by arrows of dotted line in FIG. 31. The switching valve junctions 8 in the first branch joint 10 have the on-off valves 8*a* opened, and the on-off valves 8*b* closed.

Figure 32:
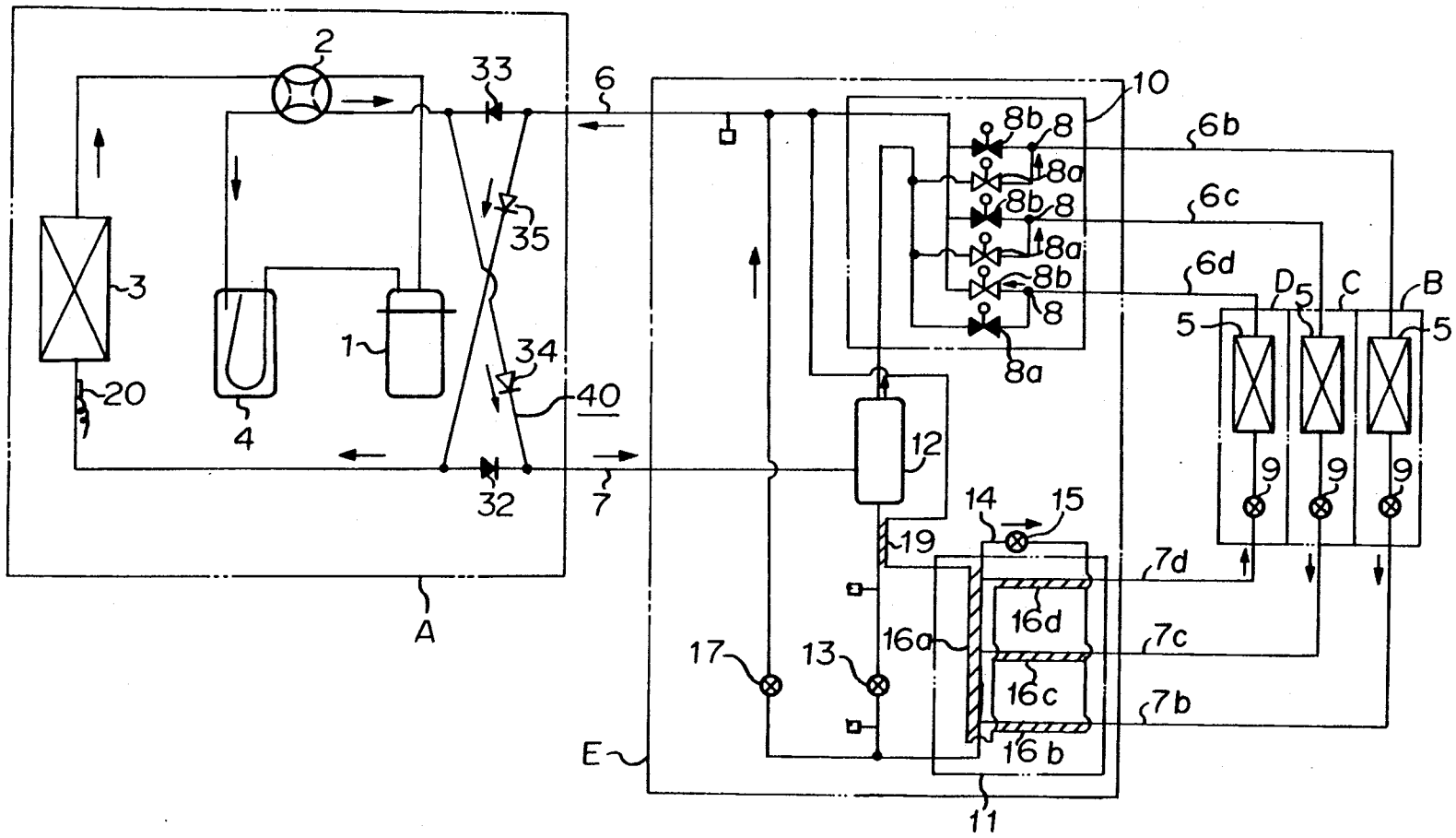
FIG. 32 is a schematic diagram showing the operation state of the thirteenth embodiment of FIG. 30 wherein room heating is principally performed under room cooling and room heating concurrent operation (heating load is greater than cooling load)

The case wherein heating is principally performed under the concurrent operation will be explained, referring to FIG. 32. Explanation will be made for the case wherein two indoor units B and C carry out heating, one indoor unit D carries out cooling.

The refrigerant flows through the refrigerant circuit as indicated by arrows of solid line. The switching valve junctions 8 which are connected to the heating indoor units B and C have the on-off valves 8*b* for the second ports closed, and the on-off valves 8*a* for the first ports opened. The switching valve junction 8 which is connected to the cooling indoor unit D has the on-off valve 8*a* for the first port closed, and the on-off valve 8*b* for the second port opened. In this cycle, a part of the liquid refrigerant enters a bypass pipe 14 from a confluent portion of second branch pipes 7b, 7c and 7d in a second branch joint 11. That part of the liquid refrigerant is depressurized to low pressure by a third flow controller 15, and carries out heat exchange at third heat exchanging portions 16b, 16c and 16d, and at a second heat exchanging portion 16a. The refrigerant which has evaporated due to such heat exchange flows into the first main pipe 6. On the other hand, the refrigerant which has carried out heat exchange and has been cooled at the second and third heat exchanging portions 16a, 16b, 16c and 16d to obtain sufficient subcooling flows from the second branch joint 11 into the cooling indoor unit D.

The case wherein cooling is principally performed under the concurrent operation will be explained, referring to FIG. 33. Explanation will be made for the case wherein the indoor units B and C carry out cooling, and the indoor unit D performs heating.

Figure 33:
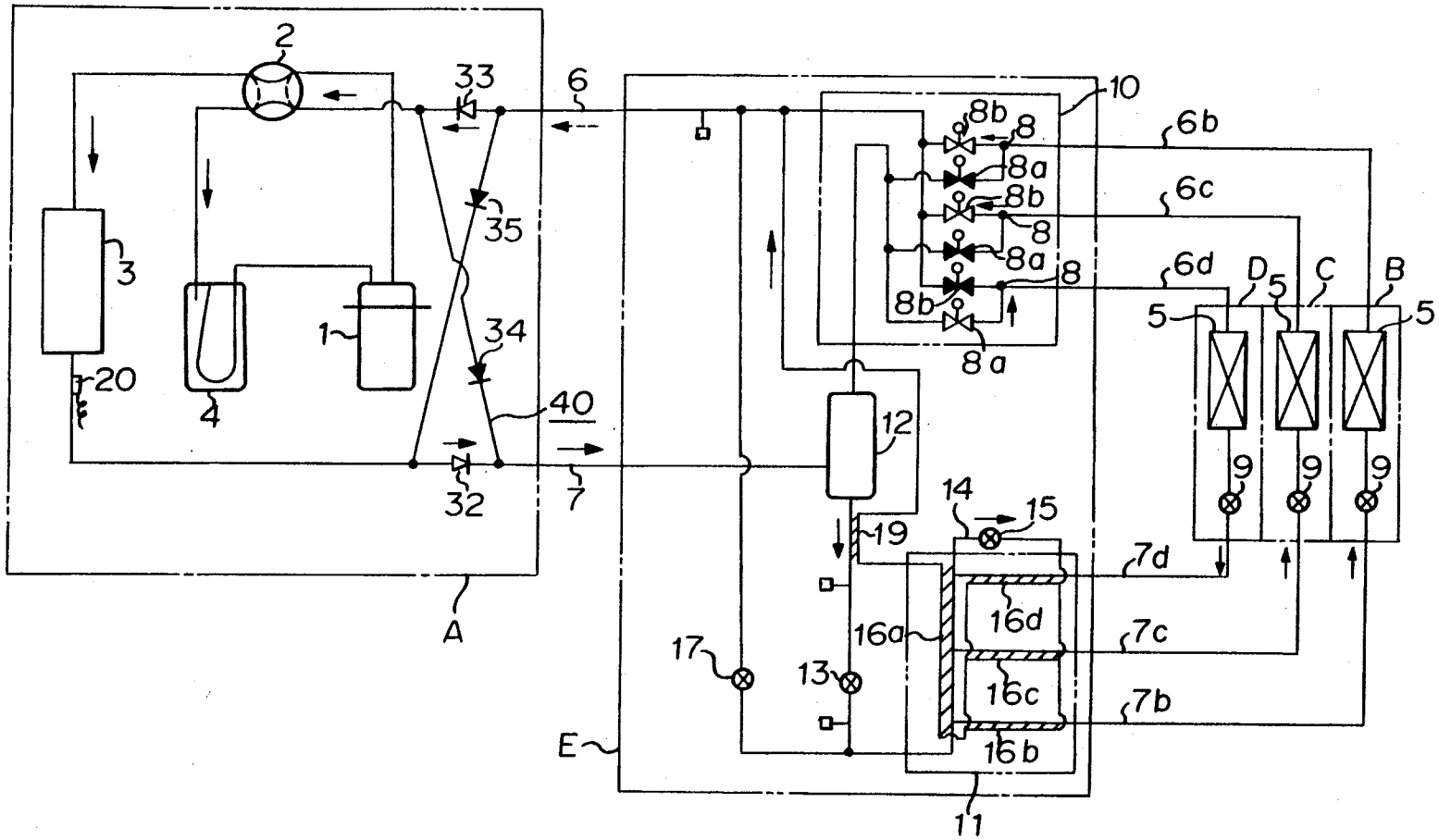
FIG. 33 is a schematic diagram showing the operation state of the thirteenth embodiment of the FIG. 30 wherein room cooling is principally performed under room cooling and room heating concurrent operation (cooling load is greater than heating load)

The refrigerant flows through the refrigerant circuit as indicated by arrows of solid line in FIG. 33. In this mode, the switching valve junctions 8 which are connected to the cooling indoor units B and C have the on-off valves 8b for the second ports opened, and the on-off valves 8a for the first ports closed. The switching valve junction 8 which is connected to the heating indoor unit D has the on-off valve 8a for the first port opened, and the on-off valve 8b for the second port closed.

Now, how to carry out defrosting in accordance with the thirteenth embodiment under the concurrent operation wherein heating is principally performed will be explained, referring to FIG. 34. Explanation will be made for the case wherein the indoor units B and C carry out heating, and the indoor unit D carries out cooling.

Figure 34:
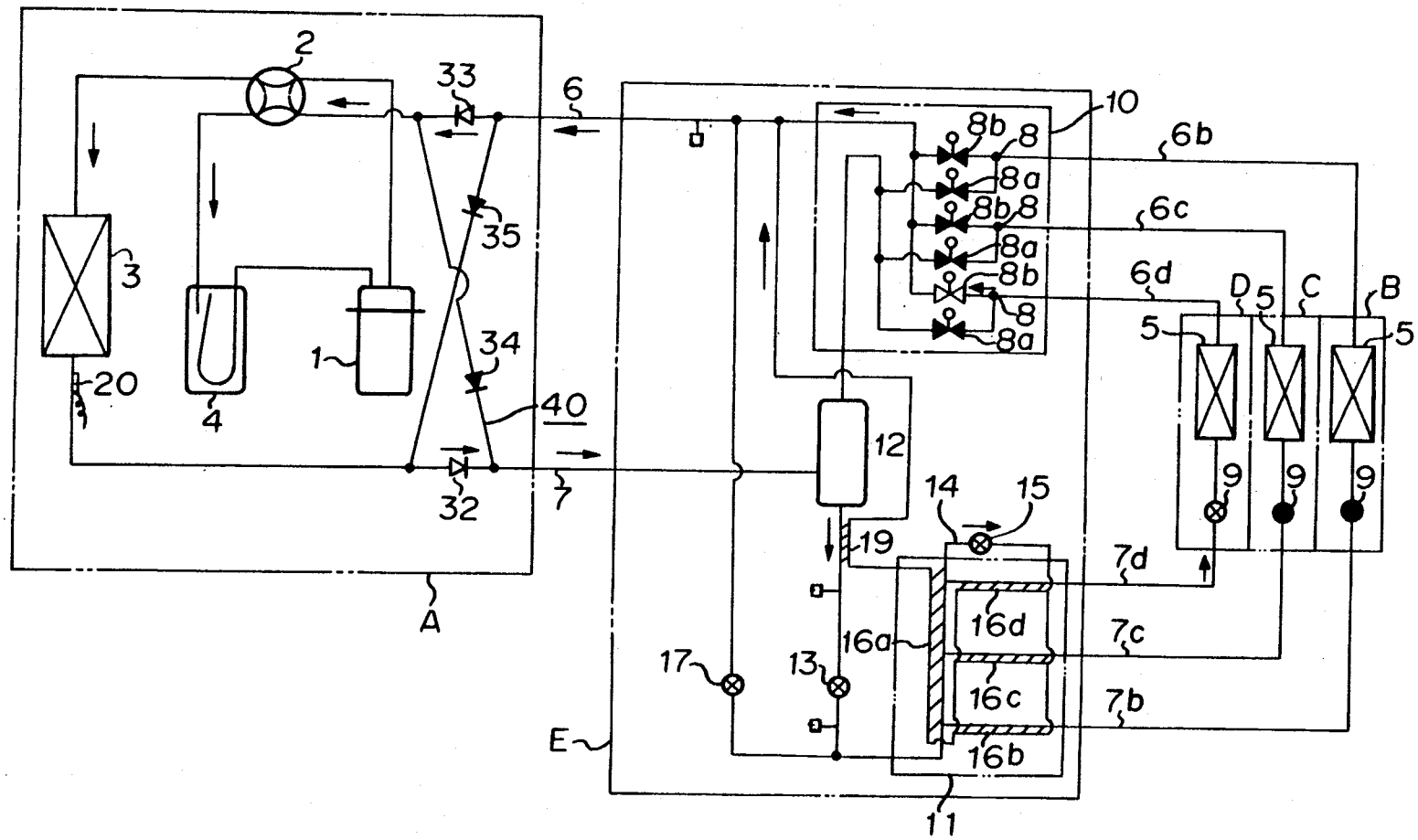
FIG. 34 is a schematic diagram showing the operation state of the thirteen the embodiment of FIG. 30 wherein defrosting is performed.

As indicated by arrows of solid line in FIG. 34, the refrigerant which has been discharged from a compressor 1 and has been a gas having high temperature under high pressure carries out heat exchange at an outdoor heat exchanger 3 to be condensed while defrosting the outdoor heat exchanger 3. After that, the refrigerant passes through a third check valve 32, the second main pipe 7, a gas-liquid separator 12 and a second flow controller 13 in that order. Then the refrigerant passes through the second branch joint 11 and the second branch pipe 7d, and enters the cooling indoor unit D. The refrigerant which has entered the cooling indoor unit D is depressurized to low pressure by a first flow controller 9 which is arranged in the cooling indoor unit D and is fully opened. The refrigerant thus depressurized carries out heat exchange, at an indoor heat exchanger 5 in the indoor unit D, with the air in the room with the indoor unit D in it. The refrigerant is evaporated due to such heat exchange to be gasified, thereby cooling the room. The refrigerant thus gasified passes through the first branch pipe 6d, the first branch joint 10 and the switching valve junction 8, and is inspired into the compressor 1 through the first main pipe 6, a fourth check valve 33, a four way switching valve 2 of a heat source device A, and an accumulator 4. In that manner, a circulation cycle is formed to continue cooling while defrosting. At that time, the switching valve junction 8 which is connected to the cooling indoor unit D has the on-off valve 8a for the first port closed, and the on-off valve 8b for the second port opened. The switching valve junctions 8 which are connected to the other indoor units (in heating, or in stoppage/ventilation) have the first port on-off valves 8a and the second port on-off valves 8b closed. In addition, first flow controllers 9 for indoor units other than the cooling indoor unit are closed. In this time, the first main pipe 6 is at low pressure in it, and the second main pipe 7 is at a high pressure in it, which necessarily causes the third check valve 32 and the fourth check valve 33 to conduct for the refrigerant.

Further, in this cycle, a part of the refrigerant which has passed through the second flow controller 13 enters the bypass pipe 14, and is depressurized to low pressure by the third flow controller 15. The refrigerant thus depressurized carries out heat exchange at the third heat exchanging portions 16b, 16c and 16d, at the second heat exchanging portion 16a and at a first heat exchanging portion 19. The refrigerant which has been evaporated due to such heat exchange passes through the first main pipe 6 and the fourth check valve 33, and is inspired into the compressor 1 through the four way reversing valve 2 and the accumulator 4. On the other hand, the refrigerant which has carried out heat exchange and is cooled at the first, second and third heat exchanging portions 19, 16a, 16b, 16c and 16d to obtain sufficient subcooling enters the cooling indoor unit D.

In that manner, the cooled refrigerant does not pass through the heating indoor heat exchangers 5 and the first branch pipes 6b and 6c to prevent a user from feeling cold in the heating rooms with the indoor heat exchangers 5 in them. The first branch pipes 6b and 6c for the indoor units which are expected to carry out heating are not cooled by the refrigerant, which can shorten the time required to resume ordinary heating from completion of defrosting.

Figure 35:
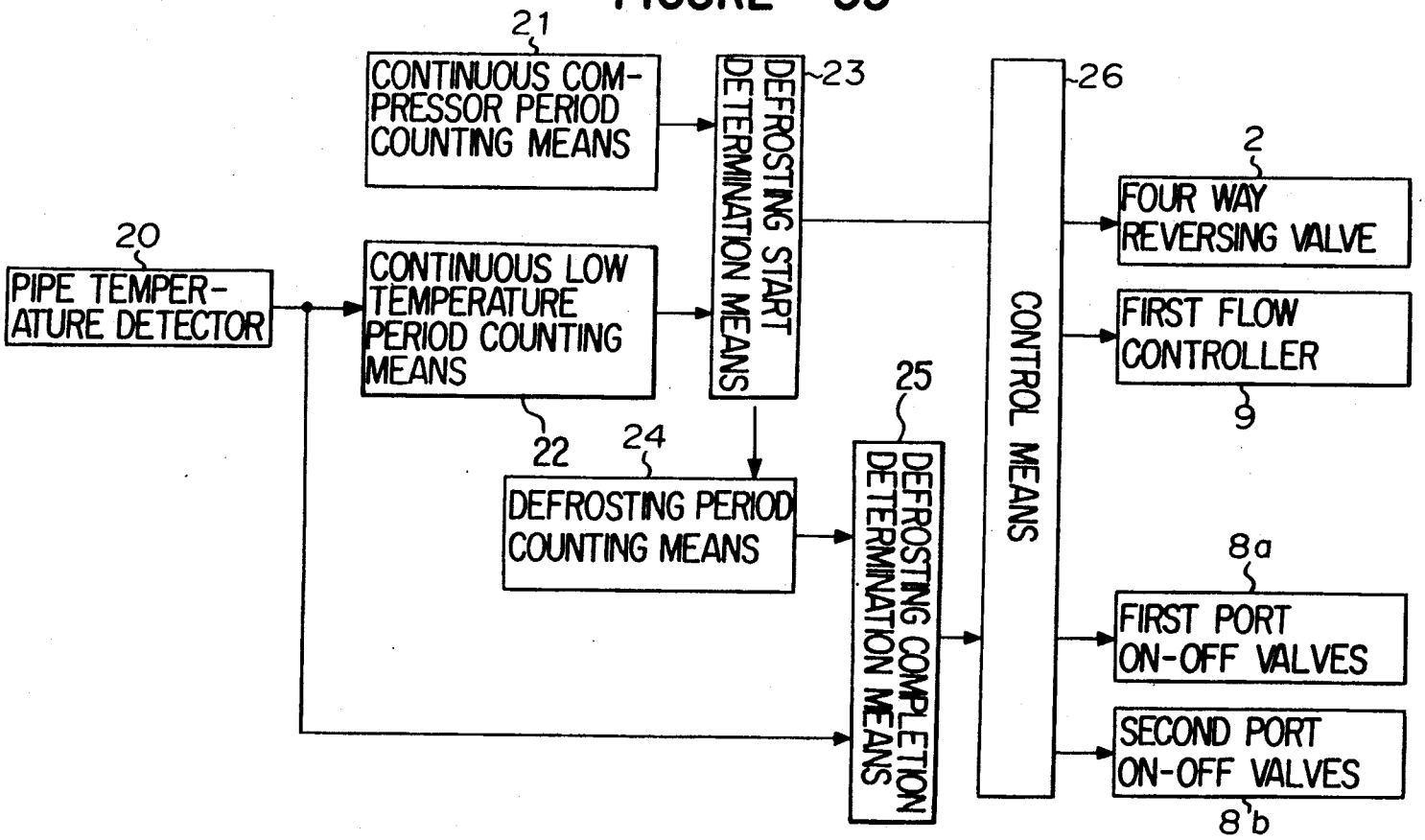
FIG. 35 is a schematic diagram showing the control for the defrosting of the thirteen the embodiment of FIG. 30.
Figure 36:
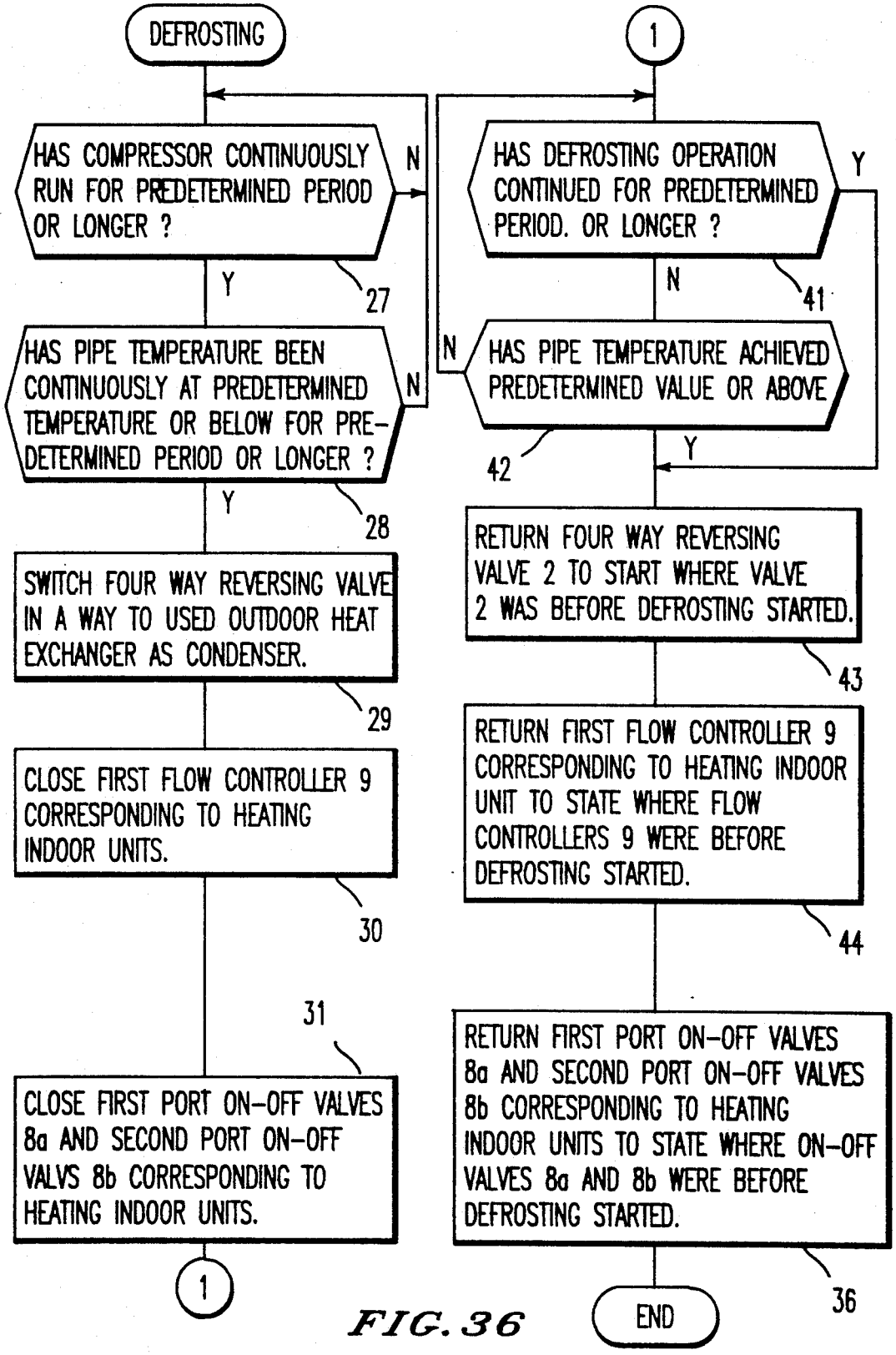
FIG. 36 is a flowchart showing the control of the thirteen embodiment.

Explanation will be continued, referring to FIGS. 35 and 36.

FIG. 35 is a schematic diagram showing the control for the defrosting wherein heating is principally performed under the concurrent operation.

Based on a signal indicative of a continuous compressor operation period from continuous compressor operation period counting means 21, and a signal indicative of a continuous operation at a predetermined temperature or below which is outputted from continuous low pipe temperature period counting means 22 based on a signal indicative of an outdoor heat exchanger temperature detected by a pipe temperature detector 20, defrosting start determination means 23 determines whether defrosting should be started or not. Control means 26 determines the switching of the four way reversing valve 2, the opening angles of the first flow controllers 9, and the on-off operations of the first port on-off valves 8a and the second port on-off valves 8b to carry out the starting operation of defrosting.

With regard to termination control for defrosting, based on a signal indicative of an outdoor heat exchanger temperature detected by the pipe temperature detector 20, and a signal indicative of a defrosting period which is counted by defrosting period counting means 24 since defrosting started as the result of the determination of the defrosting start determination means 23, defrosting completion determination means 25 determines whether defrosting should be terminated or not. Based on such determination, the control means 26 determines the switching of the four way reversing valve 2, the opening angles of the first flow controllers 9, and the on-off operations of the first port on-off valves 8a and the second port on-off valves 8b to carry out the termination control.

Referring now to FIG. 36, there is shown a flow chart showing the defrosting control which is carried out under the concurrent operation wherein heating is principally performed, in accordance with the thirteenth embodiment.

At Steps 27 and 28, the determination of a continuous compressor operation period, and the determination of a continuous low pipe temperature period are made, respectively. If both period are continued for predetermined periods, respectively, the program carries out a defrosting control which is indicated at Step 29 and the subsequent Steps. At Step 29, the four way reversing valve 2 is switched in a way to use the outdoor heat exchanger as condenser. At Step 30, the first flow controllers 9 which correspond to the heating indoor units are closed. At Step 31, the first port on-off valves 8*a* and the second port on-off valves 8*b* which correspond to the heating indoor units are closed.

After defrosting has started, the determination of a defrosting operation period and the determination of a pipe temperature is made at Step 41 and at Step 42, respectively. If the defrosting operation is continued for a predetermined period or longer, or if the pipe temperature has achieved a predetermined value or above, the defrosting termination control is carried out at Step 43 and the subsequent steps. At Step 43, the four way reversing valve 2 is returned to the state where the reversing valve 2 was before defrosting started. At Step 44, the first flow controllers 9 of the heating indoor units are returned to the state where the first flow controllers 9 were before defrosting started. At Step 36, the first port on-off valves 8*a* and the second port on-off valves 8*b* which correspond to the heating indoor units are returned to the state where the on-off valves 8*a* and 8*b* were before defrosting started.

As explained, in accordance with the air conditioning apparatus of the thirteenth embodiment, in defrosting under the concurrent operation, the four way reversing valve is switched. The cooling indoor unit continues cooling operation, and the heating indoor units are disconnected from the refrigerant circuit by closing the on-off valves and the first flow controllers which are connected to the heating indoor units. This arrangement can prevent a user from feeling cold in the heating rooms, and can utilize the quantity of heat obtained from the cooling room to terminate defrosting in a short period.

The first branch pipes which are connected to the heating indoor units are not cooled by the refrigerant, which can shorten the time required to resume ordinary heating from completing of defrosting.

A fourteenth embodiment of the present invention will be explained, referring to FIG. 37 through 39. The structure of the refrigerant circuit, and operations other than defrosting in the fourteenth embodiment are similar to those of the thirteenth embodiment shown in FIGS. 30 through 33.

The defrosting operation of the fourteenth embodiment will be described in detail, referring to FIG. 37.

Figure 37:
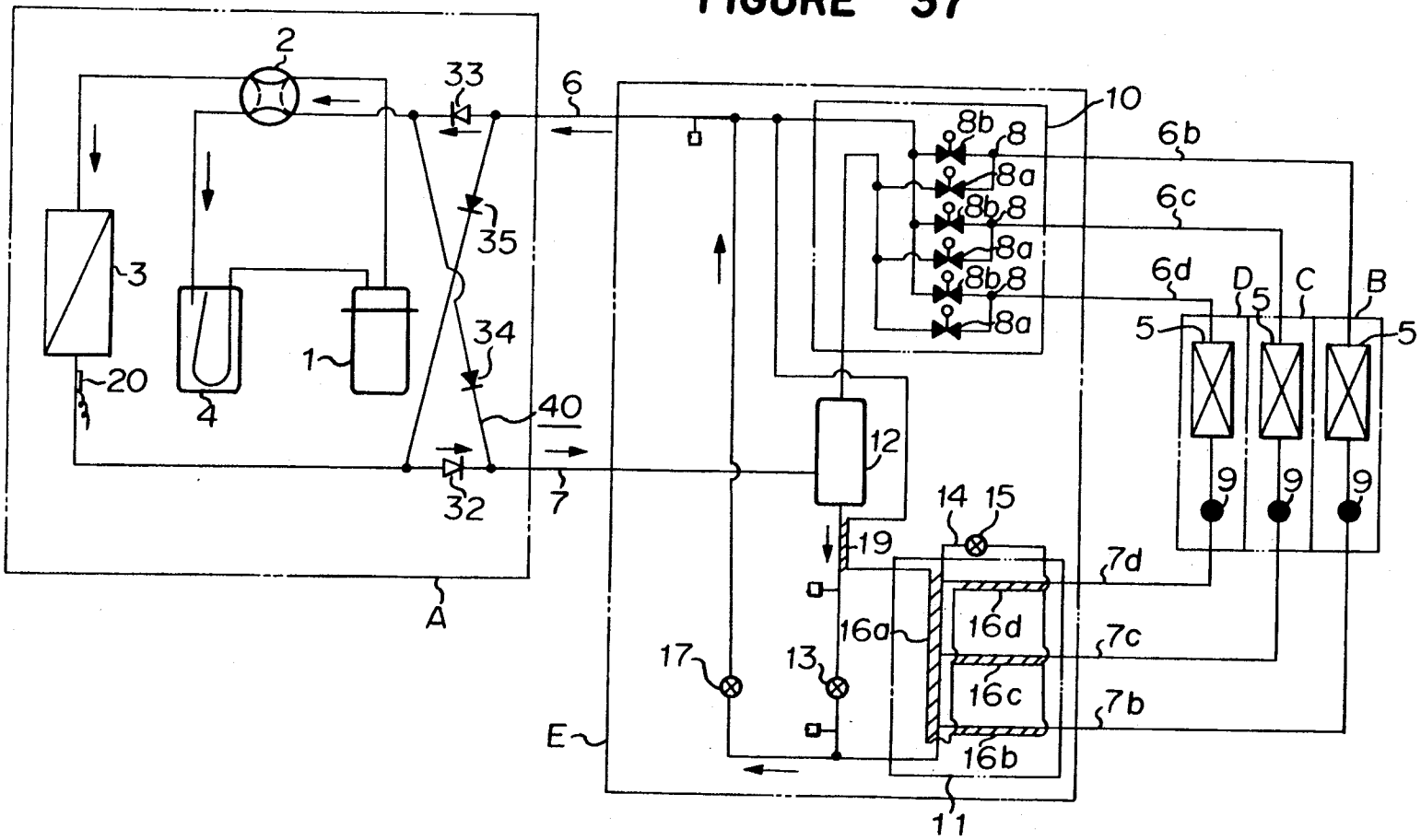
FIG. 37 is a schematic diagram showing the operation state of a fourteenth embodiment wherein defrosting is carried out.

As indicated by arrows of solid line in FIG. 37, the refrigerant gas which has been discharged from a compressor 1 and has high temperature under high pressure radiates heat at an outdoor heat exchanger 3 to be cooled and condensed while defrosting the outdoor heat exchanger. Then the refrigerant passes through a third check valve 32, a second main pipe 7, a gas liquid separator 12, a second flow controller 13 and a fourth flow controller 17 in that order, and enters a first main pipe 6. The refrigerant is inspired into the compressor 1 through a fourth check valve 33, a four way reversing valve 2 in a heat source device A, and an accumulator 4. At that mode, the first main pipe 6 is at low pressure in it, and the second main pipe 7 is at high pressure in it, which necessarily causes the third check valve 32 and the fourth check valve 33 to conduct for the refrigerant.

In addition, in this mode, first port on-off valves 8*a* and second port on-off valves 8*b* of switching valve junctions 8 in a first branch joint 10 are all closed. In addition, first flow controllers 9 in indoor units are all closed. This arrangement prevents the refrigerant from passing through indoor heat exchangers 5 and first branch pipes 6*b*, 6*c* and 6*d*, avoiding the occurrence of such case that user feels cold in a heating room due to an decrease in evaporating temperature of the corresponding indoor unit or that the indoor unit is iced. In addition, the first branch pipes 6*b* and 6*c* and 6*d* which are connected to the indoor units are not cooled by the refrigerant, which can shorten the time required to resume ordinary heating from completion of defrosting.

Figure 38:
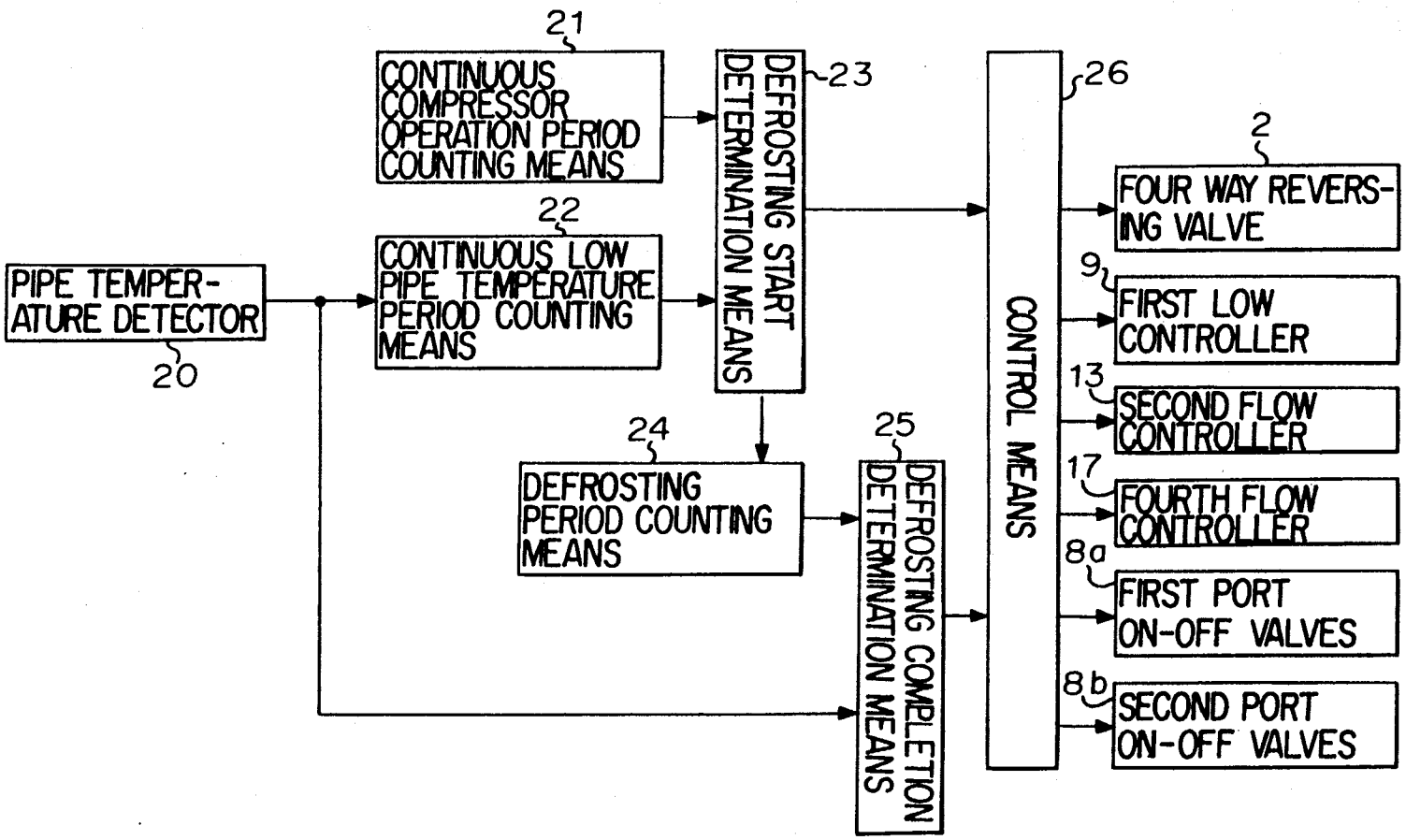
FIG. 38 is a schematic diagram showing the control for the defrosting of the fourteenth embodiment.
Figure 39:
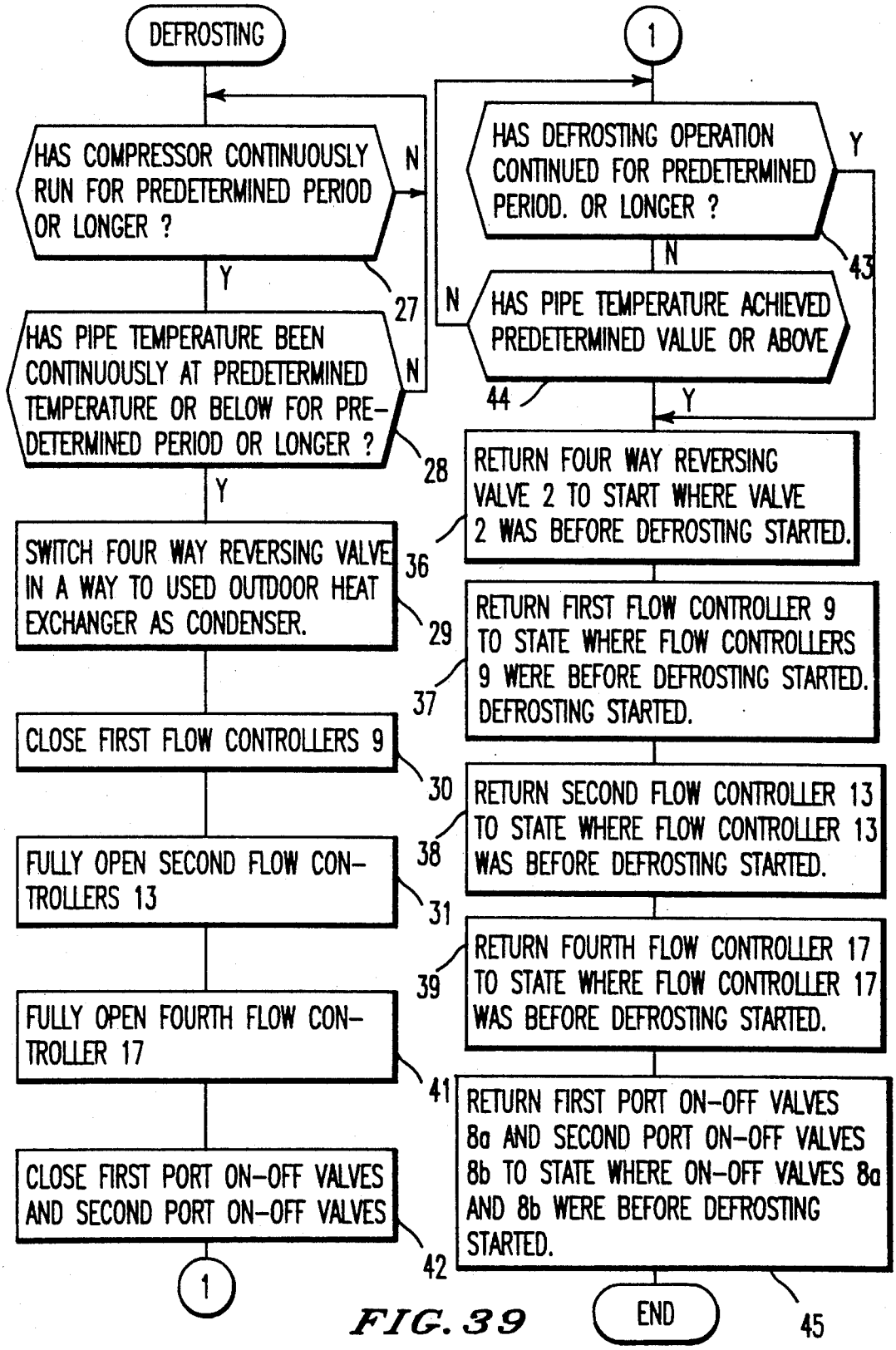
FIG. 39 is a flowchart showing the control of FIG. 38.

Explanation will be continued, referring to FIGS. 38 and 39.

In FIG. 38, there is shown a schematic diagram showing the structure of defrosting control according to the fourteenth embodiment.

With regard to the starting control for defrosting, based on a signal indicative of a continuous compressor operation period from continuous compressor operation period counting means 21, and a signal indicative of a continuous operation at a predetermined temperature or below which is outputted from continuous low pipe temperature period counting means 22 based on a signal indicative of an outdoor heat exchanger temperature detected by a pipe temperature detector 20, defrosting start determination means determines whether to start defrosting. Based on this determination, control means 26 determines the switching of the four way reversing valve 2, the opening angles of the first flow controllers 9, the second flow controller 13 and the fourth flow controller 17, and the on-off operations of the first on-off valves 8*a* and the second on-off valves 8*b* to carry out the starting operation.

With regard to a termination control for defrosting, based on a signal indicative of a defrosting period which is counted by defrosting period counting means 24 since defrosting started as the result of the determination of the defrosting start determination means 23, and a signal indicative of the outdoor heat exchanger temperature which is detected by the pipe temperature detector 20, defrosting completion determination means 25 determines whether to terminate defrosting. As the result of this determination, the control means 26 determines the switching of the four way reversing valve 2, the opening angles of the first flow controllers 9, the second flow controller 13 and the fourth flow controller 17, and the on-off operations of the first port on-off valves 8*a* and the second port on-off valves 8*b* to carry out the defrosting termination control.

In FIG. 39, there is shown a flowchart showing the defrosting control in accordance with the fourteenth embodiment.

At Steps 27 and 28, whether the compressor has continuously run for a predetermined period or longer, and whether the pipe temperature has been continuously at a predetermined temperature or below for a predetermined period or longer are determined. If both affirmative, the program carries out the defrosting control which is indicated at Step 29 and subsequent steps. At Step 29, the four way reversing valve 2 is switched to utilize the outdoor heat exchanger as condenser. At Step 30, the first flow controllers 9 are all closed. At Step 31, the second flow controller 13 is fully opened. At Step 41, the fourth flow controller 17 is fully opened. At Step 42, the first port on-off valves 8*a* and the second port on-off valves 8*b* are closed.

After defrosting started, whether the defrosting operation has continued for a predetermined period or longer, and whether the pipe temperature has achieved a predetermined value or above are determined at Steps 43 and 44. If either one is affirmative, the defrosting termination control is made at Step 36 and the subsequent steps. At Step 36, the four way reversing valve 2 is returned to the state where the reversing valve 2 was before defrosting started. At Step 37, the first flow controllers 9 are returned to the state where the flow controllers 9 were before defrosting started. At Step 38, the second flow controller 13 is returned to the state where the flow controller 13 was before defrosting started. At Step 39, the fourth flow controller 17 is returned to the state where the flow controller 7 was before defrosting started. At Step 45, the first port on-off valves 8*a*, and the second port on-off valves 8*b* are returned, respectively, to the state where the on-off valves 8*a* and 8*b* were before defrosting started.

In accordance with the fourteenth embodiment, in defrosting under the concurrent operation wherein heating is principally performed, or under solo heating, the refrigerant gas which has high temperature under high pressure carries out heat exchange at the heat source device to defrost it. The refrigerant passes through the second main pipe, the second flow controller and the fourth flow controller through a switching valve arrangement in the heat source device, and returns to the switching valve arrangement through the first main pipe.

As explained, in accordance with the air conditioning apparatus of the fourteenth embodiment, in defrosting, the four way reversing valve is switched, the first branch joint is closed, the first flow controllers are closed, and the second and fourth flow controllers are opened, which prevent a user from feeling cold in the conditioned room due to a decrease in the evaporating temperature of the corresponding indoor units, and prevent the indoor units from being iced during defrosting.

In addition, the first branch pipes are not cooled by the refrigerant, which can shorten the time required to resume ordinary heating from completion of the defrosting.

A fifteenth embodiment of the present invention will be described.

The structure of the refrigerant circuit according to the fifteenth embodiment is similar to the first embodiment shown in FIG. 1. The case wherein heating is principally performed under the concurrent operation in accordance with the fifteenth embodiment will be explained, in particular in terms of the features different from the first embodiment, referring to FIG. 3 with respect to the first embodiment.

A part of the liquid refrigerant which has entered a bypass pipe 14 from a confluent portion of second branch pipes 7*b*, 7*c* and 7*d* in a second branch joint 11 is depressurized to low pressure by a third flow controller 15, and carries out heat exchange at third exchanging portions 16*b*, 16*c* and 16*d* and a second heat exchanging portion 16*a*. That part of the refrigerant is evaporated due to such heat exchange, flows into a first main pipe 6, passes through a sixth check valve 35 in a heat source device A and an outdoor heat exchanger 3, carries out heat exchange in the outdoor heat exchanger 3 to be evaporated and gasified. Then the refrigerant is inspired into a compressor 1 through a four way reversing valve 2 in a heat source device A and an accumulator 4. On the other hand, the refrigerant which is in the second branch joint 11 and has been carried out heat exchange and cooled at the second and third heat exchanging portions 16*a*, 16*c*, 16*c* and 16*d* to obtain sufficient subcooling flows into an indoor unit D which is expected to carry out cooling.

In accordance with the fifteenth embodiment, in the case wherein heating is principally performed under the concurrent operation, the gaseous refrigerant which has high pressure is directed to heating indoor units through a heat source device switching valve arrangement, a second main pipe and a first branch joint to carry out heating in the rooms with the indoor unit in them. After that, a part of the refrigerant flows from the second branch joint into an indoor unit which is expected to carry out cooling. That part of the refrigerant enters the first main pipe from the first branch joint. Another part of the refrigerant passes through a fourth flow controller, and joins with the refrigerant which has passed through the cooling indoor unit. The refrigerant thus joined flows through the first main pipe, and returns to the heat source device. In addition, the remaining part of the refrigerant carries out heat exchange at the second heat exchanging portion in the course wherein that part of the refrigerant is directed from the second branch joint to the first main pipe through the bypass pipe with the fourth flow controller in it. That remaining part of the refrigerant can be cooled due to such heat exchange to increase subcooling in a sufficient manner. Then the refrigerant enters the cooling indoor unit.

In the case wherein cooling is principally performed under the concurrent operation, the gaseous refrigerant which has high pressure carries out heat exchange at the heat source device at an arbitrary amount to take a two phase state. The refrigerant passes through the heat source device switching valve arrangement and the second main pipe, and is separated into a gaseous refrigerant and a liquid refrigerant. The gaseous refrigerant thus separated is directed through the first branch joint to an indoor unit which is expected to carry out heating. Then the refrigerant enters the second branch joint. On the other hand, the remaining liquid refrigerant passes through the second flow controller, and joins, at the second branch joint, with the refrigerant which has passed through the heating indoor unit. The refrigerant thus joined enters indoor units which are expected to carry out cooling. After that, the refrigerant is directed from the first branch joint to the heat source device switching valve arrangement through the first main pipe, and returns to the compressor. In addition, a part of the refrigerant carries out heat exchange at the first and second heat exchanging portions in the course wherein that part of the refrigerant is directed from the second branch joint to the first main pipe through the bypass pipe. That part of refrigerant can be cooled due to such heat exchange to increase subcooling in a sufficient manner, and enters the cooling indoor units.

In solo heating, the refrigerant passes through the heat source device switching valve arrangement, the second main pipe and the first branch joint, and is directed to the indoor units to carry out heating. The refrigerant returns to the heat source device switching valve arrangement through the second branch joint and the second main pipe.

In solo cooling, the refrigerant passes through the heat source device switching valve arrangement, the second main pipe and the second branch joint, and is directed to the indoor units to carry out cooling. The refrigerant returns to the heat source device switching valve arrangement through the first branch joint and the first main pipe. In addition, a part of the refrigerant carries out heat exchange at the first and second heat exchanging portions in the course wherein that part of the refrigerant is directed from the second branch joint to the first main pipe through the bypass pipe. That part of refrigerant can be cooled due to such heat exchange to increase subcooling a sufficient manner, and is directed to indoor units which are expected to carry out cooling.

As explained, in accordance with the air conditioning apparatus of the fifteenth embodiment, cooling and heating can be selectively and individually carried out for the plurally indoor units, or cooling can be carried out in one or some indoor units, and simultaneously heating can be carried out in the other indoor units(s). In addition, the refrigerant is distributed to the cooling indoor units after the refrigerant has sufficiently obtained subcooling before the refrigerant is distributed the cooling indoor units. This arrangement can establish good distribution of the liquid refrigerant, and ensure subcooling at the inlets of the first flow controllers, improving reliability. In addition, in solo cooling, and in the concurrent operation wherein cooling is principally performed, the refrigerant which flows through the second main pipe is cooled at the first heat exchanging portion even if the refrigerant in the second main pipe takes a two phase state. As a result, the refrigerant constantly becomes a liquid refrigerant having sufficient subcooling at the inlet of the second flow controller, which facilitates the flow and the flow control of the refrigerant in the second flow controller.

What it claimed is:

1. An air conditioning apparatus comprising:

a single heat source device including a compressor, a reversing valve, an outdoor heat exchanger and an accumulator;

a plurality of indoor units including indoor heat exchangers and first flow controllers;

a first main pipe and a second main pipe for connecting between the heat source device and the indoor units;

a first branch joint which can selectively connect one end of the indoor heat exchanger of each indoor unit to either one of the first main pipe and the second main pipe;

a second branch joint which is connected to the other end of the indoor heat exchanger of each indoor unit through the first flow controllers, and which is also connected to the second main pipe through a second flow controller;

the first branch joint and the second branch joint being connected together through the second flow controller;

the second branch joint being connected to the first main pipe through a fourth flow controller;

a junction device which includes the first branch joint, the second flow controller, the fourth flow controller and the second branch joint, and which is interposed between the heat source device and the indoor units; and the first main pipe having a greater diameter than the second main pipe; and a switching valve arrangement which is arranged between the first main pipe and the second main pipe in the heat source device to switch the first main pipe and the second main pipe to a low pressure side and to a high pressure side, respectively.

2. An air conditioning apparatus according to claim 1, wherein a gas-liquid separator is arranged in the second main pipe; the second flow controller is connected between the gas-liquid separator and the second branch joint; and the junction device includes the gas-liquid separator in addition to the first branch joint, the second flow controller, the fourth flow controller and the second branch joint.

3. An air conditioning apparatus according to claim 1, wherein there are provided a bypass pipe which has one end connected to the second branch joint and the other end connected to the first main pipe through a third flow controller; a first heat exchanging portion which carries out heat exchange between the bypass pipe connecting the third flow controller and the first main pipe, and a pipe connecting the second main pipe and the second flow controller; and the junction device which includes the third flow controller, the first heat exchanging portion and the bypass pipe in addition to the first branch joint, the second branch joint, the second flow controller and the fourth flow controller; thereby to carry out such control that a refrigerant in the second main pipe takes a two phase state, and the state of the refrigerant at an outlet of the first heat exchanging portion achieves a set degree of subcooling.

4. An air conditioning apparatus according to claim 1, wherein there are provided a bypass pipe which has one end connected to the second branch joint and the other end connected to the first main pipe through a third flow controller; a heat exchanging portion which carries out heat exchange at a confluent portion of branch pipes for connecting between the respective indoor units and the second branch joint; heat exchanging portions which carry out heat exchange between the branch pipes and a part of the bypass pipe downstream of the third flow controller; first pressure detecting means arranged between the first branch joint and the second flow controller; second pressure detecting means arranged between the second flow controller and the fourth flow controller; and flow controller control means which controls the third and fourth flow controllers in a way to bring a pressure difference detected by the first and second pressure detecting means in a predetermined range under an operation wherein the indoor units carry out cooling and heating concurrent operation and the outdoor heat exchanger works as evaporator.

5. An air conditioning apparatus according to claim 4, wherein the flow controller control means carries out such control that when the flow rates of the third and fourth flow controllers are increased, the third flow controller takes priority over the fourth flow controller, and wherein when the flow rates of the third and fourth flow controllers are decreased, the fourth flow controller takes priority over the third flow controller.

6. An air conditioning apparatus according to claim 1, there are provided first pressure detecting means on the pipe between the first branch joint and the second flow controller; second pressure detecting means on the pipe between the second flow controller and the fourth flow controller; and flow controller control means for controlling the fourth flow controller in a way to bring the difference between the pressures detected by the first and second pressure detecting means in a predetermined range when heating is carried out at all the indoor units.

7. An air conditioning apparatus according to claim 1, wherein the first branch joint is selectively connected to the one end of the indoor heat exchangers to either one of the first main pipe and the second main pipe through a gas-liquid separator; the first branch joint and the second branch joint are connected together through the gas-liquid separator and the second flow controller; there is provided a bypass pipe which has one end connected to the second branch joint and the other end connected to the first main pipe through a third flow controller; there is provided a first heat exchanging portion which carries out heat exchange between the bypass pipe connecting the third flow controller and the first main pipe, and the pipe connecting the second main pipe and the second flow controller; there is provided boundary surface detecting means for detecting a boundary surface at which a gaseous refrigerant and a liquid refrigerant are divided in the gas-liquid separator; the junction device includes the third flow controller, the first heat exchanging portion, the boundary surface detecting means and the bypass pipe in addition to the first branch joint, the second branch joint, the second flow controller and the fourth flow controller; wherein the boundary surface of the gaseous refrigerant and the liquid refrigerant in the gas-liquid separator is controlled to be at a lower position than a predetermined level, and a refrigerant at the outlet of the first heat exchanging portion is controlled to have a predetermined degree of subcooling.

8. An air controlling apparatus according to claim 1, wherein the first branch joint is provided with first branch ports for connection to the indoor units; the second branch joint is provided with second branch ports for connection to the indoor units; there is provided a bypass pipe which has one end connected to the second branch joint and the other end connected to the first main pipe through a third flow controller; there are provided third heat exchanging portions which carry out heat exchange between the bypass pipe connecting the third flow controller to the first main pipe, and branch pipes connecting the indoor units to the second branch joint; and the junction device includes the third flow controller, the third heat exchanging portions and the bypass pipe as well; wherein depending on the capability of the indoor units connected to the junction device, selection of an individual use of the respective first branch ports and a combined use of some first branch ports is made for connection to the indoor units, and selection of an individual use of the respective second branch ports and a combined use of some second branch ports is also made for connection to the indoor units.

9. An air conditioning apparatus according to claim 1, wherein in defrosting under cooling and heating concurrent operation the four way reversing valve is switched, a cooling indoor unit continues cooling, and the first branch joint and the first flow controller which are connected to a heating indoor unit are closed.

10. An air conditioning apparatus according to claim 1, wherein in defrosting the four way reversing valve is switched, the first branch joint and the first flow controllers are closed, and the second and fourth flow controllers are opened.

11. An air conditioning apparatus according to claim 1, wherein there is provided a bypass pipe which connects between the second branch joint and the first main pipe through a third flow controller; there are provided a first heat exchanging portion which carries out heat exchange between the bypass pipe connecting the third flow controller and the first main pipe, and a pipe connecting the second main pipe and the second flow controller, and a second heat exchanging portion which carries out heat exchange between the bypass pipe connecting the third flow controller and the first main pipe, and the second branch joint; the junction device includes the third flow controller as well.

* * * * *